US008991522B2

(12) United States Patent
Randall et al.

(10) Patent No.: US 8,991,522 B2
(45) Date of Patent: Mar. 31, 2015

(54) DOWNHOLE HYDRAULIC JETTING ASSEMBLY, AND METHOD FOR STIMULATING A PRODUCTION WELLBORE

(75) Inventors: Bruce L. Randall, Tulsa, OK (US); Michael J. Brogdin, Amarillo, TX (US); David Brisco, Duncan, OK (US)

(73) Assignee: Coiled Tubing Specialties, LLC, Tulsa, OK (US)

( * ) Notice: Subject to any disclaimer, the term of this patent is extended or adjusted under 35 U.S.C. 154(b) by 778 days.

(21) Appl. No.: 13/198,802

(22) Filed: Aug. 5, 2011

(65) Prior Publication Data

US 2011/0290561 A1 Dec. 1, 2011

Related U.S. Application Data

(63) Continuation-in-part of application No. 13/033,587, filed on Feb. 23, 2011, now Pat. No. 8,752,651.

(60) Provisional application No. 61/308,060, filed on Feb. 25, 2010.

(51) Int. Cl.
*E21B 7/08* (2006.01)
*E21B 43/114* (2006.01)
(Continued)

(52) U.S. Cl.
CPC . *E21B 7/061* (2013.01); *E21B 7/18* (2013.01); *E21B 29/06* (2013.01); *E21B 43/26* (2013.01)
USPC ..... 175/67; 175/62; 166/298; 166/117.6

(58) Field of Classification Search
CPC ..... E21B 7/06; E21B 7/061
USPC ..... 175/61, 62, 67, 74; 166/298, 55, 117.6, 166/117.5
See application file for complete search history.

(56) References Cited

U.S. PATENT DOCUMENTS 5,413,184 A 5/1995 Landers
5,853,056 A 12/1998 Landers
(Continued)

OTHER PUBLICATIONS

Dickinson, W., Dykstra, H., Nordlund, R., Dickinson, R., Coiled-Tubing Radials Placed by Water-Jet Drilling, SPE No. 26,348, SPE 68th ATCE, Houston, Texas, (Oct. 3-6, 1993).
(Continued)

*Primary Examiner* — David Andrews
(74) *Attorney, Agent, or Firm* — Peter L. Brewer; Baker Donelson

(57) ABSTRACT

A method for forming lateral boreholes from an existing parent wellbore is provided. The wellbore has been completed with a string of production casing. The method generally comprises providing a downhole tool assembly having a whipstock. The method also includes running the assembly down into the parent wellbore. A force is applied to the assembly to cause the whipstock to rotate within the wellbore into an operating position. In this position, a curved face of the whipstock forms a bend-radius substantially across the inner diameter of the casing. A jetting hose is run into the wellbore. Upon contact with the curved face of the whipstock, the jetting hose is re-directed through a window in the production casing. Hydraulic fluid is injected under pressure through the hose to provide hydraulic jetting. The hose is directed through the window and into the formation to create a lateral borehole extending many feet outwardly into a subsurface formation. A downhole tool assembly for forming lateral boreholes from a parent wellbore is also provided herein. The assembly utilizes substantially the entire inner diameter of the casing as the bend radius for a hydraulic jetting hose.

34 Claims, 38 Drawing Sheets

(51) Int. Cl.

| | |
|---|---|
| ***E21B 7/06*** | (2006.01) |
| ***E21B 7/18*** | (2006.01) |
| ***E21B 29/06*** | (2006.01) |
| ***E21B 43/26*** | (2006.01) |

(56) References Cited

U.S. PATENT DOCUMENTS

| | | | | |
|---|---|---|---|---|
| 6,125,949 | A | 10/2000 | Landers | |
| 6,263,984 | B1 | 7/2001 | Buckman, Sr. | |
| 6,378,629 | B1 | 4/2002 | Baird | |
| 6,412,578 | B1 | 7/2002 | Baird | |
| 6,419,020 | B1 | 7/2002 | Spingath | |
| 6,530,439 | B2 | 3/2003 | Mazorow | |
| 6,550,553 | B2 | 4/2003 | Baird | |
| 6,578,636 | B2 | 6/2003 | Mazorow et al. | |
| 6,668,948 | B2 | 12/2003 | Buckman, Sr. et al. | |
| 6,889,781 | B2 | 5/2005 | Mazorow | |
| 6,915,853 | B2 | 7/2005 | Bakke et al. | |
| 6,964,303 | B2 | 11/2005 | Mazorow et al. | |
| 6,971,457 | B2 | 12/2005 | Baird | |
| 7,357,182 | B2 | 4/2008 | Hunt et al. | |
| 7,422,059 | B2 | 9/2008 | Jelsma | |
| 7,441,595 | B2 | 10/2008 | Jelsma | |
| 7,455,127 | B2 | 11/2008 | Schick | |
| 7,669,672 | B2 | 3/2010 | Brunet et al. | |
| 7,686,101 | B2 | 3/2010 | Belew et al. | |
| 7,699,107 | B2 | 4/2010 | Butler et al. | |
| 7,886,834 | B2 * | 2/2011 | Spencer et al. | 166/382 |
| 8,074,744 | B2 | 12/2011 | Watson | |
| 8,196,680 | B2 | 6/2012 | Buckman, Sr. et al. | |
| 2009/0107678 | A1 | 4/2009 | Buckman, Sr. | |
| 2010/0243266 | A1 | 9/2010 | Soby et al. | |
| 2013/0284516 | A1 * | 10/2013 | Prill et al. | 175/61 |

OTHER PUBLICATIONS

Office Action from CIPO dated Mar. 21, 2013 in related Canadian patent application (2 pages).

Summers, D. A., Corwine, J., Chen, L., A Comparison of Methods Available for the Determination of Surface Energy, 12th Symposium on Rock Mechanics, University of Missouri-Rolla (Nov. 1970) http://www.rockmech.mst.edu/documents/ paper6.pdf.

Joshi, S. D., A Review of Horizontal Well and Drainhole Technology, Society of Petroleum Engineers No. 16,868, pp. 339-355; Originally presented at the 62nd Annual Technical Conference and Exhibition of the SPE, Dallas, Texas (Sep. 27-30, 1987).

Olsen, J. H, Abrasive Jet Mechanics, The Fabricator Magazine (Mar. 2005) http://www.omax.com/images/files/abrasivejet%20mechanics.pdf.

Kojic, M., Cheatham, J.B., Jr., Analysis of the Influence of Fluid Flow on the Plasticity of Porous Rock Under an Axially Symmetric Punch, Society of Petroleum Engineers No. 4243; Society of Petroleum Engineer's Journal (Jun. 1974); Originally presented at SPE-AIME Sixth Conference on Drilling and Rock Mechanics, Austin, Texas (Jan. 22-23, 1973).

Summers, D.A., Barker, C.R., Selberg, B.P., Can Nozzle Design Be Effectively Improved for Drilling Purposes, Energy Technological Conference and Exhibition, ASME, Houston, Texas (Nov. 5-8, 1978) http://www.rockmech.mst.edu/documents/paper51.pdf.

*Carl Landers and Landers Horizontal Drill Inc* v *Sideways LLC.*, United States Court of Appeals for the Federal Circuit, 04-1510, -1538 (Decided: Jul. 27, 2005).

Carrell George Gibbons Topical Report, Lateral Drilling and Completion Technologies for Shallow-Shelf Carbonates of the Red River and Ratcliffe Formations, Williston Basin (Jul. 31, 1997). Work performed under Cooperative Agreement No. DE-FC22-94BC14984-16 Improved Recovery Demonstration for Williston Basin Carbonates, prepared for U.S. Department of Energy, National Petroleum Technology Office, Tulsa, Oklahoma, prepared by Luff Exploration Company, Denver, Colorado.

Dickinson, W., Dickinson, R.W., Pesevento, M.J., Data Acquisition Analysis and Control While Drilling With Horizontal Water Jet Drilling Systems, Society of Petroleum Engineers No. 90-127: Joint SPE/CIM International Technical Meeting, Calgary, Canada (Jun. 10-13, 1990).

Momber, A.W., Deformation and Fracture of Rocks Due to High Speed Liquid Impingement, International Journal of Fracture, #130, pp. 683-704, Kluwer Academic Publishers, Netherlands (Aug. 2004).

Tziallas, G.P., Tsiambaos, G., Saroglou, H., Determination of Rock Strength and Deformability of Intact Rocks, EJGE vol. 14, Bund. G, Paper #2008-0960; 12 pages (2009) http://www.ejge.com/2009/Ppr0960/Abs0960.htm.

Summers, D. A., Lehnhoff, T. F., Weakly, L.A., Development of a Water Jet Drilling System and Preliminary Applications of its Performance in a Stress Situation Underground, 4th International Symposium on Jet Cutting Technology, Canterbury, England (Apr. 1978) http://www.rockmech.mst.edu/ documents/paper52.pdf.

Summers, D. A. Disintegration of Rock by High Pressure Jets, University of Leeds, Department of Applied Mineral Sciences, Ph.D. Dissertation (May 1968).

Katz, O., Reches, Z., Roegiers, J.C., Evaluation of Mechanical Rock Properties Using a Schmidt Hammer, International Journal of Rock Mechanics and Mining Science, vol. 37, pp. 723-728 (2000) http://earthquakes.ou.edu/reches/Publications/ Schmidt.htm.

Summers, D.A., Feasibility of Fluid Jet Based Drilling Methods for Drilling Through Unstable Formations, 2002 SPE International Thermal Operations and Heavy Oil Symposium and International Horizontal Well Technology Conference, Calgary, Alberta, Canada (Nov. 4-7, 2002).

Maurer, W.C., Heilhecker, J.K., Love, W.W., High Pressure Drilling, Journal of Petroleum Technology, pp. 851-859 (Jul. 1973).

Dickinson, W., Dickinson, R.W., Horizontal Radial Drilling System, Society of Petroleum Engineers No. 13,949; California Regional Meeting, Bakersfield, California (Mar. 27-29, 1985).

Maurer, W.C., Heilhecker, J.K., Hydraulic Jet Drilling, Society of Petroleum Engineers No. 2,434 (1969).

Pekarek, J.L., Lowe, D.K., Huitt, J.L., Hydraulic Jetting Some Theoretical and Experimental Results, Society of Petroleum Engineers No. 421: Society of Petroleum Engineers Journal, pp. 101-112 (Jun. 1963). Originally presented at 37th Annual Fall Meeting of SPE, Los Angeles, California (Oct. 7-10, 1962).

Kovacevic, R., Hydraulic Process Parameters, Southern Methodist University's Bobby B. Lyle School of Engineering—Website Publication; (undated) http://lyle.smu.edu/rcam/research/waterjet/ProcessParameter/HydraulicprocessParameters.pdf.

Summers, D.A., Clark, G.B., Haas, C.J., Brown, J.W., HyperVelocity Impact on Rock, AIME's Eleventh Symposium on Rock Mechanics, Berkeley, California; Part VI—Chapter 32 (Jun. 1969) http://www.rockmech.mst.edu/documents /paper5.pdf.

Pittman, F.C.,Harriman, D.W., St. John, J.C., Investigation of Abrasive Laden Fluid Method for Perforation and Fracture Initiation, Society of Petroleum Engineers No. 1607-G: Journal of Petroleum Technology, pp. 489-495 (May 1961); Originally Presented at 31st Annual California Regional Fall Meeting of SPE, Pasadena, California (Oct. 20-21, 1960).

Buset, P., Riiber, M., Eek, A., Jet Drilling Tool Cost Effective Lateral Drilling Technology for Enhanced Oil Recovery, Society of Petroleum Engineers No. 68,504; Prepared for presentation at the SPE/ICoTA Roundtable, Houston, Texas (Mar. 7-8, 2001).

Summers, D.A., Iyoho, A.W., Galecki, G., Petroleum Applications of Emerging High Pressure Waterjet Technology, Society of Petroleum Engineers No. 26,347, Society of Petroleum Engineers 68th Annual Technical Conference and Exhibition, Houston, Texas (Oct. 3-6, 1993).

Summers, D.A., Yazici, S., Progress in Rock Drilling, Mechanical Engineering (Dec. 1989) http://www.rockmech.mst.edu/documents/paper157.pdf.

Olson, John H., Pumping Up the Waterjet Power, pp. 1-5 (Dec. 11, 2007) www.omax.com.

Summers, D.A., Recent Advances in the Use of High Pressure Waterjets in Drilling Applications, Advanced Mining Technology Workshop, NADET Institute, Colorado School of Mines, Golden, Colorado (Oct. 5-6, 1995) http://www.rockmech.mst.edu/documents/paper211.pdf.

(56) References Cited

OTHER PUBLICATIONS

Feenstra, R., Pols, A.C., Van Stevenick, J., Rock Cutting by Jets a Promising Method of Oil Well Drilling, Society of Petroleum Engineers No. 4,923, Publ. 425 (Sep. 1973) Presented at the 103rd AIME Annual Meeting, Dallas, Texas (Feb. 24-28, 1974).
Dickinson, W., Dickinson, R.W., Herrera, A., Dykstra, H., Nees, J., Slim Hole Multiple Radials Drilled with Coiled Tubing, Society of Petroleum Engineers No. 23,639: 2nd Latin American Petroleum Engineering Conference, Caracas, Venezuela (Mar. 8-11, 1992).
Smith Services, A Business Unit of Smith International, Inc., Smith International Inc Trackmaster PLUS Wellbore Departure Systems, Houston, Texas (Apr. 2005).
Summers, D.A., The Application of Waterjets in a Stressed Rock Environment, Third Conference on Ground Control Problems in the Illinois Coal Basin, Mt Vernon, Illinois (Aug. 8-10, 1990) http://www.rockmech.mst.edu/documents/paper158.pdf.
Haga, P.C., Lin, B., Roxborough, F.F., The Cuttability of Rock Using a High Pressure Water Jet, School of Mining Engineering, The University of New South Wales (1990) http://www.mining.unsw.edu.au/Publications/publications_staff/Paper_Hagan_WASM.htm.
Summers, D.A.; Henry, R.L., The Effect of Change in Energy and Momentum Levels on the Rock Removal in Indiana Limestone, 1st International Symposium on Jet Cutting Technology, Coventry, England (Apr. 1972) http://www.rockmech.mst.edu/ documents/paper10.pdf.
Summers, D.A., Weakly, L.A., The Effect of Stress on Waterjet Performance, 19th Symposium on Rock Mechanics, Lake Tahoe, Nevada (May 1978) http://www.rockmech.mst.edu/ documents/paper53.pdf.
Summers, D.A., Brook, N.; The Penetration of Rock by High Speed Water Jets, Int. J. Rock Mech. Min. Sci. vol. 6, pp. 249-258 Pergamon Press (1969) Great Britain (Manuscript received Oct. 30, 1968) http://www.rockmech.mst.edu/ documents/paper4.pdf.
US Hose Corp, USHose Corporation Engineering Guide No. 350, Technical Specifications for USHOSE's Flexible Hoses, Romeoville, Illinois and Houston, Texas (Copyright 2006).
Summers, D.A., Henry, R.L., Water Jet Cutting of Sedimentary Rock, Journal of Petroleum Technology, pp. 797-802 (Jul. 1972) http://www.rockmech.mst.edu/documents/paper12.pdf.
Summers, D.A., Water Jet Cutting Related to Jet and Rock Properties, 14th Symposium of Rock Mechanics, Penn State University, University Park, Pennsylvania (Jun. 12-14. 1972) http://www.rockmech.mst.edu/documents/paper11.pdf.
Summers, D.A., Clark, G.B., Water Jet Penetration into Rock, (Nov. 1970) http://www.rockmech.mst.edu/ documents/paper5a.pdf.
Summers, D.A., Waterjet Applications Session Review, 5th Pacific Rim International Conference on Water Jet Technology, New Delhi, India (Feb. 3-5, 1998) http://www.rockmech.mst.edu/documents/paper231.pdf.
Well Enhancement Services, LLC, Radial Jet Enhancement Brochure, The Woodlands, Texas (Jun. 2009) www.wellenhancement.com.
Well Enhancement Services, LLC, Radial Jet Enhancement, 7-page article, The Woodlands, Texas (Jun. 2009) www.wellenhancement.com.
Halliburton, Hydra Jet Perforating Process Service Brochure for Hydra-JetSM Perforating Process Service (Sep. 2006) www.halliburton.com.
TIW Corporation, TIW Abrasive Jet Horizontal Drill, A Pearce Industries Company located in Houston, Texas (undated slides).
Vortech Oilfield Tools, LP, Vortech Oilfield Tools, www.Vortech-Inc.com; Technical publication for Vortech pulsating jet tools, Midland, Texas (undated).
Leach, S. J., Walker, G. L.; Phil. Trans. A, Application of High Speed Liquid Jets to Cutting, vol. 260, plate 60 (1966) http://www.physics.princeton.edu/.../fluids/leach ptrsl a290 295 66.pdf.
Cooley, W. C., Correlation of Data on Erosion and Breakage of Rock by High Pressure Water Jets, 12th U.S. Symposium on Rock Mechanics (USRMS), Rolla, Missouri (Nov. 16-18, 1970).
Labus, T. J., Energy Requirements for Rock Penetration by Water Jets, 3rd International Symposium on Jet Cutting Technology, Cranfield, Bedford, England (1976).
Summers, D. A., Lehnhoff, T. F., Water Jet Drilling in Sandstone and Granite, Proceedings from the 18th Symposium on Rock Mechanics, Keystone, Colorado (May 1977).
Rehbinder, G., A Theory About Cutting Rock with a Water Jet, Journal of Rock Mechanics and Rock Engineering, Springer Wein, vol. 12/3-4, pp. 247-257 (Mar. 1980) (Manuscript submitted Oct. 1979).
Maurer, W. C., Advanced Drilling Techniques Chapter 12: "High Pressure Jet Drills (Continuous)," pp. 229-301 (1980).
Hashish, M., Experimental Studies of Cutting With Abrasive Waterjets, 2nd U.S. Waterjet Conference, University of Missouri-Rolla (May 1983).
Ford, L.M., Water Jet Assisted Mining Tools: What Type Assistance and What Type Mining Machine?, Energy Citations Database (ECD) Document #6474987 (1983) http://www.osti.gov/energycitations/product.biblio.jsp?osti id=6474987.
Kolle, J.J., A Comparison of Water Jet, Abrasive Jet and Rotary Diamond Drilling in Hard Rock, Tempress Technologies, Inc., Oil and Gas Journal vol. 96, Issue 16 (Apr. 20, 1998) http://www.tempresstech.com/bookshelf/5.pdf.
Momber, A.W., Kovacevic, R., An Energy Balance of High-Speed Abrasive Water Jet Erosion, Proceedings of the Institution of Mechanical Engineers, vol. 213 Part J, pp. 463-473 (Dec. 1998).
Orbanic, H., Junkar, M., Bajsic, I., Lebar, An Instrument for Measuring Abrasive Water Jet Diameter, International Journal of Machine Tools & Manufacture, #49, pp. 843-849 (May 2009).
Summers, D.A., Yazici, S., Abrasive Jet Drilling: A New Technology. 30th U. S. Symposium on Rock Mechanics, Morgantown, West Virginia (Jun. 1989).
Mayerhofer, Michael J., SRV Proves Key in Shales for Correlating Stimulation and Well Performance, The American Oil & Gas Reporter, pp. 81-89 (Dec. 2010).

* cited by examiner

DOWNHOLE HYDRAULIC JETTING ASSEMBLY, AND METHOD FOR STIMULATING A PRODUCTION WELLBORE

STATEMENT OF RELATED APPLICATIONS

This application claims the benefit of U.S. patent application Ser. No. 13/033,587 filed Feb. 22, 2011. That application is entitled "Downhole Hydraulic Jetting Assembly, and Method for Stimulating a Production Wellbore." That application is incorporated by reference herein in its entirety.

The above non-provisional patent application claimed the benefit of U.S. Provisional Patent Application 61/308,060 filed Feb. 25, 2010. That application is also entitled "Downhole Hydraulic Jetting Assembly, and Method for Stimulating a Production Wellbore." That application is incorporated by reference herein as well.

STATEMENT REGARDING FEDERALLY SPONSORED RESEARCH OR DEVELOPMENT

This application is filed as a continuation-in-part of U.S. patent application Ser. No. 13/033,587 filed Feb. 22, 2011. That application is entitled "Downhole Hydraulic Jetting Assembly, and Method for Stimulating a Production Wellbore." That application is incorporated by reference herein in its entirety.

THE NAMES OF THE PARTIES TO A JOINT RESEARCH AGREEMENT

The above non-provisional patent application claimed the benefit of U.S. Provisional Patent Application No. 61/308,060 filed Feb. 25, 2010. That application is also entitled "Downhole Hydraulic Jetting Assembly, and Method for Stimulating a Production Wellbore." That application is incorporated by reference herein as well.

BACKGROUND OF THE INVENTION

This section is intended to introduce selected aspects of the art, which may be associated with various embodiments of the present disclosure. This discussion is believed to assist in providing a framework to facilitate a better understanding of particular aspects of the present disclosure. Accordingly, it should be understood that this section should be read in this light, and not necessarily as admissions of prior art.

FIELD OF THE INVENTION

The present disclosure relates to the field of well stimulation. More specifically, the present disclosure relates to the stimulation of a hydrocarbon-producing formation by the formation of small lateral boreholes from an existing wellbore using a jetting assembly.

DISCUSSION OF TECHNOLOGY

In the drilling of oil and gas wells, a wellbore is formed using a drill bit that is urged downwardly at a lower end of a drill string. After drilling to a predetermined depth, the drill string and bit are removed and the wellbore is lined with a string of casing. An annular area is thus formed between the string of casing and the formation penetrated by the wellbore. A cementing operation is typically conducted in order to fill or "squeeze" part or all of the annular area with columns of cement. The combination of cement and casing strengthens the wellbore and facilitates the zonal isolation, and subsequent completion, of certain sections of potentially hydrocarbon-producing formations (or "pay zones") behind the casing.

It is common to place several strings of casing having progressively smaller outer diameters into the wellbore. A first string may be referred to as a conductor pipe or surface casing. Such casing string serves to isolate and protect the shallower, fresh water-bearing aquifers from contamination by any other wellbore fluids. Accordingly, these casing strings are almost always cemented entirely back to the surface. The process of drilling and then cementing progressively smaller strings of casing is repeated several times until the well has reached total depth. In some instances, the final string of casing is a liner, that is, a string of casing that is not tied back to the surface. The final string of casing, referred to as a production casing, is also typically cemented into place.

Additional tubular bodies may be included in a well completion. These include one or more strings of production tubing placed within the production casing or liner. Each tubing string extends from the surface to a designated depth proximate a production interval, or "pay zone." Each tubing string may have a packer attached at a lower end. The packer serves to seal off the annular space between the production tubing string(s) and the surrounding casing.

In some instances, the pay zones are incapable of flowing fluids to the surface efficiently. When this occurs, the operator may include artificial lift equipment as part of the wellbore completion. Artificial lift equipment may include a downhole pump connected to a surface pumping unit via a string of sucker rods run within the tubing. Alternatively, an electrically-driven submersible pump may be placed at the bottom end of the production tubing. Gas lift valves, plunger lift systems, or various other types of artificial lift equipment and techniques may also be employed to assist fluid flow to the surface.

As part of the completion process, a wellhead is installed at the surface. The wellhead serves to contain wellbore pressures and direct the flow of production fluids at the surface. Fluid gathering and processing equipment such as pipes, valves, separators, dehydrators, gas sweetening units, and oil and water stock tanks may also be provided. Subsequent to completion of the pay zone(s) followed by installation of any requisite downhole tubulars, artificial lift equipment, and the wellhead, production operations may commence. Wellbore pressures are held under control, and produced wellbore fluids are segregated and distributed appropriately.

Within the United States, many wells are now drilled principally to recover oil and/or natural gas, and potentially natural gas liquids, from pay zones previously thought to be too impermeable to produce hydrocarbons in economically viable quantities. Such "tight" or "unconventional" formations may be sandstone, siltstone, or even shale formations. Alternatively, such unconventional formations may include coalbed methane. In any instance, "low permeability" typically refers to a rock interval having permeability less than 0.1 millidarcies.

In order to enhance the recovery of hydrocarbons, particularly in low-permeability formations, subsequent (i.e., after perforating the production casing or liner) stimulation techniques may be employed in the completion of pay zones. Such techniques include hydraulic fracturing and/or acidizing. In addition, "kick-off" boreholes may be formed from a primary wellbore in order to create one or more new directional or horizontally completed wellbores. This allows a well to penetrate along the plane of a subsurface formation to increase exposure to the pay zone. Where the natural or hydraulically-induced fracture plane(s) of a formation is vertical, a horizontally completed wellbore allows the production casing to intersect multiple fracture planes.

It is contemplated that there are thousands of pay zones in thousands of existing vertical wells that could be enhanced by the addition of horizontal boreholes. Such wells could be drilled radially from the existing primary or vertical wellbores. However, the existing wellbores likely have substantial technical constraints that make the process of forming lateral boreholes either physically difficult or completely cost-prohibitive. Such constraints to the conventional horizontal kick-off/build-angle/case-and-cement process may include:

(a) Existing wellbore geometry. If the existing production casing has a relatively small inner diameter ("I.D."), the wellbore may not be able to accept the outer diameters ("O.D.'s") of the downhole tools required to complete a lateral borehole. Similarly, even if a conventional horizontal well can be drilled and cased, the resulting I.D. of the new inner string of casing may be too confining as to permit the requisite fracture stimulation treatment(s). Finally, even if wellbore geometry constraints are alleviated, the "telescoping down" result of adding new tubulars within existing tubulars will result in a reduced I.D. of production tubing. This can constrict production rates below profitable levels.

(b) Existing wellbore integrity. The existing production casing may not be capable of withstanding the equivalent circulating densities ("ECD's") of the casing milling/formation drilling fluids required to complete a lateral borehole. Similarly, an open set of shallow, uphole perforations may impose the same constraint.

(c) Reservoir pressure depletion. The existing reservoir pressure may be insufficient to facilitate the ECD's of the casing milling/formation drilling process. Further, simply "killing" the well (i.e., pumping a hydrostatic column of fluid down hole to keep the well from flowing during recompletion operations) may pose significant risk to the reserves.

(d) Cost Constraints. Though substantive incremental additions to hydrocarbon production rates and EUR's may be gained from a conventional horizontal kick-off/build-angle/case-and-cement process, they still may not be enough to warrant the relatively large capital expenditure.

Given the above, it is understandable why there are generally more attempts at drilling new horizontal wells than there are recompletion attempts to add horizontal laterals to existing vertical wellbores.

A relatively new technique that has been developed to address the above-listed constraints involves the use of hydraulic jetting forces. Jetting forces have been employed to erosionally "drill" relatively small diameter lateral boreholes from an existing vertical well into a pay zone. In this technique, the "drilling equipment" is run into the existing wellbore and down to the pay zone, and then exits the wellbore perpendicular to its longitudinal axis. Depending on the specific technique employed, the transition from a vertical orientation to a horizontal orientation may not be accomplished entirely within the inner diameter of the existing production casing or liner at the level or depth of the pay zone.

According to the jetting technique, lateral boreholes are generally formed by placing a nozzle at the end of a string of "jetting hose." The jetting hose is typically ¼" to ⅝" O.D. flexible tubing that is capable of withstanding relatively high internal pressures. The parent well is "killed," and the production tubing is pulled out of the wellbore. A hose-bending "shoe" is attached to the end of the production tubing string, which is then re-run into the wellbore. The shoe is comprised of an assembly having an entry port at the top, and an exit port located below, providing a substantially 90-degree turn. Thus, in a vertical wellbore, the jetting hose is run through the tubing, and is directed into the shoe vertically. The jetting hose bends along the shoe, and then exits the shoe where it is directed against the I.D. of the casing at the point of the desired casing exit.

In this known jetting technique, the entirety of the required angle is typically "built" within the walls of the existing borehole. More specifically, the entire angle is built within the guide shoe itself. By necessity, the shoe has a smaller O.D. than the production casing's I.D. This serves as a significant limitation to the size of the jetting hose. In addition, the thickness of the guide shoe material itself further reduces the I.D. of the guide shoe and, hence, the bend radius available to the jetting hose. An example of such a limited-bend lateral jetting device is described in U.S. Pat. Publ. No. 2010/0243266 entitled "System and Method for Longitudinal and Lateral Jetting in a Wellbore."

In operation, the production tubing is landed at a point within the production casing (or liner) such that the exit port of the hose-bending shoe is adjacent to the pay zone of interest. A small casing milling device or under-reaming tool is attached to the end of the jetting hose, and run down inside the tubing. Some configurations involve a mechanically-driven mill, but most are configured such that the mill is rotated by use of hydraulic forces. The casing milling device is directed through the guide shoe and against the wall of the casing so as to form a casing exit.

Once a window is milled through the casing wall, milling typically continues through the cement sheath, and a few inches into the pay zone itself. The mill and milling assembly is then tripped out of the hole by "spooling up" the jetting hose, and is replaced by a hydraulic jetting nozzle. The jetting nozzle and jetting hose are then spooled back into the tubing, passed through the guide shoe, run through the new casing exit, and then urged laterally through the pay zone, beginning at the point milling operations previously ceased.

A high pressure pump capable of pumping fluids at discharge pressures of several thousand psi, and at rates of several gallons per minute, is an integral part of the surface equipment for this configuration. The high-pressure pump must discharge an adequate volume of fluid at sufficient pressures as to overcome the significant friction losses through the small I.D. jetting hose, and generate sufficient hydraulic horsepower exiting the small holes in the jetting nozzle to erode, or "jet," a borehole in the formation itself. As the borehole is eroded in the selected pay zone, the jetting hose is continuously fed to enable the jetted opening to extend radially from the original wellbore, out into the pay zone.

Once either the desired or maximum achievable length of the horizontal borehole is reached, the jetting nozzle and hose are "spooled up" and retrieved from the borehole. Fluid may continue to be injected during retrieval so as to allow rearward thrusting jets in the jetting nozzle to clean the new borehole and possibly expand its diameter. The jetting nozzle and hose are further reeled back through the guide shoe and tubing, and back to the surface. Upon retrieval, the production tubing (with the guide shoe still attached) is then rotated, say, a quarter-turn. Assuming the downhole rotation of the guide shoe is directly proportional to the surface rotation of the production tubing (an assumption that decreases in likelihood in direct proportion to a parent wellbore's increasing depth and tortuosity), the guide shoe is then also reoriented at the desired 90-degrees from the azimuth of the original borehole, and the process is repeated. Commonly, the process would be repeated three times, yielding four new perpendicular boreholes, or "mini-laterals."

It is significant to note that the two known commercially-available forms of this process do not contemplate either measurement or control of the exact path of the mini-laterals, though they do claim lateral lengths of 300 to 500 feet from the original wellbore. In actuality, neither real-time measurement nor control of the lateral path may be necessary, as deviations from the original trajectory of the horizontal path from the wellbore may be insignificant. Authors, such as Summers, et al. (2002), have noted that fluid jet systems are "not susceptible to the geologically induced deviations encountered with mechanical bits, since no mechanical contact is made with the rock while drilling." While Kolle (1999) has beneficially noted "jet erosion requires no torque or thrust, high pressure jet drilling provides a unique capability for drilling constant radius directional hole without the need for steering corrections."

Darcy and Volumetric calculations may be made to determine the anticipated increase in production rates and recoverable reserves from the formation of horizontal mini-lateral boreholes off of an existing vertical wellbore. First, using a gas well as an example, the Darcy equation may be used to compute gas production rate:

$$Q_g = \frac{703\,kh(P_e^2 - P_w^2)^n}{\mu z T \ln(r_e / r_w')}$$

where $Q_g$=gas production rate (MCFPD)

k=formation permeability (Darcy's)

h=average formation thickness (feet)

$P_e$=reservoir pressure at the drainage radius (psia)

$P_w$=bottom-hole flowing pressure (psia)

n=deliverability coefficient (dimensionless)

μ=viscosity (cp)

z=gas compressibility factor (dimensionless)

T=temperature (° R=° F.+460)

$r_e$=external (i.e., "drainage") radius (feet)

$r_w'$=the effective parent wellbore radius, as computed from the van Everdingen skin factor ("S") equation, $S=-\ln(r_w'/r_w)$ where $r_w$ is the radius of the parent wellbore as drilled (ft).

The Volumetric Equation can be employed to compute the recoverable gas reserves:

$$G_p=0.001*(\pi*r_e^2)*h*\phi*(1-S_w)*[(1/B_{gi})-(1/B_{ga})]$$

where $G_p$=remaining recoverable gas reserves (MSCF)

$r_e$=external (i.e., "drainage") radius (feet)

h=average formation thickness (feet)

ϕ=porosity (%)

$S_w$=water saturation of the pore spaces (%)

$B_{gi}$=initial gas formation volume factor $B_{ga}$=gas formation volume factor at abandonment where $$B_g = \left[\frac{14.65}{P_R + 14.65}\right]\left[\frac{T_R(°\text{F.}) + 460}{460_60\,(°\text{F.})}\right] * Z$$

assuming $P_{Rab}$=200 psia

Z=gas compressibility factor (dimensionless)

An example of a projection may be taken from an actual gas well in Hemphill County, Texas. This is the Centurion Resources, LLC's Brock "A" #4-63. The subject well was completed in the Granite Wash 'A' formation, at a mid-point depth of perforations at a depth of 10,532 feet. The pay zone is 68 feet thick, having an original reservoir pressure of 4,000 psia. The deliverability coefficient, "n", is equal to 0.704.

The average formation porosity is assumed to be 10%, while the water saturation is about 40.9%. The average reservoir pressure at abandonment was 200 psia.

Given the "μ" and "Z" values obtained from correlations for the actual gas sampled, and using the actual bottom-hole temperature and pressures observed, solving for "k" suggests a formation permeability of 4.37 millidarcies. Note that these "original condition" calculations reflect an $r_w'=r_w$=0.328 feet, or half of the original 7⅞ inch hole diameter.

For purposes of the calculation, it is assumed that the well has been, and will continue to be, produced at a constant bottom-hole flowing pressure of 100 psia. It is further assumed that the well will drain a perfectly radial reservoir volume, and that the reservoir is cylindrical. It is still further assumed that, after perforating, the subsequent acid job eliminated all formation damage induced by drilling and cementing such that the subsequent post-acid (pre-frac) skin factor, "S", was equal to zero, at which point the steady-state flow rate was 213 MCFPD.

Table 1, below, is provided as a columnar summary of the data from the above Darcy and Volumetric equations.

| | Original Completion (Post-Acid) | Original Completion (Post-Frac) | Depletion Case (Post-Frac) | Depletion Case (Post-Frac, + Laterals) |
|---|---|---|---|---|
| Darcy Equation, Radial Flow, Gas (with Skin) $Q_g = \frac{703\,kh(P_e^2 - P_w^2)^n}{\mu z T \ln(r_e / r_w')}$ | | | | |
| $Q_g$ | 213 | 563 | 77 | 108.95 |
| K | 0.00437 | 0.00437 | 0.00437 | 0.00437 |
| $P_e$ | 4,000 | 4,000 | 700 | 957.13 |
| $P_w$ | 100 | 100 | 100 | 100 |
| μ | 0.0231 | 0.0231 | 0.0143 | 0.0143 |
| z | 0.94077 | 0.94077 | 0.94394 | 0.94394 |

-continued

| | Original Completion (Post-Acid) | Original Completion (Post-Frac) | Depletion Case (Post-Frac) | Depletion Case (Post-Frac, + Laterals) |
|---|---|---|---|---|
| T | 670 | 670 | 670 | 670 |
| $r_e$ | 912.10 | 988.49 | 988.49 | 1,412.10 |
| (implies a drainage area in Acres) | 60.00 | 70.47 | 70.47 | 143.81 |
| $r_w'$ | 0.328 | 48.958 | 48.958 | 51.409 |
| S | 0.00000 | −5.00533 | −5.00533 | −5.05418 |
| exposed sand face ($ft^2$) | 140.19 | 20,917.77 | 20,917.77 | 21,964.97 |
| Equivalent fracture wing (ft) (calculated from the assumed value of "S") | | 76.39 | 76.39 | 80.24 |
| Volumetric Gas Reserves Calculations $G_P = .001 * (\pi * r_e^2) * h * \phi * (1 - S_w) * [(1/B_{gi}) - (1/B_{ga})]$ | | | | |
| $G_P$ (MCF) | 2,255.281 | 2,648.858 | 371,018 | 1,133,419 |
| $r_e$ | 912.10 | 988.49 | 988/49 | 1,412.10 |
| $S_w$ | 40.9% | 40.9% | 40.9% | 40.9% |
| $B_{gi}$ | 0.00444 | 0.00444 | 0.02459 | 0.01798 |
| $B_{ga}$ | 0.09426 | 0.09426 | 0.09426 | 0.09426 |
| Z | 0.94077 | 0.94077 | 0.91175 | 0.91175 |

A can be seen, four columns of data are provided. These are:

1) Original Completion (Post-Acid) This column represents calculations of anticipated gas production rate and remaining recoverable gas reserves in place at the time of well completion. The calculations assume that the pay zone receives stimulation from acidization only.

2) Original Completion (Post-Frac) This column represents calculations of anticipated gas production rate and remaining recoverable gas reserves at the time of well completion. The calculations assume that the pay zone receives stimulation from both acidization and hydraulic fracturing. Subsequent to the well's hydraulic fracture treatment, actual production history from the Brock "A" #4-63 suggests that an equivalent, steady-state production rate of approximately 563 MCFPD was achieved. Assuming that the hydraulic fracturing stimulation of the pay zone effectively reduced the Skin factor "S" from zero to a value of −5.0, then back-calculating from Darcy's equation suggests that the effective wellbore radius, $r_w'$, was enlarged from the original 0.328 feet to a value of approximately 49 feet. Geometrically, this would be the equivalent of an infinite-conductivity fracture having a wing length of 76.4 feet.

3) Depletion Case (Post-Frac) This column presents calculations from the actual gas production rate (77 MCFPD) and remaining recoverable gas reserves (371,018 MSCF) at 2009, subsequent to both acidization and hydraulic fracturing upon original completion.

Note that at current conditions, the reservoir pressure at the external limits of the drainage radius ($r_e$) has declined from the original 4,000 psia to a value of 700 psia. As with the value of $r_w'$ in the previous case, the $P_e$ value of 700 psia was determined iteratively, forcing the remaining reserves ("$G_P$") calculation to align with the Expected Ultimate Recovery ("EUR") value of 2.649 BCF.

The modeling of an "infinite conductivity" fracture would suggest that the constant bottom-hole flowing pressure of 100 psi may now be superimposed to a distance equal to the wing length from the wellbore, that is, 76.4 feet. For volumetric calculations, maintaining the cylindrical "tank" model requires that the drainage radius also extend 76.4 feet, from the "Original Completion (Post-Acid)" value of 912 feet (60-acre equivalency) to an "Original Completion (Post-Frac)" value of 988.49 feet (70.5-acre equivalency).

Note particularly that the $r_w'$ value of 48.958 feet was determined iteratively, in that it forces the $G_P$ value of 2.649 BCF (2,648,858 MCF) to match the Expected Ultimate Recovery ("EUR") estimate from decline curve analysis of the actual production rate—vs—time data compiled from approximately 30 years of actual production history (1979 through 2009). Given that the actual production history represents a cumulative production of 2.356 BCF, or approximately 90% of the EUR, the EUR estimate of 2.649 BCF is accompanied by a relatively high degree of confidence.

4) Depletion Case (Post-Frac+Laterals) This column presents calculations of the anticipated gas production rate (109 MCFPD, for a 32 MCFPD, or 42%, increase from 77 MCFPD) and remaining recoverable gas reserves (1,133,419 MCF, for a 762,401, or 205% increase, from 371,018 MCF), assuming eight "mini-lateral" boreholes are to be added in 2009. Each borehole represents a 1" diameter hole that is jetted. Four mini-laterals are jetted at two different depths within the overall 68-foot thick pay zone, producing a total of eight lateral boreholes. Each borehole is 500 feet long. This extends the circular drainage radius to a point 1,412 feet from the original wellbore.

The previous "Depletion Case (Post-Frac)" pressure gradient through the reservoir ($P_e$=700 psia at the external drainage radius limit of 988 feet, to the constant bottom-hole flowing pressure of 100 psia observed in the wellbore; e.g., 600 psia/988 feet=0.607 psia/ft) can be extended to the new drainage radius of 1,412.0 feet. This generates a new value of $P_e$=957.13 psia.

As with the modeling of the hydraulic fracture upon initial completion (Column 2), the effective wellbore radius, $r_w'$, is increased geometrically in proportion to the amount of additional sand face exposure. Note, whereas a fracture half-length (i.e., "wing" length, $x_f$) of 76.4 feet penetrating the entire 68 foot reservoir thickness makes a significant impact upon $r_w'$ (increasing it from 0.328 feet to 48.96 feet), the incremental increase in $r_w'$ from the 8 mini-laterals addition is relatively small (48.96 feet to 51.41 feet, for a net increase of 2.451 feet). Also note, however, had the subject well never been fractured, a 2.451 feet increase in the original $r_w'$=0.328 would have been significant, increasing same by 647%.

Accordingly, from the calculations in the column of Table 1 labeled "Depletion Case (Post Frac+Laterals)" (Column 4), a theoretically anticipated increase in production rate of 42% (e.g., from 77 MCFPD to 109 MCFPD) would be expected. This represents an increase of 32 MCFPD. Of even greater significance would be the correlative anticipated increase in remaining reserves from 371,018 MCF to 1,133,419 MCF. This is an increase of 762,401 MCF, or 205%. Note that the addition of the 8 boreholes would thereby raise the overall (post-frac) EUR from 2,648,858 MCF to 3,411,259, for an increase of 29%.

The above example of Table 1 demonstrates how the creation of small, jetted, radial boreholes in an existing well can enhance production from the primary wellbore, even in the final stages of the well's productive life. A significant increase in daily production and remaining reserves is achieved even though the parent well was stimulated by both acidizing and hydraulic fracturing upon initial completion.

The hydraulic jetting of "mini-laterals" may be conducted to enhance fracture and acidization operations during completion. As noted, in a fracturing operation, fluid is injected into the formation at pressures sufficient to separate or part the rock matrix. In contrast, in an acidization treatment, an acid solution is pumped at bottom-hole pressures less than the pressure required to break down, or fracture, a given pay zone. Examples where the jetting of min-lateral boreholes may be beneficial include:

(a) Jetting radial laterals before hydraulic fracturing in order to confine fracture propagation within a pay zone and to deliver fractures a significant distance from the wellbore before any boundary beds are ruptured. Preferably, fractures would propagate from the mini-lateral wellbores in a vertical orientation. This would be expected in formations that are deeper than about 3,000 feet.

(b) Using "mini-laterals" to place stimulation from a matrix acid treatment well beyond the near-wellbore area before the acid can be "spent," and before pumping pressures approach the formation parting pressure.

There are also situations in which hydraulic jetting of lateral boreholes may be the preferred reservoir stimulation technique in place of hydraulic fracturing. In hydraulic fracturing, an operator generally has rather limited control over the final geometric configuration of a hydraulic fracture as it is generated radially from a given wellbore. Certainly, the operator can control such things as pumping rates, pumping pressures, fluid rheology, proppant type, and fluid concentrations. These parameters can influence the dimensions of the fractures, primarily their length. However, many of the final determinants of fracture geometry are indigenous to the pay zone and the boundary formations themselves. For example, for shale gas formations at depths greater than about 3,000 feet, fractures tend to form vertically. This is because fractures tend to propagate in a given pay zone in a direction that is perpendicular to the rock matrix's plane of least principal stress. Thus, a hydraulic fracture may undesirably grow beyond the pay zone and into the boundary formations above and/or below the pay zone.

A related situation in which geometric control issues may come into play with reservoir stimulation is in reservoirs having fluid "contacts." For example, when an oil/water or gas/water contact exists, either fracturing or acidizing can result in creating a direct, enhanced flow path for unwanted water. Similarly, when a gas/oil contact exists, and gas cap expansion is the primary reservoir drive mechanism, fracturing or acidizing may result in excessive, unwanted gas production along with, or in place of, the oil. Accordingly, in these situations it is not uncommon to see pay zone completions without any stimulation subsequent to perforating. These are particularly strong candidates for receiving benefits from hydraulic jetting of "mini-lateral" boreholes.

Other situations exist where jetting a lateral borehole is preferred over known hydraulic fracturing operations. These may include:

(a) Reservoirs where the pay zone is bounded, either above and/or below, by formations with rock strength characteristics of insufficient contrast to those of the pay zone itself. In these situations, it is particularly difficult to create conductive fracture length within the pay zone, as the weak bounding bed(s) may allow unwanted fracture height growth out of the pay zone.

(b) Reservoirs where pay zones are relatively thin, and/or aerially irregular, and/or spread vertically over a large vertical interval, such that hydraulic fracturing is not an effective (and particularly, not cost-effective) means of stimulation.

(c) Reservoirs where the pay zone has a significant indigenous heterogeneity in its permeability system, such as natural fractures that are either directional and/or discontinuous in nature. Here, the main objective is not so much to create a secondary flow path with a large permeability contrast to the pay zone's matrix, but to simply "link-up" the indigenous preferential flow paths that already exist.

Hence, in situations where controlling the direction of stimulation (particularly, in the vertical), and/or controlling the distance (radially, away from the wellbore) of stimulation is critical, hydraulic jetting of lateral boreholes may be more beneficial, and cost-effective, than conventional stimulation techniques.

A foundational work in the area of rock removal using hydraulic jets is that of Maurer, in his 1969 paper entitled "Hydraulic Jet Drilling." Later, in 1980, Maurer expanded and updated his work in a book entitled *Advanced Drilling Techniques*, particularly in Chapter 12 entitled "High Pressure Jet Drills—Continuous." In these works, Maurer compiled, analyzed, and discussed laboratory, and actual field trials of various rock drilling operations with hydraulic jets. Maurer highlighted the fundamental relationship between a rock's "drillability" to its commensurate "Specific Energy Requirement." In this context, "Specific Energy Requirement" is denoted as "SER" and is defined as follows:

SER={[the power input required to erode a unit volume of rock]×[the time required to erode a unit volume of rock]}/[the volume of rock eroded]

The units of SER will be presented herein as:

$$\frac{\text{Power} \times \text{Time}}{\text{Volume}} = \frac{\text{Horsepower} - \text{Hours}}{\text{Feet}^3}$$

-continued or $$\frac{\text{Joules (J)}}{\text{Cubic-Centimeter(cc)}} = \frac{\text{Mass}}{\text{Length} \times (\text{Time})^2}$$

Given the above definition of SER, a linear plot of Required Power Output (at the jetting nozzle), or "P.O." (in units of hydraulic horsepower), versus Erosion Rate, "$E_R$" (in units of cubic feet per hour), will yield a relationship whose slope [or first derivative, d(P.O.)/d($E_R$)] equals the Specific Energy Requirement, SER, to erode a unit volume of a given rock (in units of horsepower-hours per cubic feet).

FIGS. 1A and 1B represent such relationships for hydraulic jetting erosion. FIG. 1A provides a Cartesian coordinate plotting Power Output (P.O.) as a function of Erosion Rate ($E_R$) for a Darley Dale Sandstone. This figure is based on Maurer's "Table III" data. Similarly, FIG. 1B provides a Cartesian coordinate plotting Power Output (P.O.) as a function of Erosion Rate ($E_R$) for a Berea Sandstone. This figure is based on Maurer's FIG. 15 and FIG. 16.

The lines showing the correlations for the Darley Dale Sandstone and the Berea Sandstone are shown at 110A and 110B, respectively.

In FIG. 1A, line 110A is defined by the function:

$$\text{P.O.}=12+45(E_R)^{1.85} \text{ horsepower.}$$

In FIG. 1B, line 110B is defined by the function $$\text{P.O.}=51+5.5(E_R)^{1.70} \text{ horsepower.}$$

Note that for both formations, the general form of the relationship for P.O. is:

$$\text{P.O.}=(\text{P.O.})_{th}+a(E_R)^b$$

Where: "$(\text{P.O.})_{th}$" is the threshold Power Output for a given nozzle configuration, required to commence erosion of a given rock.

The actual numeric values for the coefficients, "a" and "b", will be dependent upon such factors as:

1. the jetting nozzle configuration;
2. the viscosity, compressibility, and abrasiveness of the jetting fluid;
3. the compressive strength, Young's modulus, Poisson's ratio, etc., of the rock itself, which, in turn will be influenced by the in situ pore pressure, fluid saturation(s), and confining pressures (i.e., in situ stress orientations and magnitudes); and
4. other specific features inherent to the rock itself, such as formation type (sandstone, limestone, dolomite, shale, etc.) and more specifically, whether the rock matrix is crystalline or granular in nature; and, if granular, the composition and strength of intergranular cementation; occurrence and orientation of bedding planes; magnitude and variation of primary and secondary porosity (such as indigenous natural fractures); and relative permeability to the jetting fluid.

The Specific Energy Requirement (SER) can be computed by taking the derivative of the P.O. equation, above. The SER values are defined by the equation:

$$SER = d(P.O.)/d(E_R)$$

$$= a * b(E_R)^{[b-1]}$$

The lines showing the SER values are seen at 220A and 220B for FIGS. 1A and 1B, respectively.

Technical literature has suggested that, for a fixed P.O. or SER, increasing the erosional penetration rate of a given rock (which would correspond to reductions of the "a" and/or "b" coefficients) may be accomplished by one or more of the following:

1. including abrasives in the jetting fluid;
2. impacting the rock surface with an intermittent (as opposed to continuous) jetting stream, otherwise known as a "pulsed" jet; or,
3. traversing the jetting stream across the targeted rock surface.

Maurer's objective was not to maximize hole diameter, but to optimize penetration rates and power requirements for a fixed hole diameter. He defined his "optimum pressure" as the point at which the Specific Energy passed through a minimum as the pressure through a hydraulic jet was increased, corresponding to the pressure at which maximum drilling rate would occur for a given size pump. The optimum pressure for Berea Sandstone is about 5,000 psi. Thus, Maurer concluded that "the optimum drilling pressure is not necessarily the maximum pressure rating of the available pumps."

Maurer related the drilling rate, "R" (in inches per minute) to the Specific Energy required to remove a unit volume of rock, "E", by the equation:

$$R = \frac{P}{A \times E}$$

where

P=power transmitted to rock (ft-lb/minute);

A=hole cross-sectional area (inches$^2$); and

E=Specific Energy (ft-lb/inches$^3$).

Hence, for a continuous jetting stream eroding a fixed hole cross-sectional area, "A", maximum rock penetration rate will be achieved by simultaneously delivering the maximum hydraulic horsepower ("P") at the "optimum" (or, minimum) Specific Energy Requirement ($E_R$) to remove rock.

Technical literature also suggests that sandstone and limestone formations will tend to exhibit an elastic-plastic failure response. This indicates that an erosion process using hydraulic jetting corresponds to the compressive strength of the rock.

In a work published by Labus in 1976 entitled, "Energy Requirements for Rock Penetration by Water Jets," a close correlation was demonstrated between the log-log relationships of Specific Energy to a term Labus quantified empirically as "Specific Pressure." Labus defined Specific Pressure as:

$$P_{Sp} = \frac{P_J}{\sigma_M}$$

where $P_{Sp}$=Specific Pressure;

$P_J$=Jet impact pressure; and $\sigma_M$=Rock compressive strength.

Note that when $P_J$ and $\sigma_M$ are measured in the same units, $P_{Sp}$ is dimensionless.

Labus found that the Specific Energy ("SE") data can be normalized by plotting it against the Specific Pressure (ratio of jet pressure to rock compressive strength). Labus hypothesized that Specific Energy (SE) varies to the −1.035 power of Specific Pressure ($P_{Sp}$). Labus expressed his correlation of Specific Energy to Specific Pressure as follows:

$$SE(\text{joules/cc})=146{,}500\times P_{Sp}^{-1.035}$$

Converting the above to the units of Specific Energy Requirement (SER) in horsepower-hours per cubic feet yields:

$$SER(\text{hp-hrs/ft}^3)=1{,}545\times P_{Sp}^{-1.035}$$

This is of the form:

$$SER=cP_{Sp}^{d}$$

Accordingly, we now have two independent relationships for the SER. Note that by equating these two relationships, a relationship for the Erosion Rate, $E_R$, can be derived:

$$E_R=\left[\frac{c}{a\times b}\right]^{(1/b-1)}\times\left[\frac{P_J}{\sigma_M}\right]^{(d/b-1)}$$

Terms "a," "b," "c," and "d" are coefficients. Note that the above relationship should hold true for any set of operating conditions within which $P_J>P_{Th}$.

As applied to the context of hydraulic jetting, Bernoulli's Equation provides:

$$P.O.=P_J\times Q$$

where

P.O.=required power output at the jetting nozzle;

Q=volume flow rate, or "pump rate" of the jetting fluid; and $P_J$=jet impact pressure The equation may be written in terms of horsepower as follows:

$$P.O.(hp)=0.00007273P_J(psi)\times Q(ft^3/hr).$$

This may be substituted into an erosion rate calculation in the following manner:

$$E_R=.00007273\frac{Q}{a}(P_J-P_{Th})^{(1/b)}$$

where $E_R$=erosion rate;

Q=volume pump rate of the jetting fluid;

$P_J$=jet impact pressure;

$P_{Th}$=threshold pressure; and a and b are coefficients as described above.

It is believed that the achievable Erosion Rate, $E_R$, of a radial lateral borehole being hydraulically eroded will be exponentially proportional to the difference by which the jetting pressure ($P_J$) exceeds the threshold pressure ($P_{Th}$). It is also believed that the achievable Erosion Rate, $E_R$, of a lateral borehole being hydraulically eroded will be exponentially inversely proportional to the compressive strength ($\sigma_M$) of the rock being bored. In addition, assuming that the jet impact pressure ($P_J$) is greater than the threshold pressure of the rock ($P_{Th}$), the achievable Erosion Rate ($E_R$) of a borehole being hydraulically jetted will be linearly proportional to the pump rate (Q) that can be achieved.

For both rocks for which hydraulic drilling penetration (e.g., P.O. vs. $E_R$) data could be compiled, (Darley Dale and Berea sandstones) the coefficient b is greater than 1.0. As long as:

$P_J>P_{Th}$, and $b>1.0$, the dominant determinant of $E_R$ will not be the jetting pressure ($P_J$), but will be the pump rate (Q). Hence, the ultimate success of any lateral borehole erosional system will be governed by how effectively the system can put the maximum hydraulic horsepower output (P.O.) at the jetting nozzle, and specifically, by how well the system can maximize the pump rate (Q) at jetting pressures ($P_J$) greater than the threshold pressure ($P_{Th}$).

It is noted here that the units of Erosion Rate, $E_R$, are in units of rock volume per unit of time (e.g., $ft^3$/hour), as opposed to technical literature that typically deals in penetration rates (i.e., distance per unit of time, such as ft/hour). The latter presupposes a fixed hole diameter. The motivation of basing a system model on $E_R$ is to provide for optimization of both penetration rate and hole diameter for a given system. In this respect, it may be more effective to hydraulically form lateral boreholes at lower penetration rates if substantial gains can be made in resultant borehole diameters. This optimization process, as applied to the subject method and invention for a given oil and/or gas reservoir rock of compressive strength ($\sigma_M$) and threshold pressure ($P_{Th}$), will then be a process of utilizing the pressure and rate capacities of a given coiled tubing and jetting hose configuration to maximize the Power Output (P. O.) at the jetting nozzle.

Once maximum P.O. is delivered to the jetting nozzle, the selection of a particular nozzle design will dictate corresponding values of the coefficients "a" and "b," for a given rock compressive strength ($\sigma_M$). Optimum nozzle selection will then be based upon obtaining a maximum hole diameter at a satisfactory penetration rate. As discussed further below, nozzle design refers primarily to the selection of the number, spacing, and orientation of the nozzle's fluid portals.

A rate-pressure hydraulic horsepower optimization process presumes, as previously stated, a $P_J>P_{Th}$. In addition, it assumes a minimum pump rate ($Q_{min}$) that will provide sufficient annular velocities in the horizontal borehole that provides for sufficient hole cleaning of the generated "cuttings," that is, the jetted rock debris. Hence, limitations relevant to optimum jetted-hole configuration in a given oil and/or gas reservoir are those limitations imposing losses of hydraulic horsepower at the jetting nozzle. However, other limitations to hydraulic jetting systems, particularly those for creating lateral boreholes, exist. Those limitations generally include:

(a) limited hydraulic horsepower (P.O.) at the jetting nozzle;

(b) vertical depth limitations for candidate pay zones; and (c) wellbore geometry limitations.

These are discussed separately, below.

Limited Hydraulic Horsepower at the Jetting Nozzle.

Anything that diminishes or restricts the jetting pressure ($P_J$), or the jetting fluid's "pump rate" ($Q_J$) constitutes a limitation to the hydraulic horsepower (P.O.) of the fluid jet impacting the target rock. Working from the jetting nozzle back toward the surface equipment, these limiting factors include:

(1) The inefficiencies in the nozzle itself, such that selection of the number, spacing, and orientation of the nozzle's fluid portals do not provide optimum values of the "a" and "b" coefficients when jetting through a rock matrix. In this instance, the pressure drop inherent in the nozzle is not yielding the maximum possible benefits.

(2) The pressure loss due to friction of the jetting fluid as it is being pumped through the jetting hose. The longer the jetting hose is, the greater the amount of pressure loss due to line friction. However, limiting the length of jetting hose invokes a directly proportional limit in the potential length of the lateral borehole.

(3) The burst pressure of the hose, particularly at the bend radius. The erosion of in situ reservoir rocks necessitates relatively high surface pumping pressures. These pumping pressures, in addition to the hydrostatic head of the jetting fluid column downhole, invoke burst forces that must be withstood by the jetting hose throughout its entire length. This internal burst force is at a maximum if there are no (or limited) jetting fluid "returns" circulating back toward the surface in the annular region outside the jetting hose and within the wellbore, thereby providing supportive hydrostatic forces from the outside. Regardless of the materials comprising the jetting hose itself (be it continuous stainless steel, stainless steel with a supporting braided steel exterior, or elastomeric materials), the limiting burst pressure will always occur at the maximum point of flexure in the bending of the hose. This is why hoses are specified by both Maximum Working Pressure and Minimum Bend Radius. Accordingly, the jetting hose must have sufficient burst strength and, more importantly, because the jetting hose must be capable of making a 90-degree bend within a relatively small radius (conforming to the bending device positioned opposite the point of the casing exit), sufficient burst strength within a state of flexure.

Vertical Depth Limitations for Candidate Pay Zones.

At present, the commercial processes available for executing a complete vertical-to-horizontal transition within a well casing, exiting the casing, and jetting the horizontal lateral(s) limit themselves to depths of approximately 5,000 feet or less. There are two plausible reasons for this depth limitation:

(1) The commercially available methods are provided via equipment designed for specific geologic basins. If the majority of pay zones in those basins are at depths of 5,000 feet or less, outfitting equipment with, say, 10,000 feet of coiled tubing would needlessly double the friction losses encountered in the coiled tubing prior to the jetting fluid reaching the jetting hose. In this respect, the jetting fluid must be pumped through all of the coiled tubing prior to reaching the jetting hose, whether the coiled tubing is extended into the wellbore or still coiled at the surface.

(2) Technically, the only limitations constraining the penetrability of a given formation by hydraulic jetting are the rock's strength characteristics, and particularly, those rock characteristics resisting erosion by the hydraulic forces emanating from the jets. Such characteristics include ($\sigma_M$) and ($P_{Th}$). Hence, in theory, if the P.O. at the nozzle can exceed these erosional thresholds of the formation, a successful jetting process should occur independent of the depth of the host rock.

In general, however, ($\sigma_M$) and ($P_{Th}$) tend to increase with depth. In this respect, as the overburden pressure from the weight of overlying rock layers increases (which is directly related to depth), the resultant confining forces and stresses tend to increase ($\sigma_M$) and ($P_{Th}$). Similarly, favorable oil and gas reservoir characteristics such as porosity and permeability, in general, tend to decrease with depth.

Wellbore Geometry Limitations.

The current methods for executing a vertical-to-horizontal transition within a well casing, exiting the casing, and subsequently jetting a horizontal borehole requires full casing inner diameter access. This means that a workover rig (or, "pulling unit") is required to trip existing production tubing out of the hole. U.S. Pat. No. 5,853,056 issued to Landers, for example, then requires attachment of a deflection shoe to the end of the production tubing. The shoe is landed at the depth of the intended casing exit.

In order to conduct this operation, either the well is "killed," such that it cannot flow during the tripping operation, or a rather expensive and time-consuming "snubbing unit" is employed to snub the production tubing in and out of the wellbore. Note that in the first case, the well cannot be produced throughout the entire operation. Further, killing the well introduces a risk of possible formation damage. In this respect, it is not uncommon (particularly in somewhat pressure-depleted reservoirs) for kill fluids themselves to partially invade the producing formation in the near-wellbore area, and unfavorably alter the relative permeability to oil and/or gas. In partially depleted tight gas producing formations, this is frequently evidenced by a substantial portion of the kill fluid never being recovered.

Therefore, a need exists for a system that provides for substantially a 90-degree turn of the jetting hose opposite the point of casing exit, while utilizing the entire casing inner diameter as the bend radius for the jetting hose, thereby providing for the maximum possible inner diameter of jetting hose, and thus providing the maximum possible hydraulic horsepower to the jetting nozzle. A need further exists for a system that includes a whipstock that can be conveyed, set, operated, re-oriented, re-set, and retrieved on the end of a string of coiled tubing. An additional need exists wherein the whipstock system can be conveyed through a "slimhole" region, and then set in a string of production casing having a relatively larger inner diameter, and then once again retrieved through the slimhole region. Such slimhole regions may include not only strings of intermediate repair casing, but also strings of production tubing. A need further exists for a method of forming lateral boreholes using hydraulically directed forces, wherein production of a flowing well may continue throughout the process of jetting lateral boreholes, thereby allowing any uplifts in production rates to be observed in real time.

SUMMARY OF THE INVENTION

The systems and methods described herein have various benefits in the conducting of oil and gas production activities. First, a downhole tool assembly for forming a lateral borehole from a parent wellbore is provided. The lateral borehole is formed using hydraulic forces that are directed through a jetting hose. The parent wellbore has been completed with a string of production casing defining an inner diameter. The parent wellbore may also have a slimhole region having an inner diameter that is less than the inner diameter of the production casing.

The downhole tool assembly serves to direct a jetting assembly. Generally, the downhole tool first includes a whipstock member. The whipstock member includes a curved face configured to bend a jetting hose across the entire inner diameter of the production casing. In this way, the jetting hose may be re-directed within the wellbore to a desired point of casing exit through the production casing adjacent a targeted pay zone.

The downhole tool assembly also includes a pin. The whipstock member is configured to rotate about the pin from a first run-in position, to a second set position in response to a force applied to the downhole tool assembly within the wellbore.

The downhole tool assembly further includes a set of slips. The individual slips are configured to pivot from a first run-in position to a second set position. When the whipstock and the slips are in their respective run-in positions, the tool assembly has an outer diameter that is less than the inner diameter of the slimhole region. When the jetting assembly reaches the desired pay zone, the slips are pivoted outwardly in response to the force applied to the downhole tool assembly to engage an inner wall of the production casing and to anchor the assembly.

The downhole tool assembly may further include a plurality of disc springs. The disc springs are disposed along a lower end of the downhole tool assembly. The disc springs provide an upward force against the slips, biasing them in their run-in position.

Still further, the downhole tool assembly may include a hose-guiding section. The hose-guiding section directs the jetting hose within the wellbore. In one embodiment, the hose-guiding section comprises a series of descending deflection faces that translate from a first run-in position that permits the tool assembly to pass through a slimhole region, to a second set position in response to hydraulic forces, wherein the deflection faces extend from the tool assembly towards the production casing in the set position to direct the jetting hose towards an upper end of the whipstock member.

Still further, the downhole tool assembly may include a hose-bending section. The hose-bending section is designed to guide the jetting hose such that the bend radius of the jetting hose is equivalent to the full available I.D. of the production casing.

A method for forming a lateral borehole from a parent wellbore is also provided herein. The parent wellbore has been completed with a string of production casing defining an inner diameter. In addition, the parent wellbore has a slimhole region defining an inner diameter that is less than the inner diameter of the production casing.

In one embodiment, the method includes providing a downhole tool assembly. The tool assembly serves to direct a jetting assembly in accordance with the assembly described above. The tool assembly includes a whipstock member having a curved face. The face is configured to bend a jetting hose across the entire available inner diameter of the production casing. In this way, the jetting hose may be re-directed within the wellbore to a desired point of casing exit through the production casing adjacent a selected pay zone. Because the burst strength, working pressure ratings, and bend radii for a given family of jetting hoses are inversely proportional to their inner diameters, utilizing the full production casing I.D. as the bend radii for the jetting hose serves to maximize the I.D. of the jetting hose that can be employed for a given jetting operation. This maximized jetting hose I.D., for any set of fixed operating pressure and bend radius constraints, provides for maximized Power Output to be delivered to a nozzle at the end of the hose.

The tool assembly also includes a pin. The whipstock member is configured to rotate about the pin from a first run-in position, to a second set position in response to a force applied to the downhole tool assembly within the wellbore.

The downhole tool assembly further includes a set of slips. The individual slips are configured to pivot from a first run-in position to a second set position. When the whipstock and the slips are in their respective run-in positions, the tool assembly has an outer diameter that is less than the inner diameter of the slimhole region. The slips pivot outwardly in response to the force applied to the downhole tool assembly to engage an inner wall of the production casing and to anchor the assembly.

The method can also accommodate running the downhole tool assembly through a slimhole region of the parent wellbore. The tool assembly is run into the wellbore adjacent the targeted pay zone. Thereafter, a force is applied to the tool assembly within the wellbore to cause the whipstock member to rotate from its first run-in position to its second set position. The force also causes the slips to pivot from their run-in positions to their set positions.

The method further includes running the jetting hose into the parent wellbore. The hose is also run down to and against the curved face of the whipstock member of the downhole tool assembly within the production casing. The jetting hose, with either a jetting nozzle or mill at its end, is further run down to a position to perform a first casing exit in the production casing.

In addition, the method includes injecting hydraulic fluid through the hose. In one embodiment, hydraulic fluid is used to actually create an opening in the production casing. Alternatively, an initial casing exit is milled into the casing using a milling tool and milling bit at the end of the hose, and then removing the milling tool and milling bit and attaching a suitable jetting nozzle for jetting.

The method also includes further running the jetting hose, with a jetting nozzle at its end, into the wellbore and through the newly formed casing exit. At the same time, hydraulic fluid is injected through the hose under pressure to create a first lateral borehole in the subsurface formation. This first borehole may extend from about 10 feet to 500 feet from the wellbore. The first borehole is preferably formed at a wellbore depth greater than 400 feet, or even greater than 5,000 feet.

In one embodiment, the wellbore is substantially horizontal at a depth of the subsurface formation. The first lateral borehole then extends substantially normal to the wellbore. In another embodiment of the method, the wellbore is substantially vertical at a depth of the subsurface formation. The first lateral borehole then extends substantially normal to the wellbore and along the plane of the subsurface formation.

The method preferably includes an additional step of changing the radial orientation of the whipstock member. This is done when the whipstock member is within the wellbore below the slimhole region. Changing the radial orientation may be accomplished by re-engaging the downhole tool assembly with the setting tool, and then transmitting a force that incrementally rotates the upper portion of the downhole tool assembly (including the whipstock member) about its longitudinal axis to a new orientation. Beneficially, this may be done without disengaging the slips from the inner wall of the production casing.

The method may optionally include the steps of pulling the hose out of the lateral borehole and the casing exit, discontinuing injecting hydraulic fluid through the hose, spooling up the coiled tubing and jetting hose to the surface, disconnecting the jetting hose and reconnecting the setting tool, re-entering the parent wellbore with the coiled tubing and setting tool and re-engaging the downhole tool assembly, incrementally rotating the upper portion of the downhole tool assembly (including the whipstock member) a selected number of degrees, disengaging the setting tool from the downhole tool assembly, retrieving the coiled tubing and setting tool to the surface to disconnect the setting tool and reconnect the jetting hose, re-entering the parent wellbore with the jetting hose and coiled tubing, forming a second casing exit in the production casing, then continuing high pressure injection of hydraulic fluid through the jetting hose and nozzle while simultaneously feeding the jetting hose through the downhole tool assembly and the second casing exit. This is done by advancing the coiled tubing from surface. Feeding the jetting hose through the second casing exit serves to erosionally "drill" a second lateral borehole in the subsurface formation.

BRIEF DESCRIPTION OF THE DRAWINGS

So that the manner in which the present inventions can be better understood, certain illustrations, charts and/or flow charts are appended hereto. It is to be noted, however, that the drawings illustrate only selected embodiments of the inventions and are therefore not to be considered limiting of scope, for the inventions may admit to other equally effective embodiments and applications.

FIG. 9A shows the setting tool and the connected jetting assembly in their run-in positions.

FIG. 9B shows a sleeve being shifted in the setting tool. This serves to allow disc springs to set the downhole tool assembly.

FIG. 9C shows slip springs being activated. The whipstock has been rotated into its set position to receive a jetting nozzle and connected jetting hose.

FIG. 9D shows deflection faces being activated along the jetting assembly. These serve as part of a hose-guiding section for the downhole tool assembly.

FIG. 9E shows the setting tool in its hydraulic retrieving position.

FIG. 9F shows the setting tool and the connected downhole tool assembly being moved back into their run-in position. The dogs are locked and the whipstock is rotated back into a collapsed position.

In FIG. 10A, the wellbore is seen. The wellbore extends from a surface into the producing formation.

In FIG. 10B, a setting tool and connected downhole tool assembly are being run into a wellbore.

In FIG. 10C, the downhole tool assembly has been set in the wellbore adjacent the producing formation. The setting tool is being retrieved from the wellbore.

In FIG. 10D, a jetting hose is being run into the wellbore using a string of coiled tubing. A jetting nozzle is seen connected to the jetting hose proximate a whipstock on the jetting assembly. A window has been formed in the production casing.

DETAILED DESCRIPTION OF CERTAIN EMBODIMENTS

Definitions

Figure 1A:
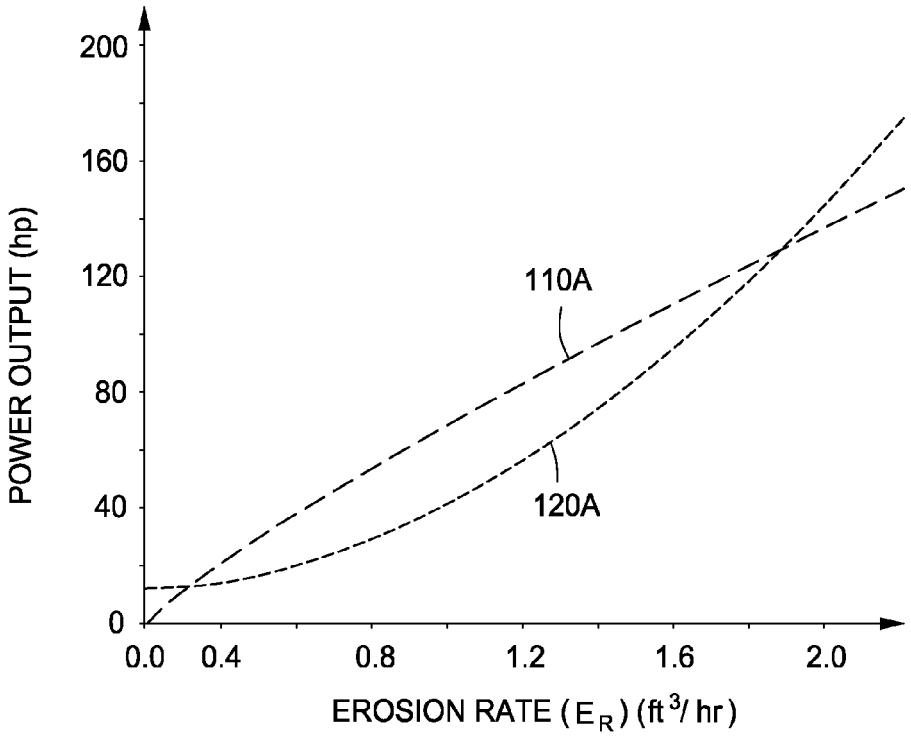
FIG. 1A is a Cartesian coordinate plotting Power Output as a function of Erosion Rate in a hydraulic jetting test. This figure is based upon test results using a Darley Dale Sandstone.
Figure 1B:
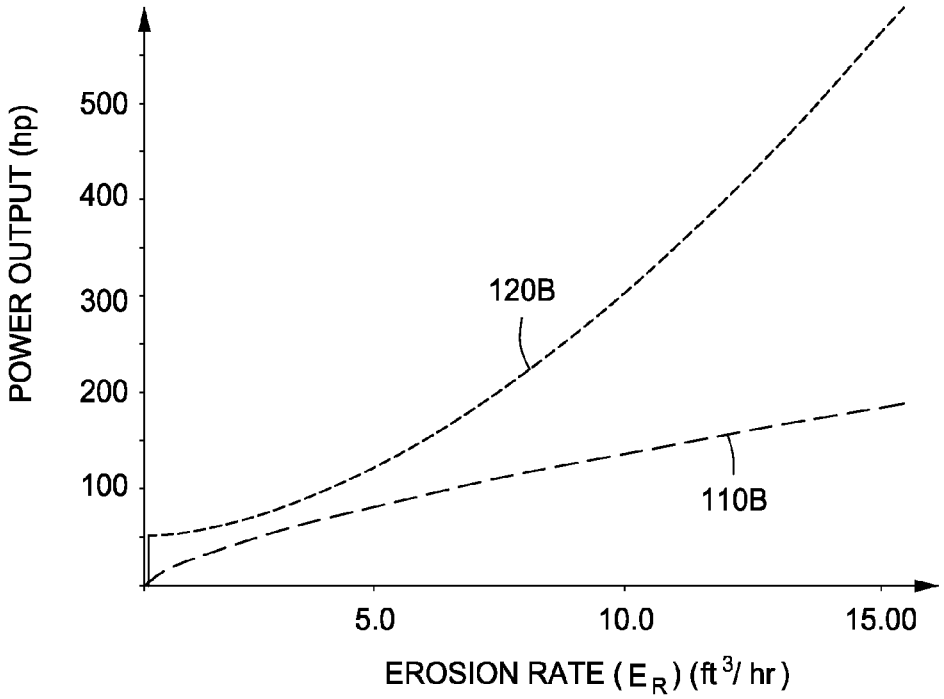
FIG. 1B is another Cartesian coordinate plotting Power Output as a function of Erosion Rate in a hydraulic jetting test. This figure is based upon test results using a Berea Sandstone.

As used herein, the term "hydrocarbon" refers to an organic compound that includes primarily, if not exclusively, the elements hydrogen and carbon. Hydrocarbons generally fall into two classes: aliphatic, or straight chain hydrocarbons, and cyclic, or closed ring hydrocarbons, including cyclic terpenes. Examples of hydrocarbon-containing materials include any form of natural gas, oil, coal, and bitumen that can be used as a fuel or upgraded into a fuel.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions, or at ambient conditions (15° C. and 1 atm pressure). Hydrocarbon fluids may include, for example, oil, natural gas, coal bed methane, shale oil, pyrolysis oil, pyrolysis gas, a pyrolysis product of coal, and other hydrocarbons that are in a gaseous or liquid state.

As used herein, the term "fluid" refers to gases, liquids, and combinations of gases and liquids, as well as to combinations of gases and solids, and combinations of liquids and solids.

As used herein, the term "condensable hydrocarbons" means those hydrocarbons that condense at about 15° C. and one atmosphere absolute pressure. Condensable hydrocarbons may include, for example, a mixture of hydrocarbons having carbon numbers greater than 4.

As used herein, the term "subsurface" refers to geologic strata occurring below the earth's surface.

The term "subsurface interval" refers to a formation or a portion of a formation wherein formation fluids may reside. The fluids may be, for example, hydrocarbon liquids, hydrocarbon gases, aqueous fluids, or combinations thereof.

The terms "zone" or "zone of interest" refer to a portion of a formation containing hydrocarbons. Sometimes, the terms "target zone," "pay zone," or "interval" may be used.

As used herein, the term "wellbore" refers to a hole in the subsurface made by drilling or insertion of a conduit into the subsurface. A wellbore may have a substantially circular cross section, or other cross-sectional shape. As used herein, the term "well," when referring to an opening in the formation, may be used interchangeably with the term "wellbore."

The term "jetting fluid" refers to any fluid pumped through a jetting hose and nozzle assembly (typically at extremely high pressures) for the purpose of erosionally boring a lateral borehole from an existing parent wellbore. The jetting fluid may or may not contain an abrasive material.

The term "abrasive material" refers to small, solid particles mixed with or suspended in the jetting fluid to enhance erosional penetration of: (1) the pay zone, (2) the cement sheath between the production casing and pay zone, and/or (3) the wall of the production casing at the point of desired casing exit.

The term "repair casing" means any tubular body installed along the inner diameter of a pre-existing casing to repair or seal a previous casing. The term "repair casing" includes a repair liner.

The terms "tubular" or "tubular member" refer to any pipe, such as a joint of casing, a portion of a liner, a joint of tubing, or a pup joint.

DESCRIPTION OF SPECIFIC EMBODIMENTS

Figure 2:
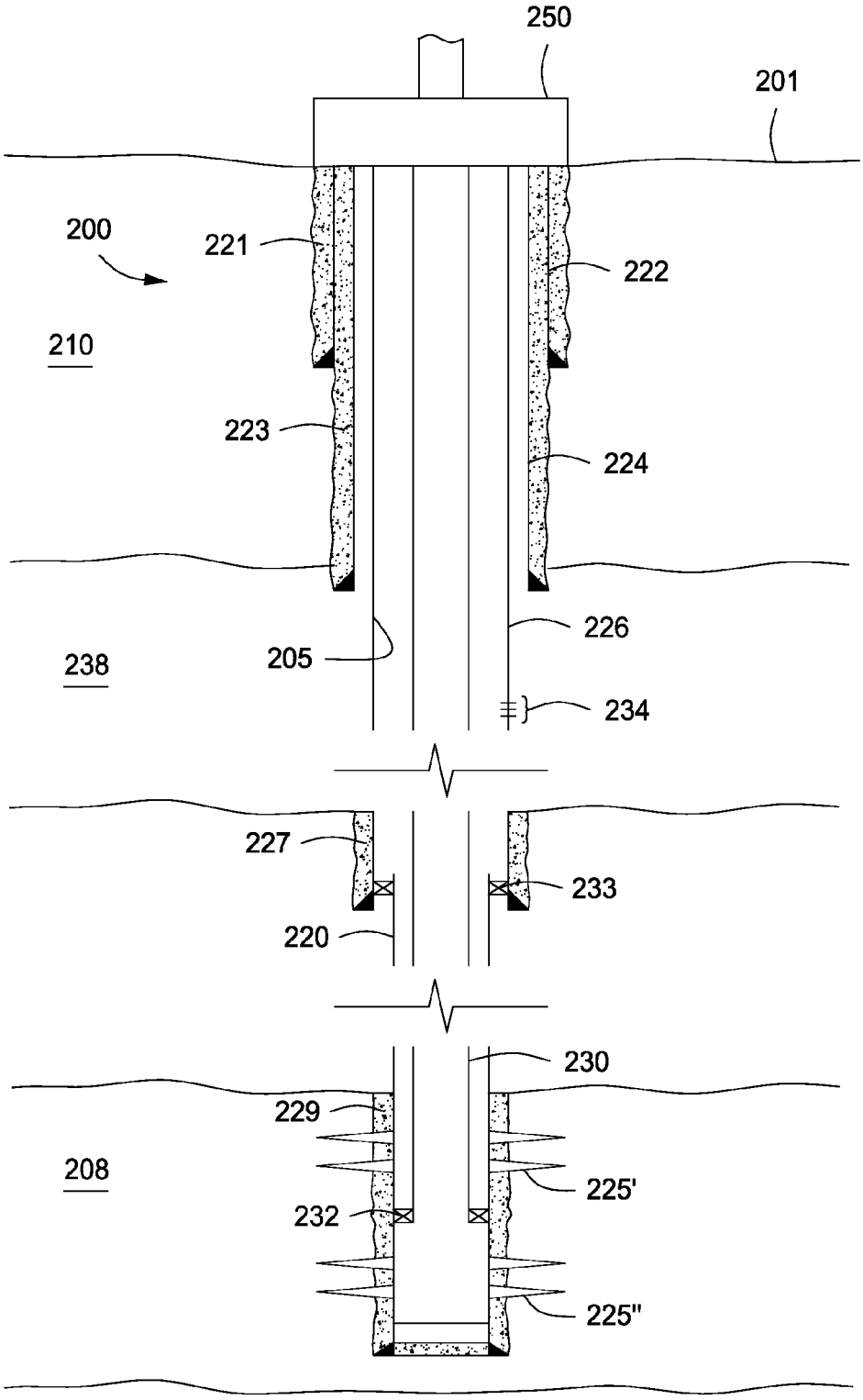
FIG. 2 is a side view of an illustrative wellbore. The wellbore has a slimhole region.

FIG. 2 is a cross-sectional view of an illustrative wellbore 200. The wellbore 200 defines a bore 205 that extends from a surface 201, and into the earth's subsurface 210. The wellbore 200 is completed with a string of production casing 220 that spans the length of the wellbore 200. The production casing 220 is perforated along a target producing formation 208. Perforations are seen at 225 to provide fluid communication between the producing formation 208 and the bore 205.

The wellbore 200 has been formed for the purpose of producing hydrocarbons for commercial sale. A string of production tubing 230 is provided in the bore 205 to transport production fluids from the producing formation 208 up to the surface 201. The wellbore 200 may optionally have a pump (not shown) along the producing formation 208 to artificially lift production fluids up to the surface 201.

The wellbore 200 has been completed by setting a series of pipes into the subsurface 110. These pipes include a first string of casing 222, sometimes known as conductor pipe. These pipes also include a second string of casing 224. The second string of casing 224, sometimes known as surface casing, has the primary purpose of isolating the wellbore 200 from any potential fresh water strata. Hence, casing strings 222 and 224 are typically required to be cemented completely back to surface 201. FIG. 2 shows cement sheaths 221 and 223 around casing strings 222 and 224, respectively. In addition, cement sheath 229 protects at least a part of the production casing 220.

Possibly a third 226 or more strings of casing, sometimes known as intermediate pipe, may be required to safely and/or efficiently drill the wellbore to total depth by providing support for walls of the wellbore 200. Cement sheath 227 covers at least a part of the intermediate casing string 226. Note that cement columns 227, 229 do not extend to the surface 201, as is common for these casing strings, particularly in deeper wellbores.

The intermediate casing string 226 may be hung from the surface 201, or may be hung from a next higher casing string 224 (if the next higher casing string is not the conductor pipe 222 or surface casing 224) using a liner hanger. It is understood that a pipe string that does not extend back to the surface (not shown) is normally referred to as a "liner." In the illustrative arrangement of FIG. 2, intermediate casing string 226 is hung from the surface 201, while the production casing string 220 is a liner hung from the lower end of the casing string 226 using liner hanger 233. Additional intermediate casing strings (not shown) may be employed. The present inventions are not limited to the type of completion casing arrangement used.

Each string of casing 222, 224, 226, and the production tubing string 230, is connected to, sealed, and isolated by various valves and fittings comprising a wellhead 250. The wellhead 250 is located immediately above and/or slightly below the surface 201. Immediately atop, and connected to the wellhead 250, is a well tree (not shown). The well tree is comprised of various valves and possibly a choke capable of limiting, completely shutting in, and/or redirecting flow from the wellbore 200.

In the wellbore 200 of FIG. 2, two different sets of perforations 225 have been created. These represent an upper set of perforations 225', and a lower set of perforations 225". Each set of perforations 225', 225" may correlate to a separate pay zone within the producing formation 208. The pay zones associated with the sets of perforations 225' and 225" may be partially depleted.

In FIG. 2, the wellbore 200 has a slimhole region. Here, the slimhole region is the string of production tubing 230, which runs from the surface 201 (specifically a tubing hanger) down to a downhole packer 232. However, the slimhole region may alternatively be a straddle packer used for isolating a previously completed subsurface zone. Alternatively still, the slimhole region may be a string of repair casing or repair liner used to isolate an area of the wellbore where the casing has become corroded or otherwise compromised. The slimhole region may also represent one or more packers or one or more seating nipples, or combinations of the above.

Note the inner diameters of both the production tubing 230 and packer 232 may be equal, or nearly so; but both will be significantly less than the inner diameter of production casing 220.

The downhole packer 232 serves to anchor the tubing string 230. The packer 232 also isolates the pressures and flows of fluids through the lower set of perforations 225" from an annular region between the production casing 220 and the production tubing 230. In addition, within FIG. 2, the packer's 232 isolation prevents cross-flow of fluids between the lower 225' and the higher 225" sets of perforations. In addition, the packer 232 isolates production fluids from the lower set of perforations 225" from casing leaks 234. Such casing leaks 234 may be induced, for example, by corrosive brine from a higher formation 238. These leaks 234 provided a path for old drilling mud from the annular region between production casing 230 and borehole 105 (which was only partially displaced by cement 229) to invade perforations 225' and damage the higher pay zone, leading to its premature abandonment.

The operator of wellbore 200 may desire to stimulate the subsurface formation 208 to increase the production of valuable hydrocarbons. Specifically, the operator may desire to stimulate the producing formation 208 by forming a series of small, radial, boreholes through the production casing 220 and outward into the formation 208. Accordingly, an assembly system for controllably forming lateral boreholes from a parent wellbore is provided herein. The lateral boreholes are formed using hydraulic forces that are directed through a flexible jetting hose. Beneficially, the assembly allows the operator to complete a vertical-to-horizontal transition within a well casing, exit the casing, and subsequently jet horizontal lateral boreholes using the entire casing inner diameter ("ID") as the bend radius for the jetting hose.

Using the full I.D. of the production casing 220 (that is, below the production tubing 130) allows the operator to use a jetting hose having a larger diameter. This, in turn, allows the operator to pump a higher volume of jetting fluid, thereby generating higher hydraulic horsepower at the jetting nozzle at a given pump pressure. This will provide for substantially more P.O. at the jetting nozzle, that is, the nozzle at the end of the jetting hose. These P.O. benefits will enable:

(1) jetting larger diameter lateral boreholes within the target formation;
(2) achieving longer lateral lengths;
(3) achieving greater erosional penetration rates; and/or
(4) achieving erosional penetration of higher ($\sigma_M$) and ($P_{Th}$) oil/gas reservoirs heretofore considered impenetrable by existing hydraulic jetting technology. This, in general, will facilitate targeting deeper reservoirs than previously believed erosionally penetrable.

Because of open perforations 225" to a partially depleted pay zone, and because of casing leaks 234 providing an open path for the corrosive brines of formation 238, removal of packer 232 in order to perform the stimulation could induce cross-flow (with associated well control issues) and/or formation damage to the pay zone associated with the lower perforations 225". Accordingly, the operator may choose to consider only those stimulation techniques that do not require removal of the packer 232. This represents a viable scenario played out numerous times in wells completed through corrosive strata, such as wells in the panhandles of Texas and Oklahoma completed through the Brown Dolomite formation.

Even if packer 232 was, by design, retrievable, it is more than likely trapped within the wellbore 200 by accumulated debris atop it from casing leak 234. Thus, even if cross-flow or formation damage were not factors, the mere expense to 'wash over' the debris and retrieve the packer 232 could far outweigh the perceived benefit of stimulating the pay zone adjacent lower perforations 225". Further, even in the absence of a casing failure or the upper perforations 225', there could be a risk of formation damage to "kill" the well. Absent such formation damage risk, the operator would certainly desire to forego the expense of killing the well, and pulling and reinstalling production tubing 130, if at all possible. Hence, in virtually any wellbore configuration scenario, if two stimulation techniques provide relatively equal production enhancement at similar service costs, and have relatively equal chances of success, and one of them can be performed "through tubing" (i.e., does not require removal of packer 232 and/or tubing string 230), the through-tubing alternative will be the least total cost alternative, and therefore the preferred alternative. Note, however, in some wellbore situations, such as those depicted in FIG. 2, the through-tubing alternative may be the only viable alternative.

FIGS. 3A through 3D provide a cross-sectional expanded view of a downhole tool assembly 300 of the present invention, in one embodiment. The tool assembly 300 defines an elongated downhole tool designed to be run into a wellbore, such as wellbore 200 of FIG. 2. Beneficially, the tool assembly 300 is designed to be run through a smaller I.D. tubing (such as slimhole region 230 of FIG. 2) set in a larger I.D. string of production casing (such as casing string 220 of FIG. 2). The tool assembly 300 is further designed to receive a jetting hose that will hydraulically jet radial boreholes (demonstrated in FIG. 10E) into the surrounding formation.

In each of FIGS. 3A through 3D, the tool assembly 300 is shown positioned in a string of production casing 220. The production casing 220, in turn, is secured by a surrounding cement sheath 229. The production casing 220 forms a bore 205 into which the tool assembly 300 has been run.

FIGS. 4A through 4D provide another cross-sectional expanded view of the downhole tool assembly 300 of FIGS. 3A through 3D. In FIGS. 3A through 3D, the tool assembly 300 is in its run-in position. However, in FIGS. 4A through 4D the tool assembly is in its set and operating position. In both sets of figures, the tool assembly 300 is shown broken into seven different segments. The segments are fictitious segments created for the purpose of enlarging the cross-sectional views for clarity. In actual practice, the segments form one continuous and elongated tool. Arrows are provided along phantom lines between the segments to indicate that the segments should be joined end-to-end.

Referring to both FIGS. 3A through 3D and FIGS. 4A through 4D together, the tool assembly 300 generally includes:

- A locking/retrieving section which locks the upper section of the downhole tool assembly 300 in place during jetting operations. This section also contains retrieving dogs 307 which provide a backup method to collapse the tool assembly 300 and retrieve it.
- A hose guide/whipstock section below the locking/retrieving section which guides the flexible hose into the proper position for forming lateral boreholes.
- An indexing section which rotates the upper sections of the tool assembly 300 in the casing 220 to reposition the flexible hose for jetting additional lateral boreholes.
- A slip section which anchors the downhole tool assembly 300 to the surrounding casing 220.

Locking/Retrieving Section

The downhole tool assembly 300 first includes a locking/retrieving section. In this section there is a retrieving mandrel 301. The retrieving mandrel 301 is fashioned as a fishing neck, having a bulbed upper end 30, an undercut region 31, and an elongated rod 32 there below. The retrieving mandrel 301 may have threads (not shown) at a lower end for securing the retrieving mandrel 301 within the tool assembly 300.

The downhole tool assembly 300 also includes a collet 302. The collet 302 is positioned around the retrieving mandrel 301 below the bulbed upper end 30. Together with the retrieving mandrel 301, the collet 302 forms a part of a locking/retrieving section of the tool assembly 300.

Figure 4A:
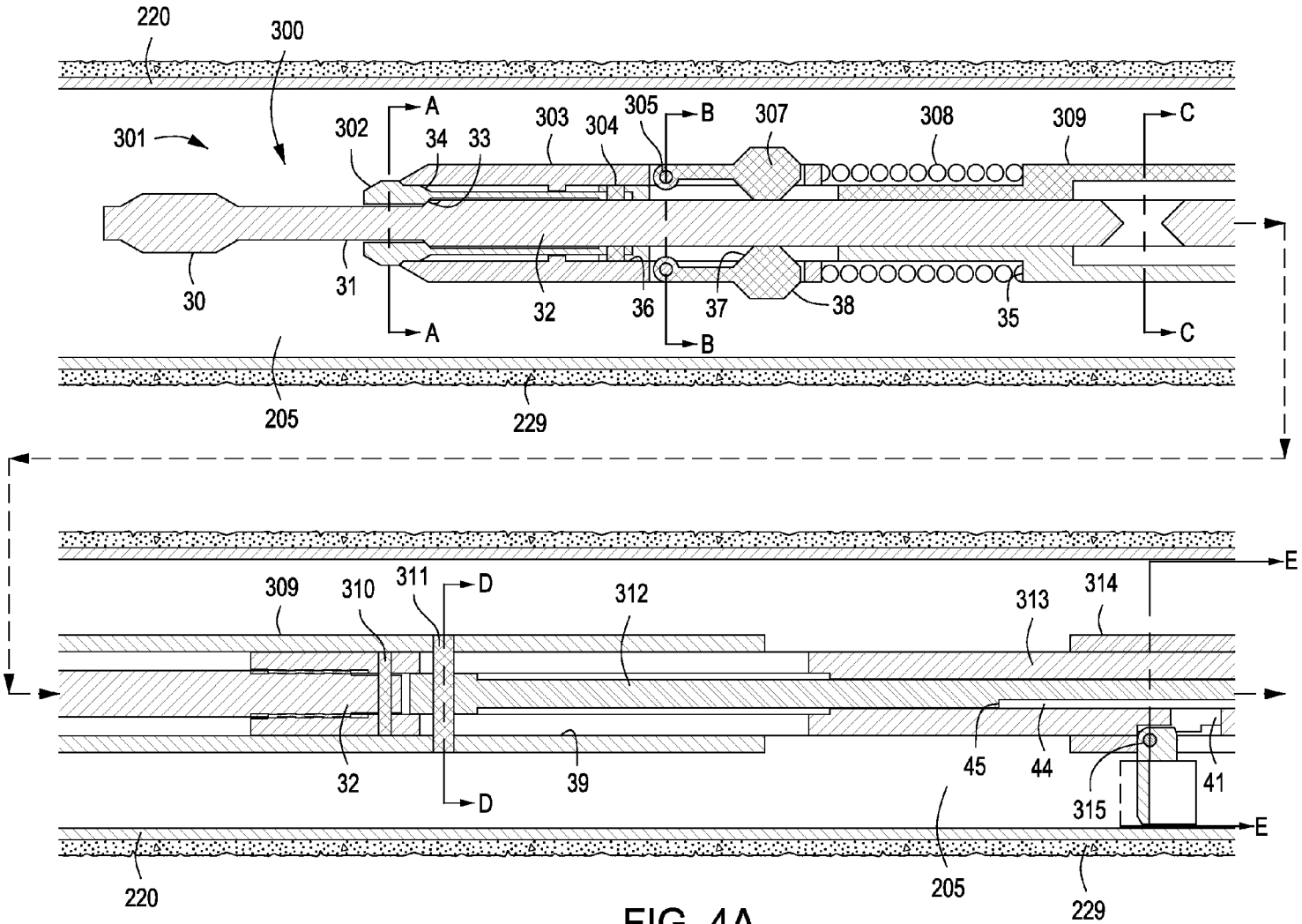
FIGS. 4A through 4D provide another cross-sectional expanded view of the downhole tool assembly of FIGS. 3A through 3D. Here, the tool assembly is in its set position with the whipstock ready to receive a hydraulic jetting nozzle and connected jetting hose, and direct them into a casing exit formed within a surrounding production casing.
Figure 5A:
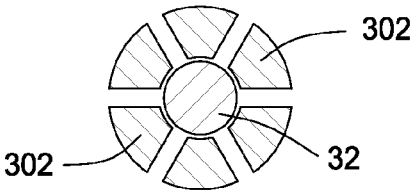
FIG. 5A is a cross-sectional view of the downhole tool assembly of FIGS. 3A through 3D. The view is taken across line A-A of FIG. 4A. A retrieving mandrel is seen. In addition, fingers from a collet are visible around the retrieving mandrel.

FIG. 5A is a cross-sectional view of the downhole tool assembly of FIG. 4A. The view is taken across line A-A of FIG. 4A. In FIG. 5A, the elongated rod 32 of the retrieving mandrel 301 is seen. In addition, segments or fingers forming the collet 302 are visible around the retrieving mandrel rod 32.

Figure 3A:
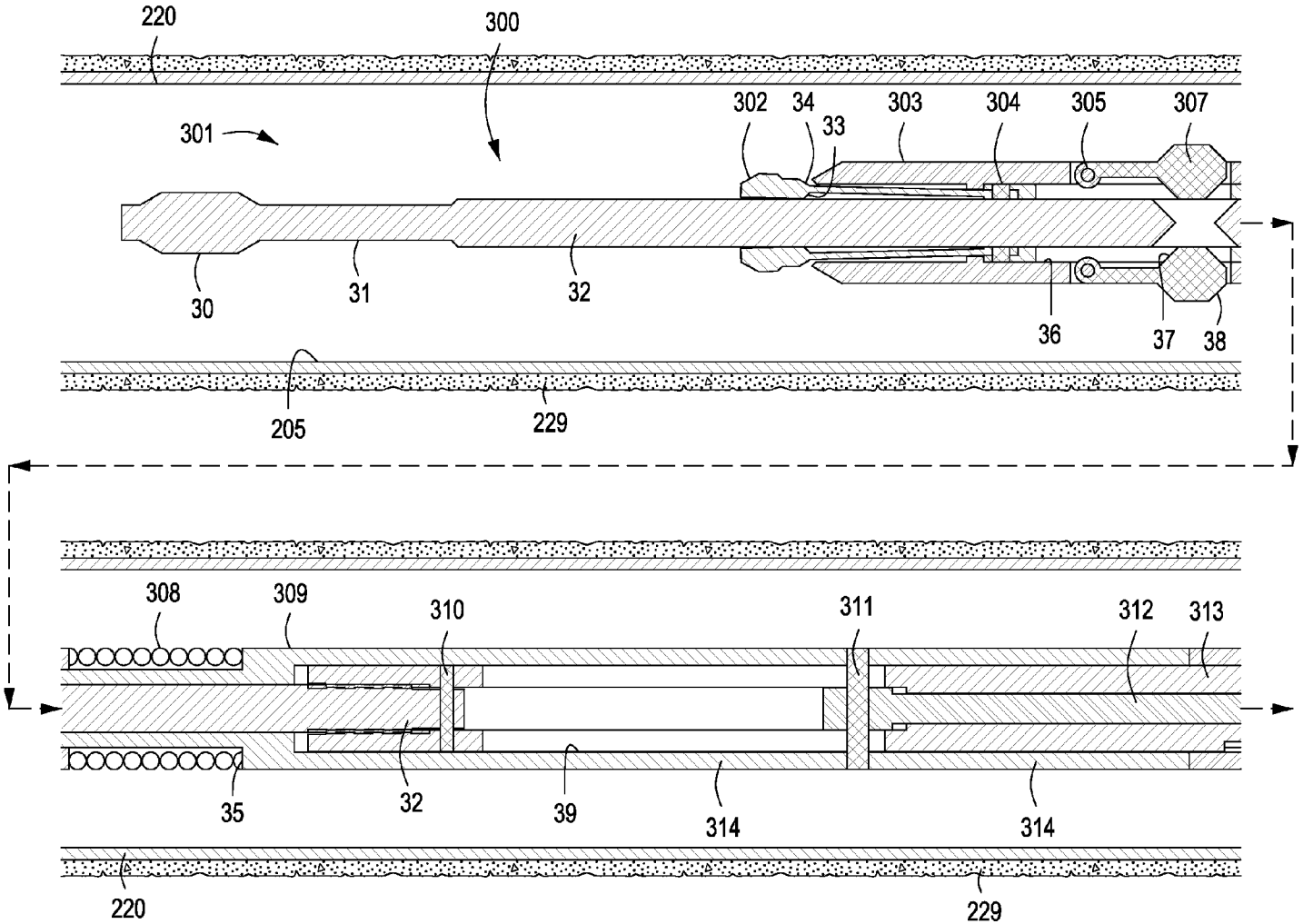
FIGS. 3A through 3D provide a cross-sectional expanded view of a downhole tool assembly of the present invention, in one embodiment. Here, the tool assembly is in its run-in position. The tool assembly includes a whipstock that is configured to receive a hydraulic jetting nozzle and connected jetting hose. In this view, the whipstock is in its closed position.

The downhole tool assembly 300 further includes a collet lock sleeve 303. The collet lock sleeve 303 generally circumscribes the collet 302. In this way, the collet 302 resides between the retrieving mandrel 301 and the surrounding collet lock sleeve 303. In the arrangement of FIG. 3A, the lower end of the collet 302 is attached to the collet lock sleeve 303 with pins 304. In this way, the collet 302 and the collet lock sleeve 303 move together.

The collet 302 has an internal upset 33 and an external upset 34. The external upset 34 forms a shoulder which limits upward travel of the surrounding collet lock sleeve 303.

The tool assembly 300 further includes a retrieving sleeve 309. The retrieving sleeve 309 defines a tubular body that resides below the collet lock sleeve 303 and around a portion of the retrieving mandrel 301. The retrieving sleeve 309 includes an external shoulder 35. The retrieving sleeve 309 transfers movement from a setting tool (shown in FIGS. 6A through 6D at 600, and described below) to components in the downhole tool assembly 300 below the retrieving sleeve 309.

The downhole tool assembly 300 also includes a biasing spring 308. The biasing spring 308 resides below the collet lock sleeve 303 and around the retrieving mandrel 301. The biasing spring 308 acts against the external shoulder 35 at the upper end of the retrieving sleeve 309. The biasing spring 308 provides an upward force against the collet lock sleeve 303 to urge against the external upset 34 at the upper end of the collet 302.

Also as part of the locking/retrieving section of the tool assembly 300, retrieving dogs 307 are provided. The retrieving dogs 307 are positioned in slots at the lower end of the collet lock sleeve 303. The retrieving dogs 307 are attached to the collet lock sleeve 303 by means of pins 305. In addition, retaining rings 306 are provided at each end of the pins 305 to keep the pins 305 in place. The retaining rings 306 are seen in FIG. 5B, discussed below.

The retrieving dogs 307 have an internal upset 37. The internal upset 37 extends through slots 36 in the collet lock sleeve 303 and contact the outer diameter of the retrieving mandrel 301. The retrieving dogs 307 also have an external upset 38 which extends beyond the outer diameter of the downhole tool assembly 300.

Figure 5B:
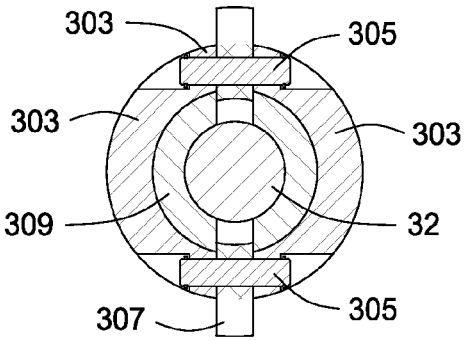
FIG. 5B is a cross-sectional view of the downhole tool assembly of FIGS. 4A through 4D. The view is taken across line B-B of FIG. 4A. Pins supporting dogs are seen. An elongated rod is also seen.

FIG. 5B is a cross-sectional view of the downhole tool assembly 300 of FIG. 4A. The view is taken across line B-B of FIG. 4A. Pins 305 supporting the retrieving dogs 307 are seen. The elongated rod 32 of the retrieving mandrel 310 is also seen in the center.

Figure 5C:
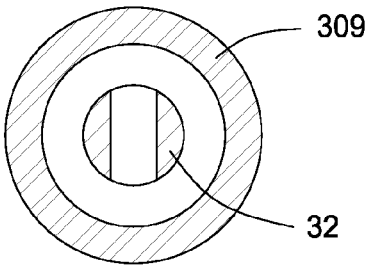
FIG. 5C is a cross-sectional view of the downhole tool assembly of FIGS. 4A through 4D. The view is taken across line C-C of FIG. 4A. A rod and a surrounding retrieving sleeve are seen.

FIG. 5C is another cross-sectional view of the downhole tool assembly 300 of FIG. 4A. The view is taken across line C-C of FIG. 4A. The elongated rod 32 of the retrieving mandrel 301 and surrounding retrieving sleeve 309 are seen.

Hose Guide/Whipstock Section

Figure 3B:
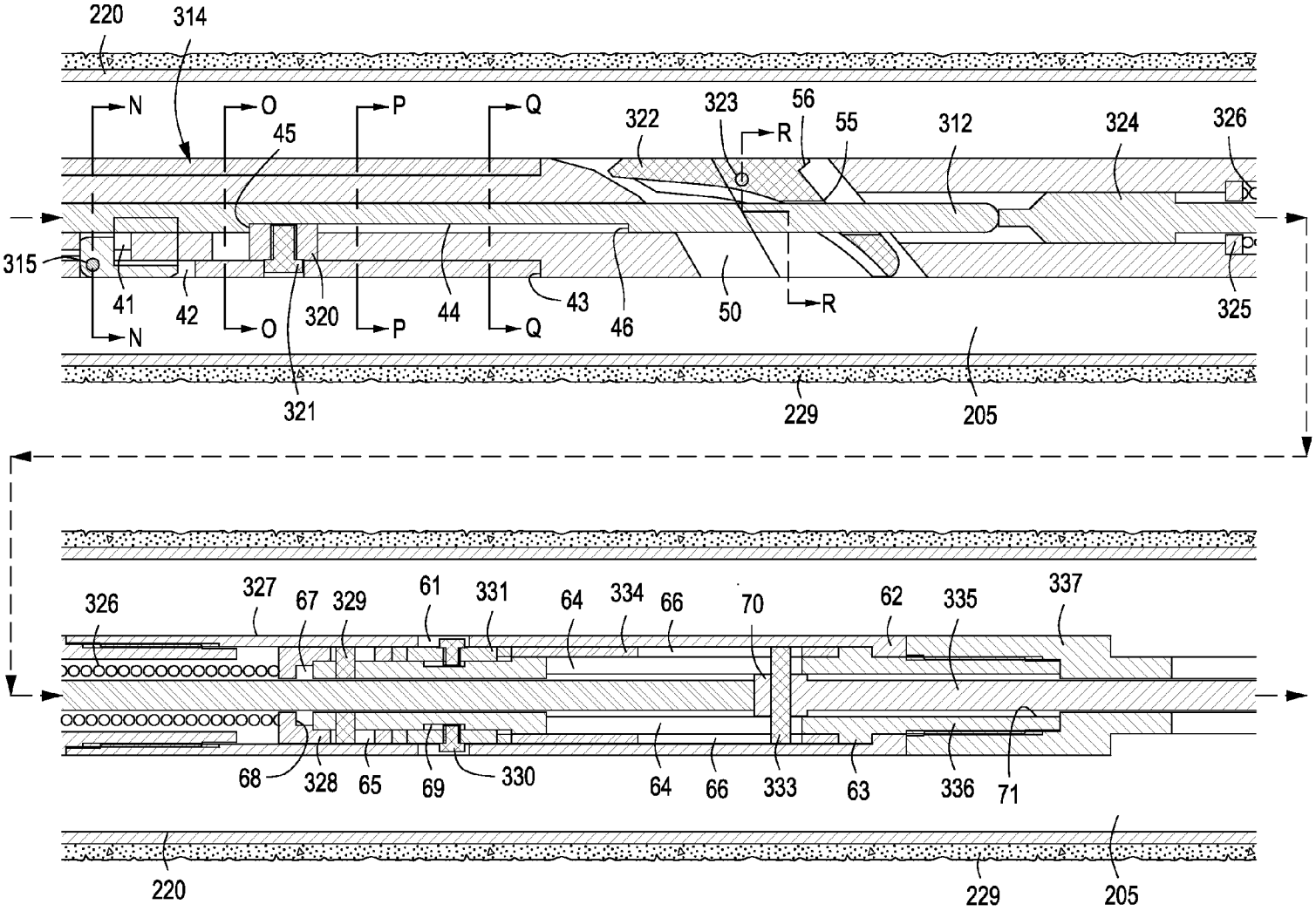

Also seen in FIG. 3A, and extending into FIG. 3B, the downhole tool assembly 300 has a hose guide/whipstock section. This section first includes an upper whipstock rod 312. The upper whipstock rod 312 is an elongated rod residing below rod 32 of the retrieving mandrel 301. In addition, a whipstock mandrel 313 resides around the whipstock rod 312. The whipstock mandrel 313 is threadedly connected to a lower end of the retrieving mandrel 301. The whipstock mandrel 313 includes a pair of elongated slots 39 below the retrieving mandrel 301.

The downhole tool assembly 300 also has a pair of pins. First, pin 310 extends through the rod 32 of the retrieving mandrel 301. The pin 310 also extends into the whipstock mandrel 313 to rotationally lock the pieces together. Second, pin 311 extends through holes at the lower end of the retrieving sleeve 309, through slots at the upper end of the whipstock mandrel 313, connecting the retrieving sleeve 309 to the whipstock rod 312.

Figure 5D:
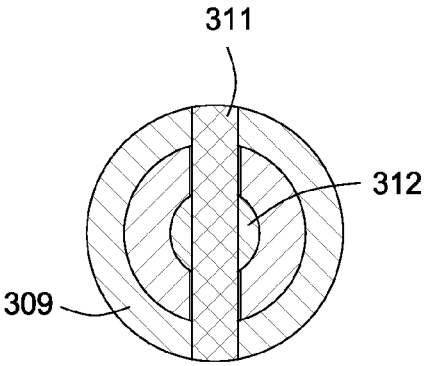
FIG. 5D is a cross-sectional view of the downhole tool assembly of FIGS. 4A through 4D. The view is taken across line D-D of FIG. 4A. A pin is visible in cross-section cutting through an upper whipstock rod and the retrieving sleeve.

FIG. 5D is a cross-sectional view of the downhole tool assembly 300 of FIG. 4A. The view is taken across line D-D of FIG. 4A. The pin 311 is visible in cross-section cutting through the rod 32 of the retrieving mandrel 301 and the retrieving sleeve 309.

Below the pair of slots 39 is a first stepped slot 41. The stepped slot 41 resides around a portion of the upper whipstock rod 312. Immediately below the first stepped slot 41 is a second slot 42. The second slot 42 extends through the wall of the whipstock mandrel 313. In addition to the first stepped slot 41 and the second slot 42, the tool assembly 300 provides a set of two additional stepped slots. The additional stepped slots are not seen as they are located immediately below the first stepped slots 41 but are equally radially spaced clockwise and counterclockwise around the circumference of the downhole tool assembly 300. Additional sets of two stepped slots are located further down on the whipstock mandrel 313, each also equi-radially spaced clockwise and counterclockwise around the circumference of the whipstock mandrel 313 from the set immediately above it.

Below the various stepped slots is an external shoulder 43. Below the external shoulder 43 is an angled opening 50. The angled opening 50 is formed through the whipstock mandrel 313 and is dimensioned to receive a whipstock 322. As will be discussed more fully below, the whipstock 322 is movable from a collapsed position (shown in FIG. 3B) to a set position (shown in FIG. 4B). In this way, the whipstock 322 may receive and redirect a jetting nozzle and connected jetting hose (seen in FIG. 10E).

In the arrangement of FIG. 3B, the upper side of the angled opening 50 has an arcuate profile, while the bottom side has a substantially linear profile. Other profiles may be selected so long as the opening 50 accommodates a pivoting motion by the whipstock 322. More specifically, the whipstock 322 pivots about a pin 323.

The downhole tool assembly 300 also includes a guide sleeve 314. The guide sleeve 314 defines a tubular body that resides concentrically around an upper portion of the whipstock mandrel 313. The guide sleeve 314 is positioned on the whipstock mandrel 313 over the stepped slots 41, 42. The guide sleeve 314 has matching sets of pockets which fit over the stepped slots 41, 42 in the whipstock mandrel 313.

The purpose of the guide sleeve 314 is to carry sets of hose guides 316, 317, 318, 319. Hose guides 316, 317, 318, 319 reside in the pockets and are seen in FIGS. 5E, 5F, 5G, and 5H. The hose guides 316, 317, 318, 319 are attached to the guide sleeve 314 with pins 315. The guides 316, 317, 318, 319 rotate on the pins 315 when the guide sleeve 314 is in a downward position against the external shoulder 43 on the whipstock mandrel 313. The guides 316, 317, 318, 319 are designed to rotate into the stepped slots 41, 42, etc. on the whipstock mandrel 313 so that they are flush with the outer diameter of the tool assembly 300 in the run-in position.

Figure 5E:
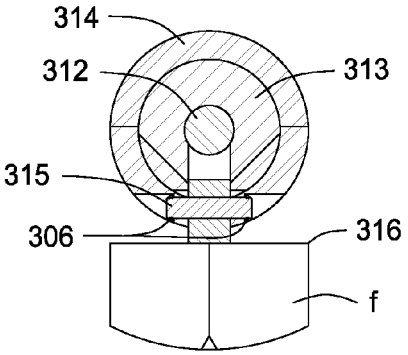
FIG. 5E is a cross-sectional view of the downhole tool assembly of FIGS. 4A through 4D. The view is taken across line E-E of FIG. 4A. A top hose guide is visible, having been actuated.

FIG. 5E is a cross-sectional view of the downhole tool assembly 300 of FIG. 4A. The view is taken across line E-E of FIG. 4A. The top hose guide 316 is visible, having been actuated.

Figure 5F:
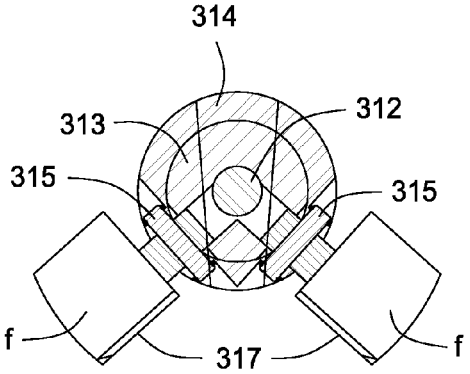
FIG. 5F is a cross-sectional view of the downhole tool assembly of FIG. 4A through 4D. The view is taken across line F-F of FIG. 4A. A second layer of two hose guides is seen, having been actuated.

FIG. 5F is another cross-sectional view of the downhole tool assembly 300 of FIG. 4A. The view is taken across line F-F of FIG. 4A. The second hose guide 317 is seen, having been actuated.

Figure 4B:
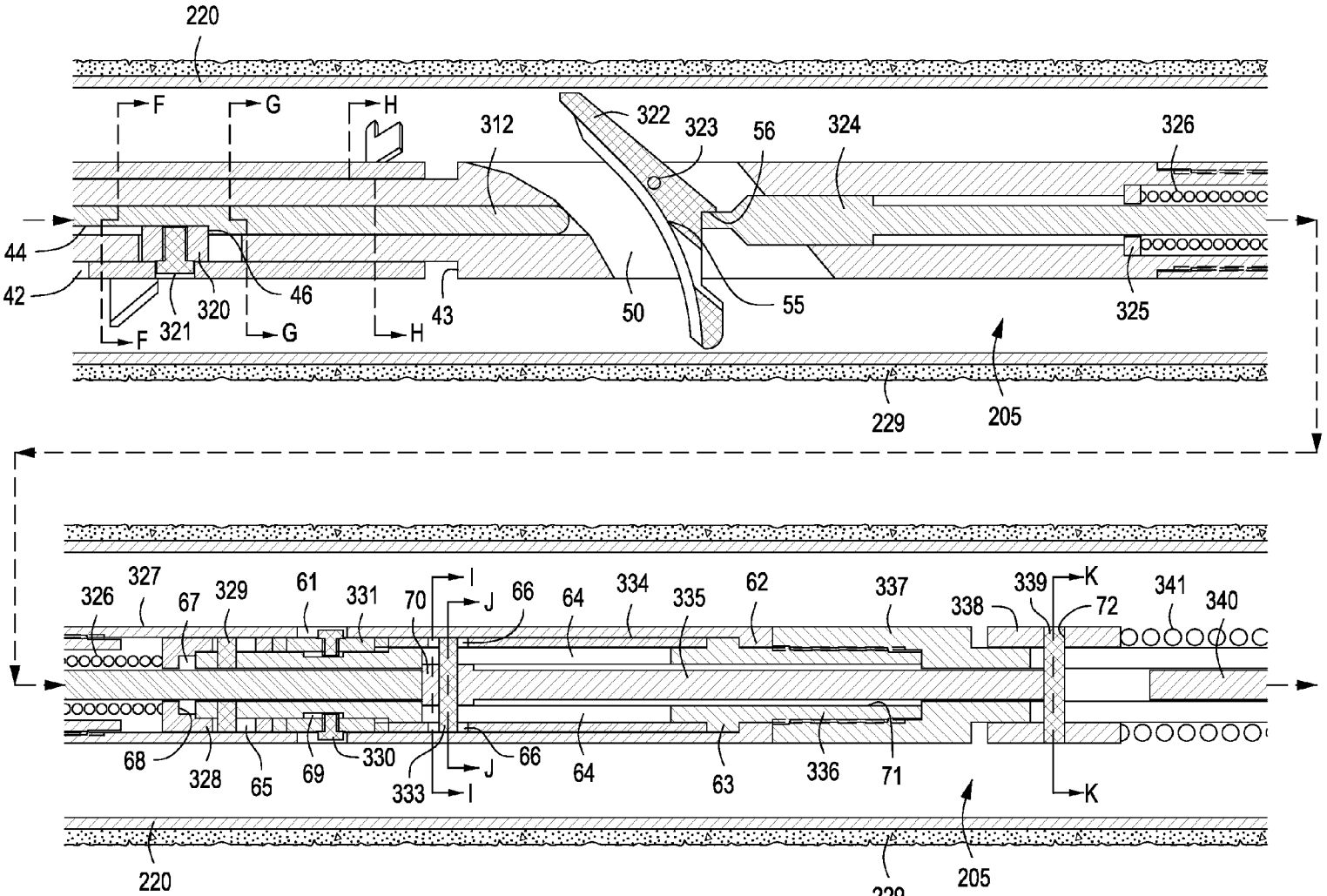
Figure 5G:
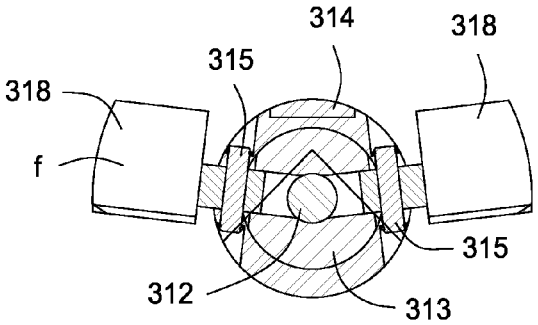
FIG. 5G is a cross-sectional view of the downhole tool assembly of FIGS. 4B through 3D. The view is taken across line G-G of FIG. 4B. A third layer of two hose guides is shown, having been actuated.

FIG. 5G is yet another cross-sectional view of the downhole tool assembly 300 of FIG. 4B. The view is taken across line G-G of FIG. 4B. The third hose guide 318 is shown, having been actuated.

Figure 5H:
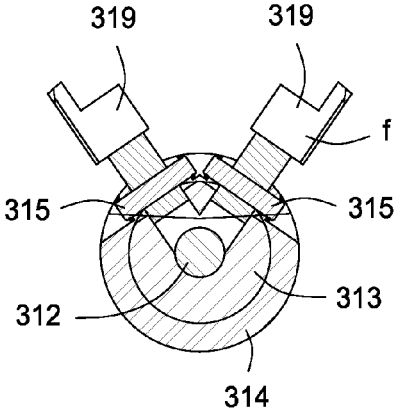
FIG. 5H is a cross-sectional view of the downhole tool assembly of FIGS. 4A through 4D. The view is taken across line H-H of FIG. 4B. A bottom hose guide is seen, having been actuated.

FIG. 5H is still another cross-sectional view of the downhole tool assembly 300 of FIG. 4B. The view is taken across line H-H of FIG. 4B. The bottom hose guide 319 is seen, having been actuated.

In the run-in position of FIG. 3B, the guides 316, 317, 318, 319 are collapsed into the slots 41, 42, etc. However, in the set position of FIGS. 4A and 4B, the guides 316, 317, 318, 319 are rotated outward. In operation, movement of the guide sleeve 314 causes the guides 316, 317, 318, 319 to rotate outwardly about 90 degrees. In this position, the guides 316, 317, 318, 319 serve to deflect and direct the jetting hose onto the top, curved face of the whipstock 322. The guides 316, 317, 318, 319 define angled deflecting faces so that as the hose hits the first guides 316, the hose is directed towards the next lowest guides 317. Hose guides 317 direct the hose towards the third guides 318, which in turn direct the hose towards the lowest guides 319.

Figure 5I:
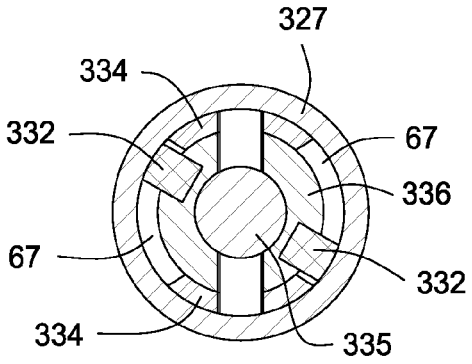
FIG. 5I is a cross-sectional view of the downhole tool assembly of FIGS. 4A through 4D. The view is taken across line I-I of FIG. 4B.
Figure 5J:
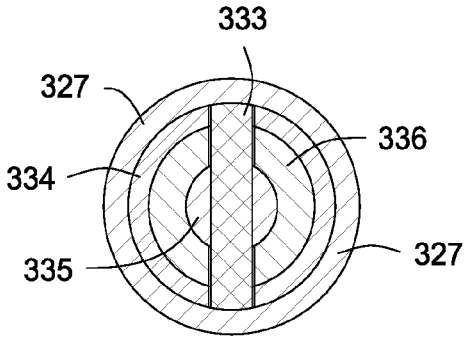
FIG. 5J is a cross-sectional view of the downhole tool assembly of FIGS. 4A through 4D. The view is taken across line J-J of FIG. 4B.
Figure 5K:
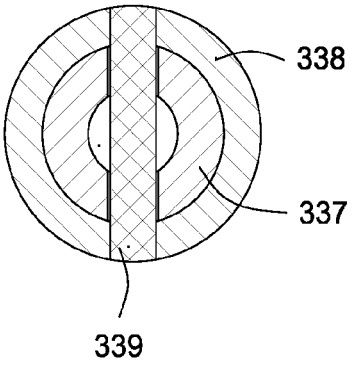
FIG. 5K is a cross-sectional view of the downhole tool assembly of FIGS. 4A through 4D. The view is taken across line K-K of FIG. 4B. A pin is seen cutting through the spring rod, the indexing spring mandrel, and a spring sleeve.
Figure 5L:
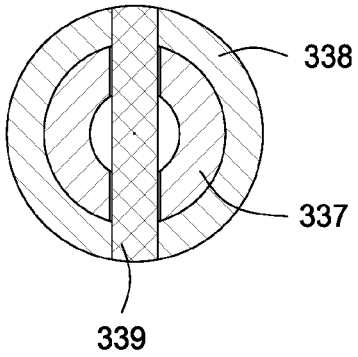
FIG. 5L is another cross-sectional view of the downhole tool assembly of FIGS. 4A through 4D. The view is taken across line L-L of FIG. 4C. A pin is again seen cutting through the spring rod, the indexing spring mandrel, and a spring sleeve.
Figure 5M:
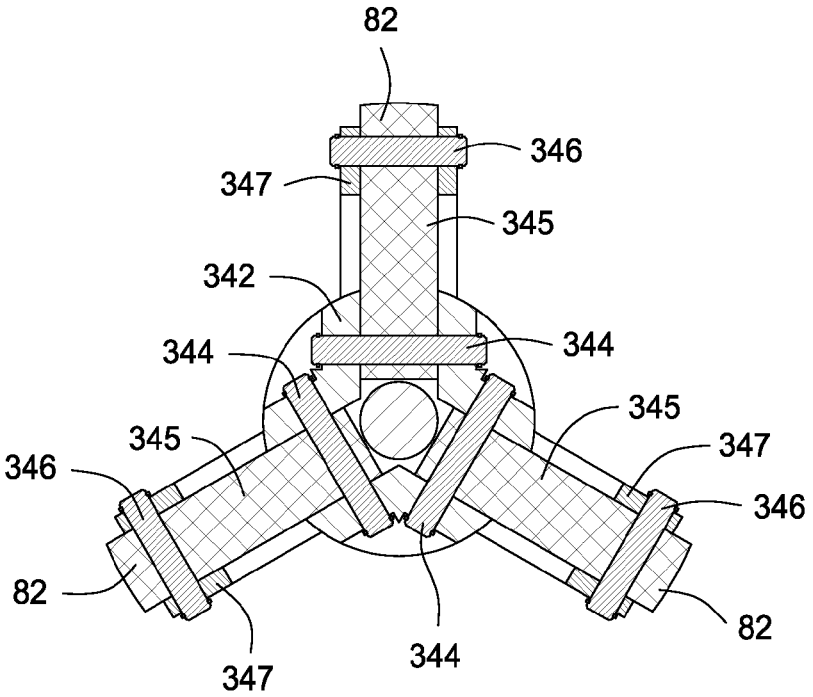
FIG. 5M is a cross-sectional view of the downhole tool assembly of FIGS. 4A through 4D. The view is taken across line M-M of FIG. 4C. Three slips are seen
Figure 5N:
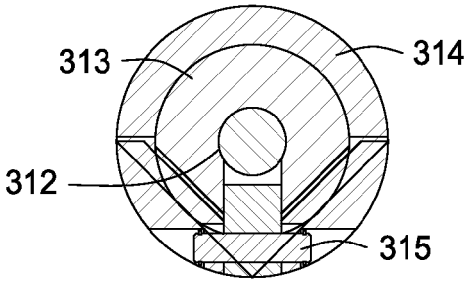
FIG. 5N is a cross-sectional view of the downhole tool assembly of FIGS. 3A through 3D. The view is taken across line N-N of FIG. 3B. The top hose guide is visible, having been collapsed.

FIG. 5N offers another cross-sectional view of the downhole tool assembly 300 of FIG. 3B. The view is taken across line N-N of FIG. 3B. The top hose guide 316 is visible, having been collapsed.

Figure 5O:
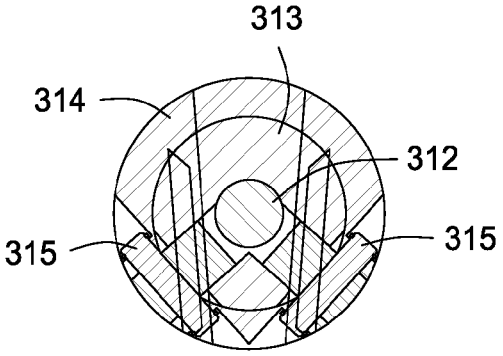
FIG. 5O is a cross-sectional view of the downhole tool assembly of FIGS. 3A through 3D. The view is taken across line O-O of FIG. 3B. The second hose guide is seen, having been collapsed.

FIG. 5O is yet another cross-sectional view of the downhole tool assembly 300 of FIG. 3B. The view is taken across line O-O of FIG. 3B. The second hose guide 317 is seen, having been collapsed.

Figure 5P:
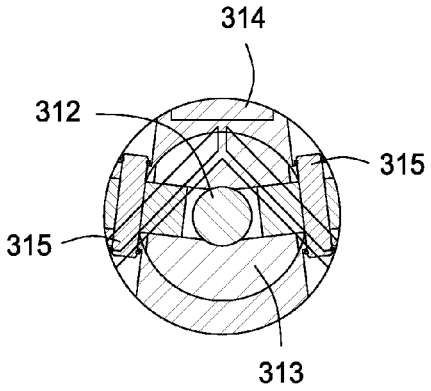
FIG. 5P is a cross-sectional view of the downhole tool assembly of FIGS. 3A through 3D. The view is taken across line P-P of FIG. 3B. The third hose guide is shown, having been collapsed.

FIG. 5P is yet another cross-sectional view of the downhole tool assembly 300 of FIG. 3B. The view is taken across line P-P of FIG. 3B. The third hose guide 318 is shown, having been collapsed.

Figure 5Q:
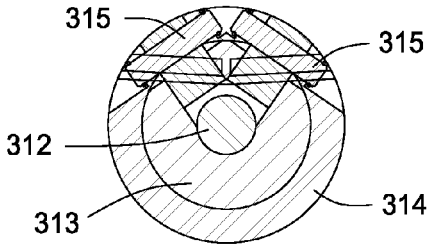
FIG. 5Q is a cross-sectional view of the downhole tool assembly of FIGS. 3A through 3D. The view is taken across line Q-Q of FIG. 3B. The bottom hose guide is seen, having been collapsed.

FIG. 5Q provides another a cross-sectional view of the downhole tool assembly 300 of FIG. 3B. The view is taken across line Q-Q of FIG. 3B. The bottom hose guide 319 is seen, having been collapsed.

As noted above, the upper end of the whipstock rod 312 is attached to the retrieving sleeve 309 with a pin 311. In this way, the retrieving sleeve 309 and the whipstock rod 312 move together. The whipstock rod 312 includes a longitudinal flat surface 44, or "flat." A dog 320 is positioned in a slot in the whipstock mandrel 313 below the top stepped slot 41 and along the flat 44. A hex socket screw 321 is made up in the dog 320, with the screw head sunken into a recess in the guide sleeve 314. The dog 320 is positioned against an upper shoulder 45 on the flat 44. When the upper whipstock rod 312 is moved upward, a shoulder 46 at the lower end of the flat 44 contacts the dog 320 and moves the guide sleeve 314 upward. Reciprocally, when the whipstock rod 312 is moved downward, the shoulder 45 at the upper end of the flat 44 contacts the dog 320 and moves the guide sleeve 314 downward.

The whipstock mandrel 313 extends below the opening 50. Threads are placed at the lower end of the whipstock mandrel 313 for connection with an outer indexing sleeve 327.

As also noted, a whipstock 322 is positioned in the opening 50 machined in the whipstock mandrel 313. The whipstock 322 is connected to the whipstock mandrel 313 with a pin 323. The whipstock 322 has a machined radius which guides the flexible jetting hose from one side of the casing 220 to the other when rotated to the set position (seen in FIG. 4B). The whipstock 322 collapses into the tool assembly 300 when rotated to the closed position (seen in FIG. 3B). The whipstock 322 includes a hole 55 that allows the upper whipstock rod 312 to move through the whipstock 322 and contact a lower whipstock rod 324. The lower end of the whipstock 322 is machined so that its rotation is limited in the set position by the upper end of the lower whipstock rod 324.

Figure 5R:
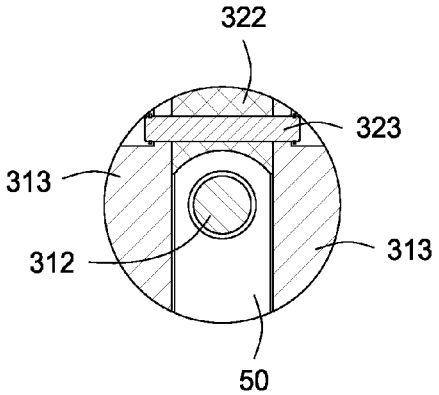
FIG. 5R is a cross-sectional view of the downhole tool assembly of FIGS. 3A through 3D. The view is taken across line R-R of FIG. 3B. The whipstock rod is seen, along with a portion of the whipstock.

FIG. 5R is a cross-sectional view of the downhole tool assembly 300 of FIG. 3B. The view is taken across line R-R of FIG. 3B. The upper whipstock rod 312 is seen, along with a portion of the whipstock 322.

Indexing Section

Figure 3C:
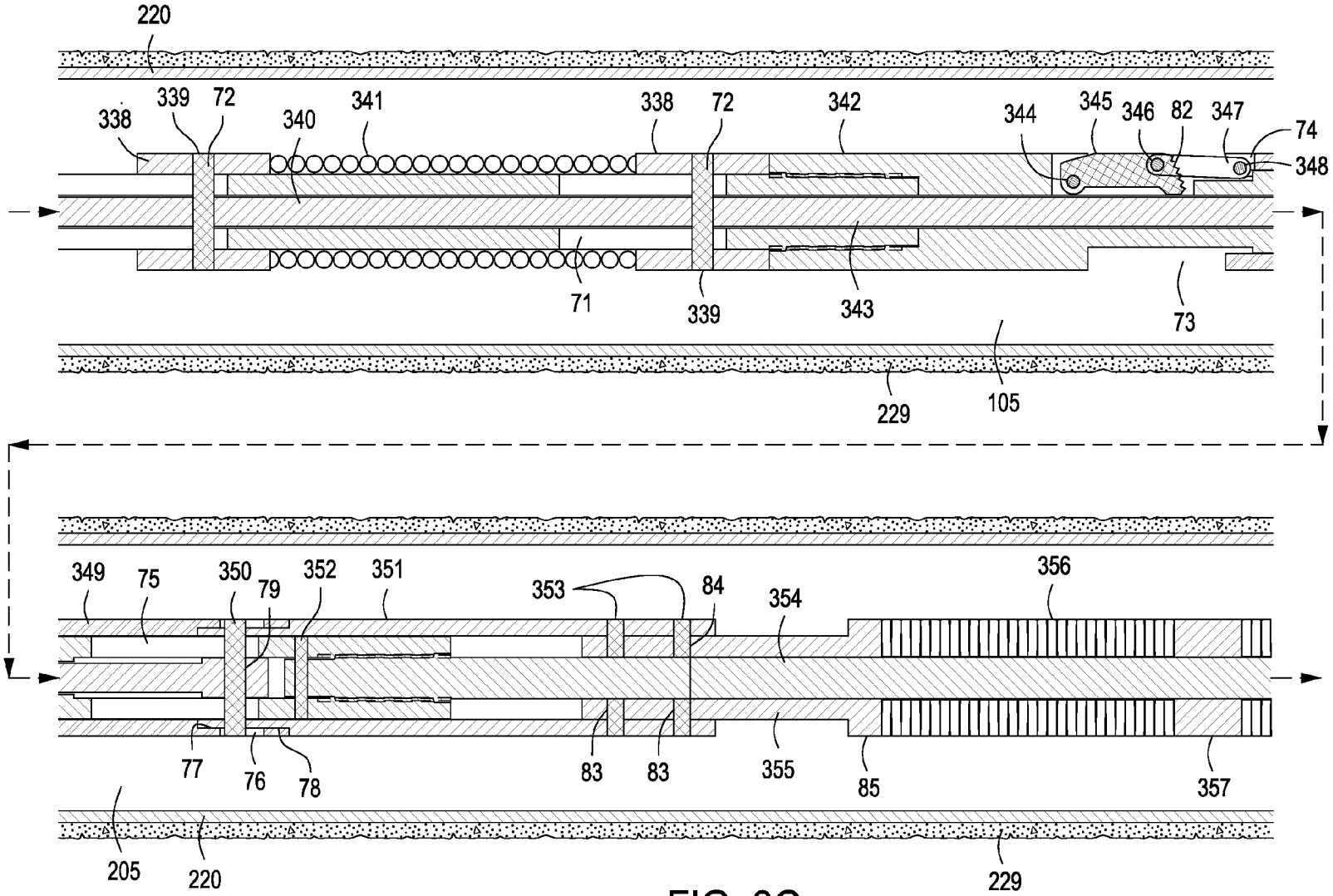
Figure 3D:
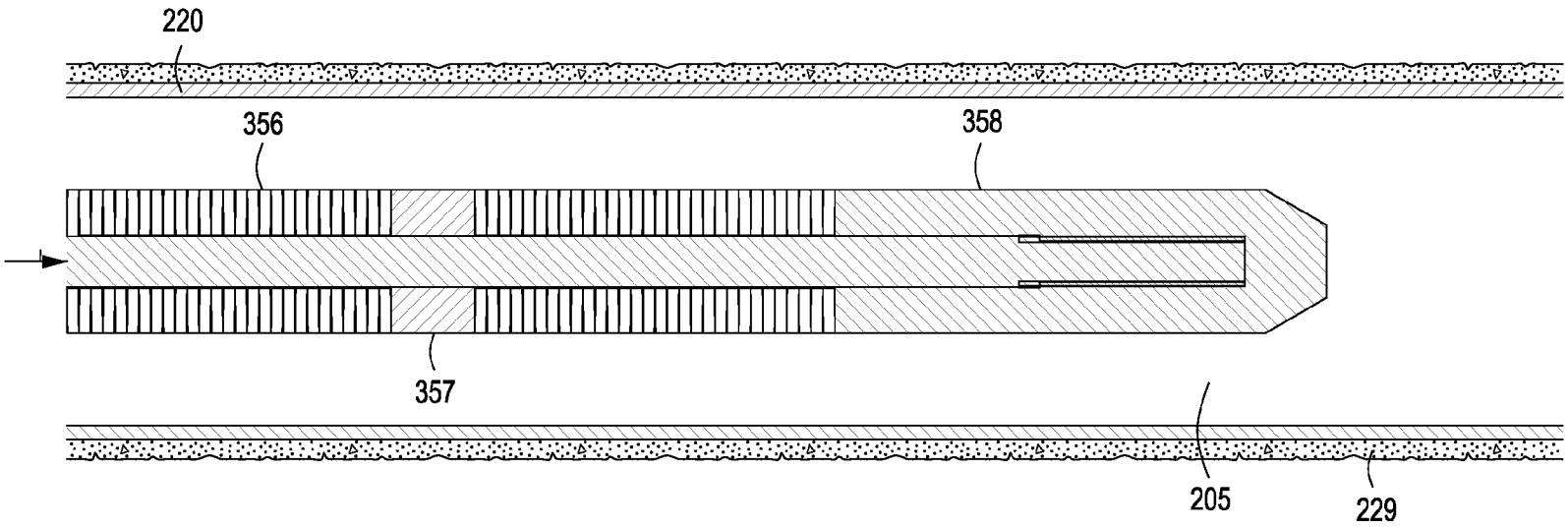
Figure 4C:
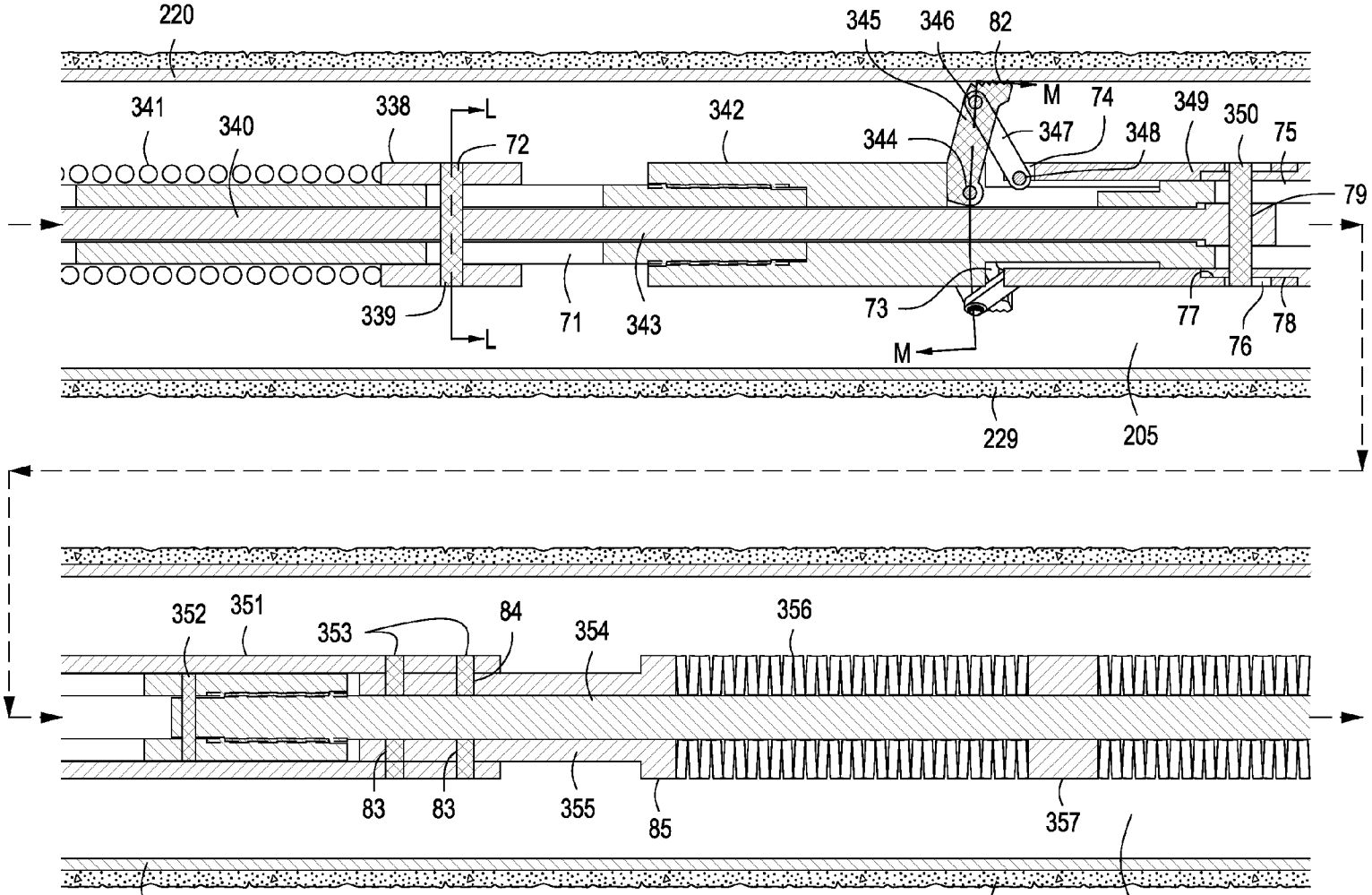
Figure 4D:
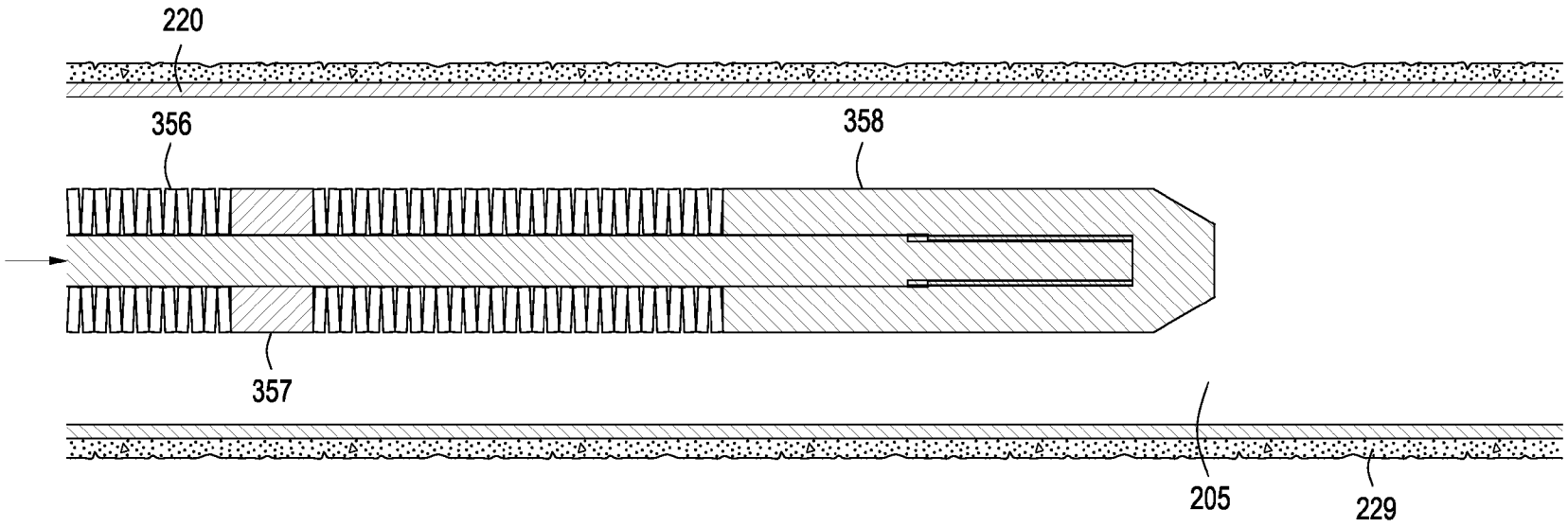

The downhole tool assembly 300 also includes an indexing section. Components of the indexing section are seen in FIGS. 3C and 4C. The indexing section allows the operator to rotate the angular (radial) orientation of the whipstock 322 within the wellbore.

As part of the indexing section, the tool assembly 300 first has an outer indexing sleeve 327. The outer indexing sleeve 327 is connected to the lower end of the whipstock mandrel 313. The middle of the outer indexing sleeve 327 has two short longitudinal slots 61 spaced 180 degrees apart. The outer indexing sleeve 327 also has an internal upset 62 at the lower end which is captured between an external upset 63 on the lower end of an indexing mandrel 336 and the upper end of an indexing spring mandrel 337. The indexing mandrel 336 and the indexing spring mandrel 337 are connected with a thread.

Above the external upset 63 on the lower end of the indexing mandrel 336 are two longitudinal slots 64 spaced 180 degrees apart. Two holes (not visible) are located 180 degrees apart and 90 degrees from the slots 64. Above these slots 64 are two short shallow slots 65 and at the upper end of the indexing mandrel 336 are two holes (not seen). These holes provide a housing for additional pins (not seen) that are located through the circumferential slots in a lower indexing ratchet 334 and in the two longitudinal slots 64. The holes allow limited rotational movement of the lower indexing ratchet 334 relative to the indexing mandrel 336 while preventing longitudinal movement.

The lower indexing ratchet 334 is positioned against the upper end of the external upset 63 on the indexing mandrel 336. The middle of the lower indexing ratchet 334 has two slots 66 spaced 180 degrees apart. The upper ends of the slots 66 are machined on a lead and the lower ends are straight.

The upper end of the lower indexing ratchet 334 contains ratchet teeth (not visible). The ratchet teeth are configured to have an angle on one side and an opposing side that is parallel to the centerline of the downhole tool assembly 300. An inner indexing sleeve 331 is positioned above the lower indexing ratchet 334 on the indexing mandrel 336. The lower end of the inner indexing sleeve 331 has ratchet teeth identical to and mating with the ratchet teeth on the upper end of the lower indexing ratchet 334.

In the middle of the inner indexing sleeve 331 are two threaded holes spaced 180 degrees apart. The upper end of the inner indexing sleeve 331 has ratchet teeth which are opposite to those on the lower end. An upper indexing ratchet 328 is positioned on the indexing mandrel 336 above the inner indexing sleeve 331. The lower end of the upper indexing ratchet 328 has ratchet teeth that mate with the ratchet teeth on the upper end of the inner indexing sleeve 331.

In the middle of the upper indexing ratchet 328 are two short longitudinal slots 67 spaced 180 degrees apart. The upper end of the upper indexing ratchet 328 has in internal upset. 68. A spring 326 is positioned above the upper indexing ratchet 328 to keep the upper indexing ratchet 328 and the inner indexing sleeve 331 pushed downward against the lower indexing ratchet 334. Pins 329 are located through the two slots 67 on the upper indexing ratchet 328 and the two holes in the upper end of the indexing mandrel 336. These allow longitudinal movement for the upper indexing ratchet 328 relative to the indexing mandrel 336.

Screws 330 are made up in threaded holes in the inner indexing sleeve 331. Heads for the screws 330 are sunken into slots 69 in the outer indexing sleeve 327. The slots 69 allow longitudinal movement of the inner indexing sleeve 331 relative to the outer indexing sleeve 327, and also allow torque to be transmitted from the inner indexing sleeve 331 to the outer indexing sleeve 327. Additional pins (not seen) are located through the circumferential slots in the lower indexing ratchet 334 and in the two holes in the indexing mandrel 336 between the two longitudinal slots 64. These allow limited rotational movement of the lower indexing ratchet 334 relative to the indexing mandrel 336 but prevent longitudinal movement.

The outer indexing sleeve 327 is seen around the lower indexing ratchet 334, the indexing mandrel 336, and an indexing rod 335. The indexing rod 335 is located along a portion of the indexing mandrel 336. The indexing rod 335 has a radial hole 70 at the upper end. An indexing pin 333 is located through the slots 66 machined on a lead in the lower indexing ratchet 334, the longitudinal slots 64 in the indexing mandrel 336, and the hole 70 in the indexing rod 335.

FIG. 5I is a cross-sectional view of the downhole tool assembly of FIG. 4B. The view is taken across line I-I of FIG. 4B. The outer indexing sleeve 327 is seen surrounding the upper indexing ratchet 328 and the indexing mandrel 336.

FIG. 5J is another cross-sectional view of the downhole tool assembly of FIG. 4B. The view is taken across line J-J of FIG. 4B. The outer indexing sleeve 327 is seen surrounding the lower indexing ratchet 334, the indexing mandrel 336, and the lower whipstock rod 324.

Below the threads at the upper end of the indexing spring mandrel 337 are two sets of two longitudinal slots 71. The slots 71 are located 180 degrees apart. At the lower end of the indexing spring mandrel 337 is a thread which connects the indexing spring mandrel 337 to a slip mandrel 342. This is seen in FIG. 3C and FIG. 4C.

Upper and lower spring sleeves 338 are located on the indexing spring mandrel 337. A spring 341 is disposed between the spring sleeves 338. The spring sleeves 338 each have two holes 72 located 180 degrees apart. Pins 339 are located through the holes 72 in the spring sleeves 338 and through the longitudinal slots 71 in the indexing spring mandrel 337. A spring rod 340 is then located in the middle of the indexing spring mandrel 337 between the two pins 339. The spring rod 340 limits compression of spring 341 and transfers downward load to the pin 339 and the slip rod 343 after the spring 341 is compressed.

FIG. 5K is a cross-sectional view of the downhole tool assembly 300 of FIG. 4B. The view is taken across line K-K of FIG. 4B. A pin 339 is seen cutting through the spring rod 340, the indexing spring mandrel 337, and a spring sleeve 338.

FIG. 5L is another cross-sectional view of the downhole tool assembly 300 of FIG. 4B. The view is taken across line L-L of FIG. 4C. A pin 339 is again seen cutting through the spring rod 340, the spring mandrel 342, and a spring sleeve 338.

Slip Section

As noted, the downhole tool assembly 300 also has a slip section. Components of the slip section are generally seen in FIG. 3C and FIG. 4C. The slip section first includes a slip mandrel 342. The slip mandrel 342 is connected to the lower end of the indexing spring mandrel 337. The slip mandrel 342 has three longitudinal slots 73 spaced 120 degrees apart. Below the slots 73 are two longitudinal slots 74 spaced 180 degrees apart.

A thread is located at the lower end of the slip mandrel 342. An upper slip sleeve 349 is located on the slip mandrel 342. The upper slip sleeve 349 has three slots 75 spaced 120 degrees apart on the upper end. In addition, the upper slip sleeve 349 has two short slots 76 spaced 180 degrees apart on the lower end. The upper slip sleeve 349 also has an internal undercut 77 on the lower end.

A lower slip sleeve 351 is located below the upper slip sleeve 349. The lower slip sleeve 351 has an external undercut 78 on the upper end which is located in the internal undercut 77 in the lower end of the upper slip sleeve 349. The lower slip sleeve 351 also has two holes spaced 180 degrees apart at the upper end, and multiple holes at the lower end. A slip rod 343 with a radial hole 79 at the lower end is located in the slip mandrel 342. A pin 350 is located through the slots 75 at the lower end of the upper slip sleeve 349, the holes at the upper end of the lower slip sleeve 351, and the hole 79 at the lower end of the slip rod 343.

Slips 345 are located in the three longitudinal slots 73 in the slip mandrel 342. The slips 345 are connected at the upper end to the slip mandrel 342 with pins 344. Each slip 345 is connected at the lower end to two slip arms 347. This connection is via pins 346. Each slip 345 also has multiple hardened sharp teeth 82 machined on the end on a radius so that as the slip 345 rotates outward and contacts the casing I.D., the teeth 82 will bite into the casing 220. In this manner the slips 345, slip arms 347 and pins 344, 346 form an anchor.

FIG. 5M is a cross-sectional view of the downhole tool assembly 300 of FIG. 4C. The view is taken across line M-M of FIG. 4C. Three slips 345 are seen in an actuated state.

The lower ends of the slips 345 are connected to the upper end of the upper slip sleeve 349. This connection is via pins 348. In operation, upward movement of the upper slip sleeve 349 extends the slips 345 outward by rotation around the pins 344, 346, 348. Reciprocally, downward movement of the upper slip sleeve 349 pulls the slips 345 inward into the slots 73 in the slip mandrel 342 flush with the O.D. of the tool assembly 300.

A slip spring mandrel 354 is connected to the lower end of the slip mandrel 342 with threads. A pin 352 inserted through holes in the slip mandrel 342 and the slip spring mandrel 354 rotationally locks the slip mandrel 342 and the slip spring mandrel 354 together.

An upper spring shoe 355 is located in the lower end of the lower slip sleeve 351 on the slip spring mandrel 354. The upper spring shoe 355 has a pair of holes 83 at the upper end which match holes 84 at the lower end of the lower slip sleeve 351. The upper spring shoe 355 and the lower slip sleeve 351 are held together with shear pins 353 located through holes 83, 84.

The upper spring shoe 355 has an external upset 85 at the lower end. Multiple sets of disc springs 356 are located on the slip spring mandrel 354. Each set of disc springs 356 is separated by spacers 357. A thread is located at the lower end of the slip spring mandrel 354. The thread connects the slip spring mandrel 354 to the lower spring shoe 358. The spacers 357 and disc springs 356 extend from FIG. 3C into FIG. 3D, and from FIG. 4C into FIG. 4D.

In order to set and to manipulate the tool assembly 300 of FIGS. 3A through 3D and FIGS. 4A through 4D, a setting tool may be provided. FIGS. 6A through 6D provide a cross-sectional expanded view of a downhole setting tool 600. The setting tool 600 is designed to selectively move the tool assembly 300 from its run-in position (FIGS. 3A through 3D) to its set position (FIGS. 4A through 4D). Once the downhole tool assembly 300 is in its set and operating position, the setting tool 600 is can re-engage the assembly 300. The setting tool utilizes incremental, indexed rotation to reorient the upper portions of the assembly 300 (and, accordingly, the whipstock 322) a desired number of degrees. Note that this indexed rotation of the upper portions of the downhole tool assembly 300 is accomplished without having to disengage the slips 345. The setting tool 600 is also used to retrieve the downhole tool assembly 300 from a wellbore after jetting operations are completed.

The setting tool 600 generally includes:

- A slip joint section located at the top of the setting tool 600.
- A rod/barrel section located in the middle of the setting tool 600.
- A lock section that locks the setting tool 600 in an extended position for running and retrieving the tool assembly 300.
- A centralizer section for centralizing the setting tool 600.
- A collet section which connects the setting tool 600 to the tool assembly 300.

Slip Joint Section

The setting tool 600 first includes a slip joint section. The slip joint section allows opposing forces to be directed into the tool 600. Specifically, weight may be set down on an inner section of the setting tool 600 while tension is applied to an outer section. The slip joint section also allows rotation of the setting tool 600 with upper sections of the downhole tool assembly 300 without rotating the coiled tubing.

Figure 6A:
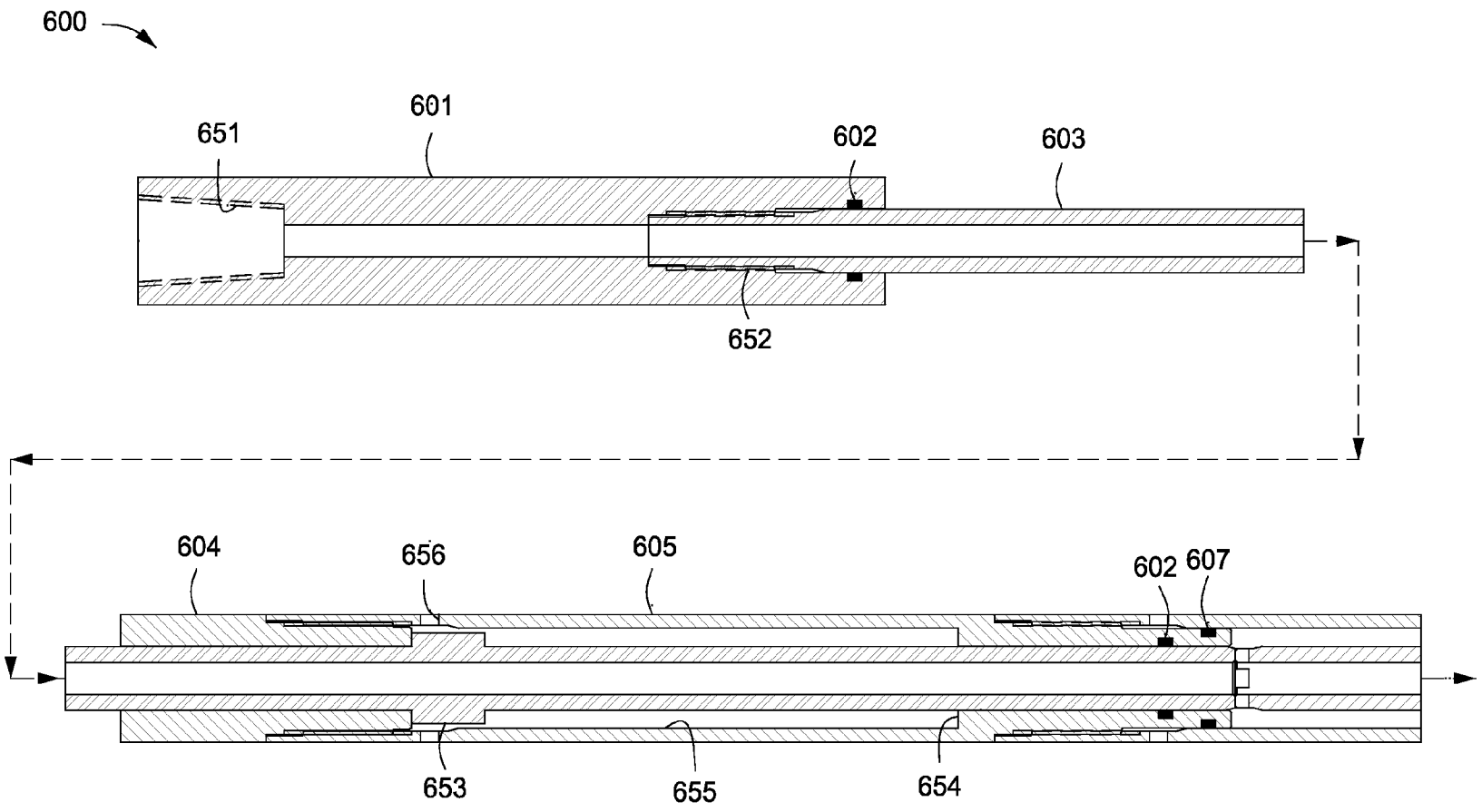
FIGS. 6A through 6D provide a cross-sectional expanded view of a downhole setting tool. The setting tool is designed to selectively move the downhole tool assembly from its run-in position (FIGS. 3A through 3D) to its set position (FIGS. 4A through 4D). Here, the setting tool itself is in its run-in position.

This slip joint section is generally seen in FIG. 6A. As part of the slip joint section, the setting tool first includes a coupling 601. The coupling 601 is an elongated tubular body having upper internal threads 651 at an upper end and lower internal threads 652 at a lower end. The upper threads 651 allow the setting tool 600 to be connected to a run-in or working string (not shown), preferably one of coiled tubing, or a jetting hose connected to coiled tubing, while the lower internal threads 652 connect to the upper end of a slip joint rod 603.

The slip joint rod 603 also defines an elongated tubular body. The slip joint rod 603 serves to allow telescoping motion for the setting tool 600. O-rings 602 are provided at opposing ends of the slip joint rod 603. The o-rings 602 provide a fluid seal. The slip joint rod 603 also has an external upset 653. The external upset 653 serves as a shoulder for receiving the lower end of a retaining shoe 604. The retaining shoe 604 covers a portion of the slip joint rod 603 and serves to limit the travel of the slip joint rod 603.

The retaining shoe 604 is threadedly connected to an upper barrel 605. The upper barrel 605 defines an elongated tubular body forming an outer wall for a portion of the setting tool 600. The upper barrel 605 has an internal upset 654 at a lower end. An annular region 655 is formed between the slip rod 603 and the surrounding upper barrel 605. The annular region 655 is generally bounded by the external upset 653 and the internal upset 654.

The upper barrel 605 has threads at upper and lower ends. Through-openings 656 are provided along the upper barrel 605 below the threads at the upper end. These through-openings 656 allow fluid movement out of the contained annular region 655 as well as pressure equalization. The upper barrel 605 also has an o-ring 607 outside of the internal upset 654.

Rod/Barrel Section

Figure 6B:
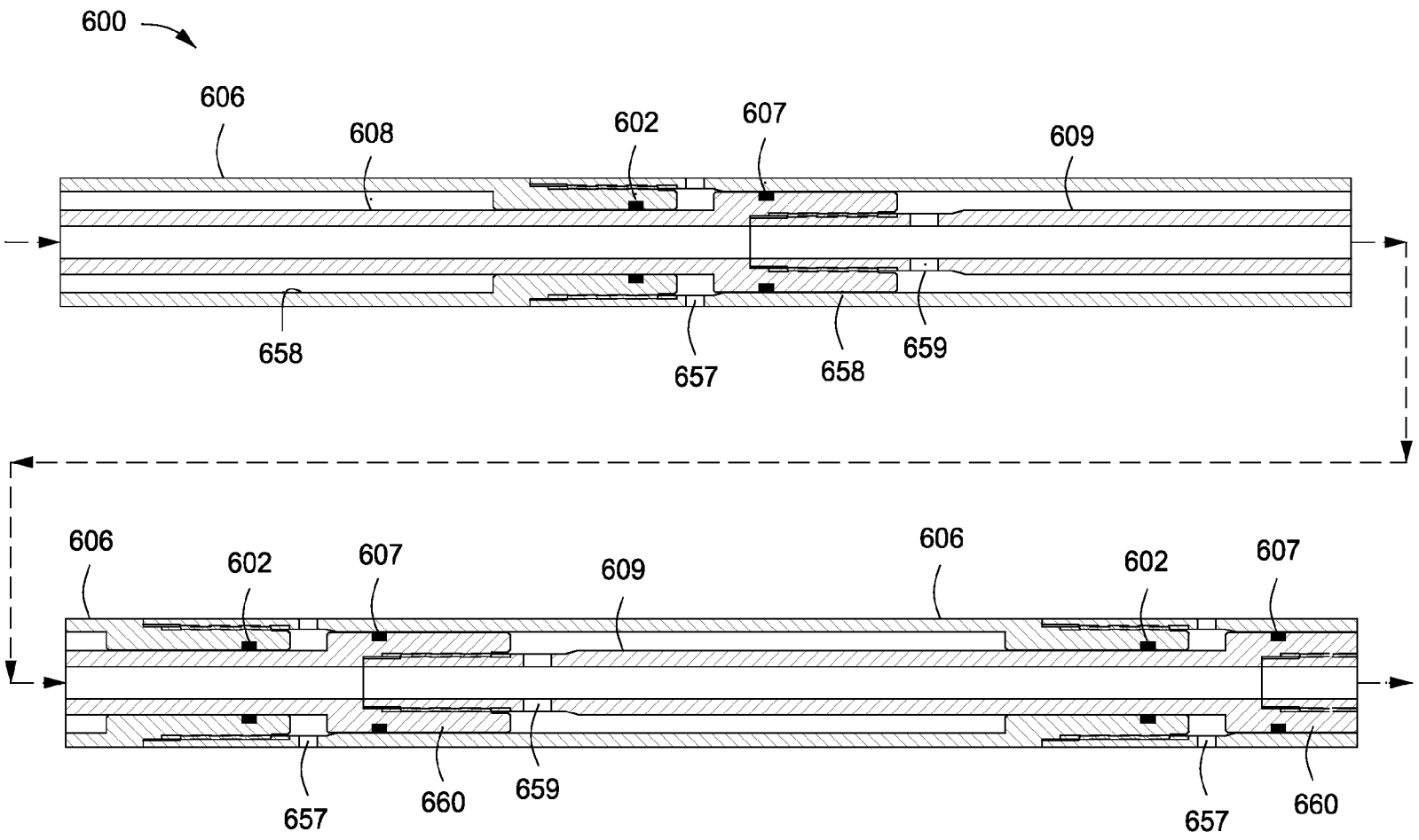

The setting tool 600 also includes a rod/barrel section. The rod/barrel section is generally seen in FIG. 6B. The rod/barrel section is located in the middle of the setting tool 600 below the slip section. The rod/barrel section has multiple differential areas positioned in series below the upper barrel 605 which allow pressure to be applied to generate downward force to the tool assembly 300.

The rod/barrel section first includes a barrel 606. The barrel 606 also defines an elongated tubular body forming an outer wall for a portion of the setting tool 600. The barrel 606 is threadedly connected to the lower end of the upper barrel 605. The barrel 606 has internal threads at an upper end.

The barrel 606 is generally dimensioned in the same way as the upper barrel 605. In this respect, the barrel 606 also has an internal upset 658 at a lower end as well as o-rings 602, or seals. Through-openings 657 are provided below the threads which allow fluid movement and pressure equalization.

The lower end of the barrel 606 is attached to a next barrel in series. This means that the rod/barrel section preferably comprises two or more barrels 606. FIG. 6B shows three barrels 606 connected end-to-end. The last barrel 606 in the series (seen in FIG. 6C) is attached to a lock barrel 615.

The rod/barrel section also includes a series of rods. The first rod (seen in FIG. 6B) is an upper rod 608. The upper rod 608 is positioned below the slip joint rod 603. The upper rod 608 has an external upset 658 at a lower end. The external upset 658 receives o-ring 607 at the top of FIG. 6B. Above the external upset 658, the upper rod 608 receives o-ring 602. Thus, the lower end of the upper rod 608 serves as a sealing surface.

The lower end of the upper rod 608 also has internal threads. The internal threads mate with threads of an elongated rod 609. FIG. 6B shows that the setting tool 600 includes a series of rods 609 within the barrels 606. Each rod 609 has through-openings 659 below the threads which allow fluid movement and pressure equalization.

The lower end of each rod 609 has an external upset 660. The external upsets 660 also receive o-rings 607. The last rod 609 in the series is attached to a lower rod 610.

Lock Section

Figure 6C:
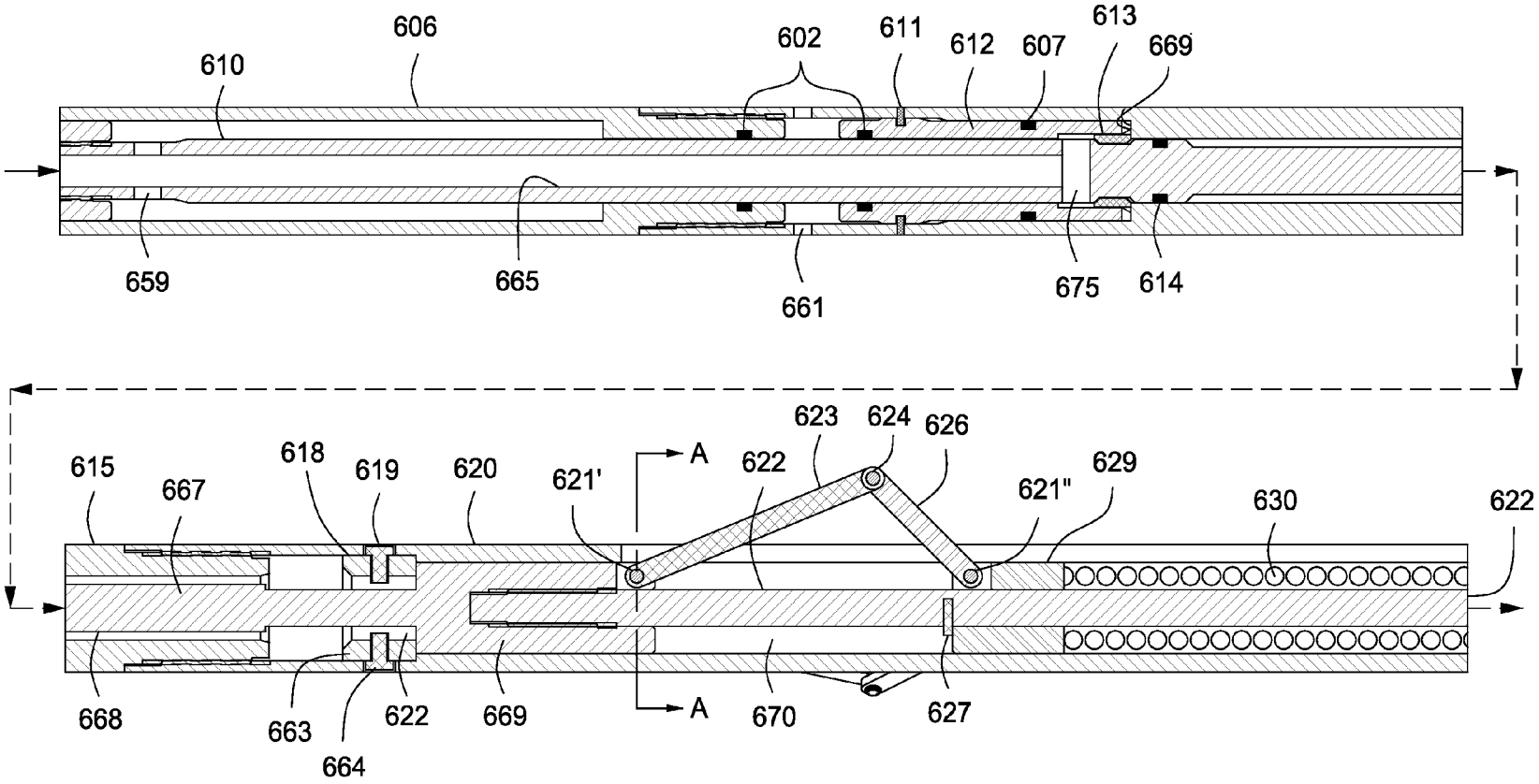

The setting tool 600 also includes a lock section. The lock section is generally seen in FIG. 6C. The lock section serves to lock the setting tool 600 in an extended position for running and retrieving the downhole tool assembly 300.

The lock section first includes a lock barrel 615. The lock barrel 615 defines an elongated tubular body that forms an outer wall for a portion of the setting tool 600. The lock barrel 615 as threadedly connected to the last barrel with threads. Through-openings 661 are provided below the threads at the upper end. The through-openings 661 allow fluid movement and pressure equalization.

Below the through-openings 661 are threaded holes for receiving shear pins 611. The shear pins 611 hold a lock sleeve 612 in place. Below the shear pins 611 is an internal sealing surface contacting o-rings 602 and 607. At the lower end of the lock barrel 615 is an external thread. A lower barrel 620 is attached to the lower end of the lock barrel 615 with the threads.

The lower barrel 620 has an undercut 662 below the threads. Near the lower end of the undercut 662 are threaded holes 663. A dog retainer 618 is positioned at the end of the internal undercut 662. The dog retainer 618 is held in place with hex socket head screws 619. The head screws 619 are placed through through-openings 664 in the lower barrel 620 into threaded holes in the dog retainer 618. The dog retainer 618 and head screws 619 help retain the lower barrel 620.

Returning again to the lower rod 610, the lower rod 610 comprises an elongated bore 665. The bore 665 is in fluid communication with the through-openings 659. The bore 665 is also in fluid communication with a radial hole 675. Below the radial hole 675 is an external groove in which a lock ring 613 is placed. The lock ring 613 secures a locking rod 667.

The lock ring 613 is used when running the downhole setting tool 600 into a wellbore with the tool assembly 300 attached. The lock ring 613 is used to lock the setting tool 600 in its extended position, and to keep the retrieving dogs 307, hose guides 316, 317, 318, 319, whipstock 322, and slips 345 collapsed on the tool assembly 300 when running into the wellbore. FIG. 6C shows the lock ring 613 in a groove on the lower rod 610 below the radial hole 675. The lock ring 613 is held in place with the lock sleeve 612, which in turn is held in place with shear pins 611. Pressure acts on the lock sleeve 612 to move to move the lock sleeve 612 upward and off of the lock ring 613. This releases the lock ring 613 from the groove, thereby allowing the downhole tool assembly 300 to be set.

An external seal 614 is placed around the locking rod 667. Below the seal 614 is an external undercut, or reduced outer diameter portion 668. At a lower end of the locking rod 667 is an external upset 669. The external upset 669 defines an enlarged outer diameter portion with three slots 670. The slots 670 are cut in the lower end of the locking rod 667 120 degrees apart.

The lock sleeve 612 is positioned on the lower rod 610. The lock sleeve 612 has an internal seal 602 at the upper end and an external seal 607. The lock sleeve 612 also receives the shear pins 611. The shear pins 611 hold the lock sleeve 612 in place. The lock sleeve 612 has an internal undercut 669 at the lower end. The lock ring 613 is placed along the internal undercut 669 and below the radial hole 665.

Figure 8A:
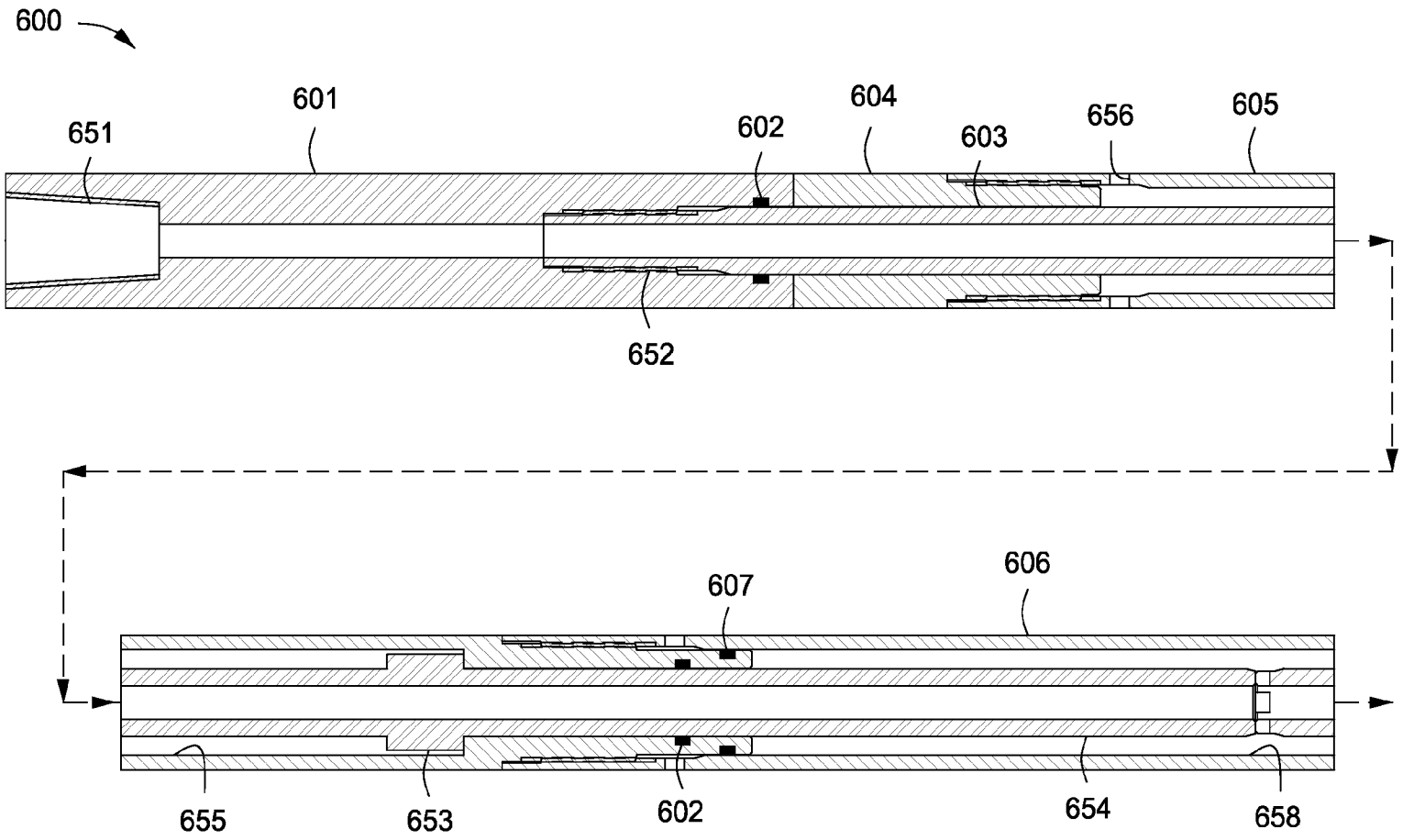
FIGS. 8A through 8D provide yet another cross-sectional expanded view of the setting tool of FIGS. 6A through 6D. Here, the setting tool is in its retrieving position.
Figure 8B:
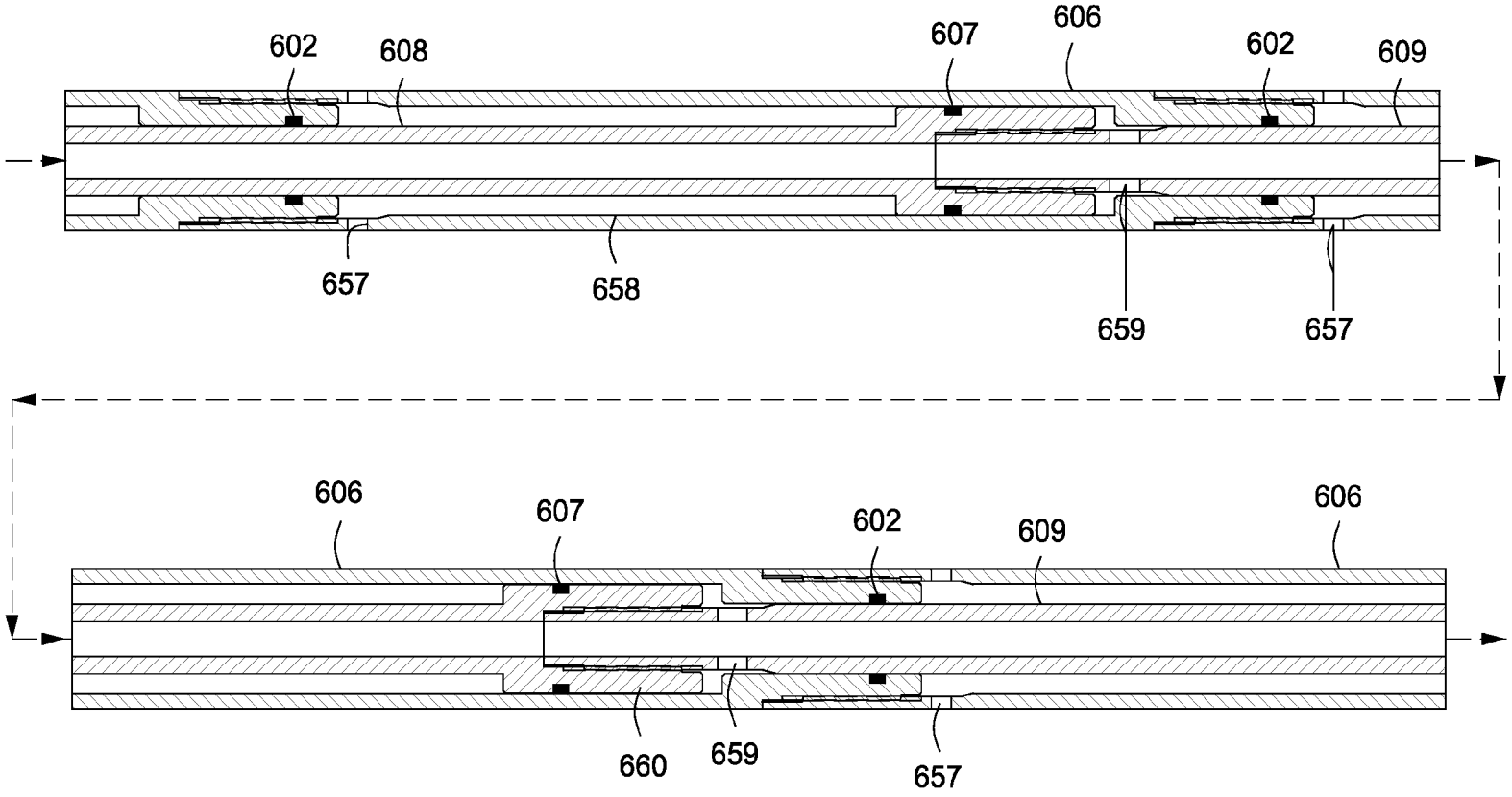
Figure 8C:
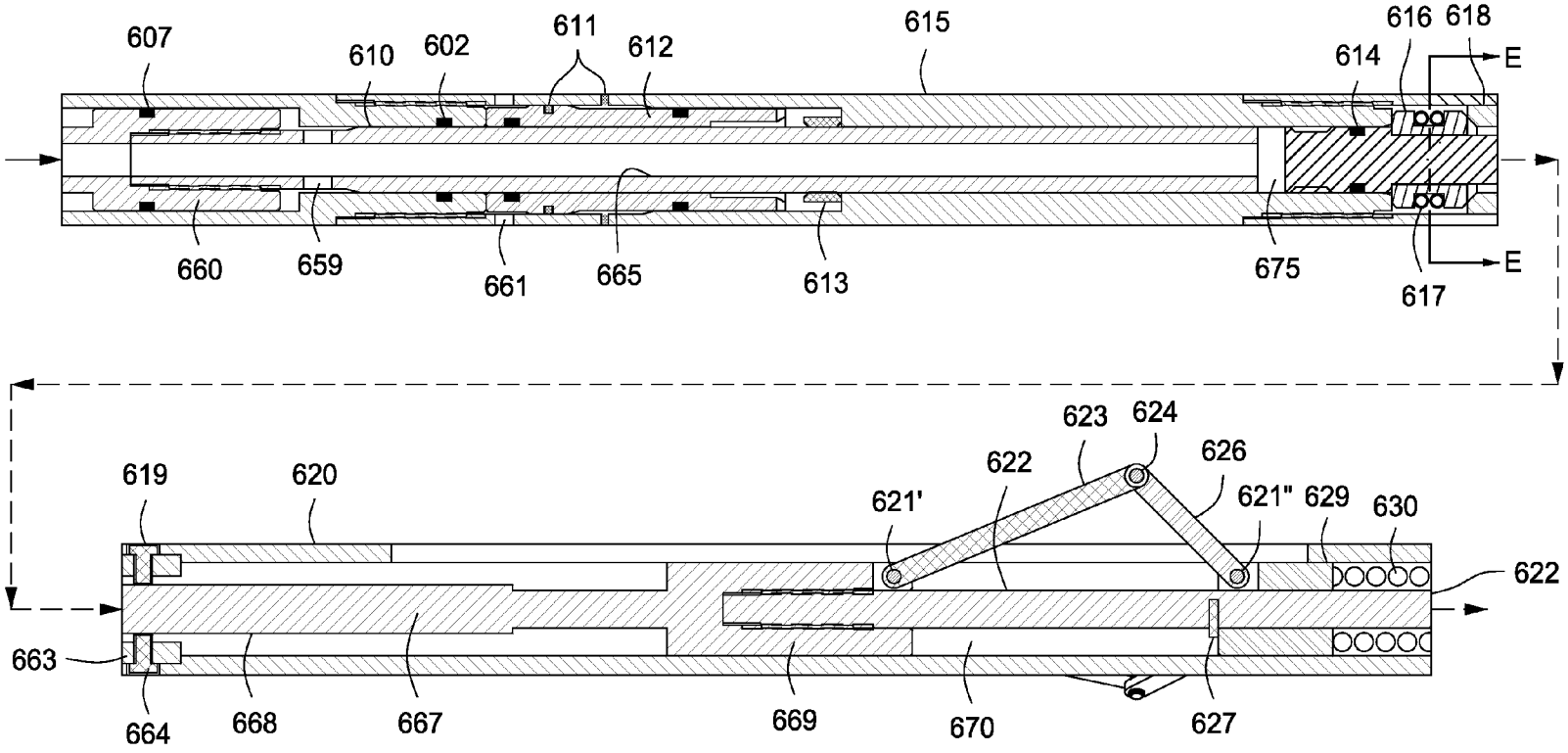
Figure 8D:
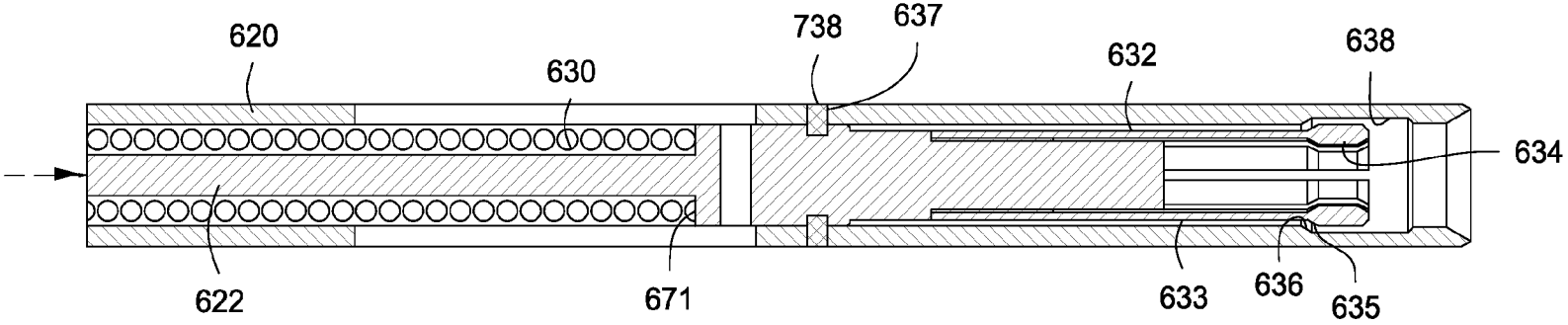

A set of locking dog segments is positioned between the lower end of the lock barrel 615 and the dog retainer 618. The locking dog segments are not seen in FIGS. 6A through 6D, but are shown in FIG. 8C at 616. The locking dog segments 616 are only assembled on the setting tool 600 when the setting tool 600 is used to retrieve the tool assembly 300. The dog segments 616 are held in place against the locking rod 667 with an inward force from two garter springs 617. The garter springs 617 are also seen in FIG. 8C.

Figure 8E:
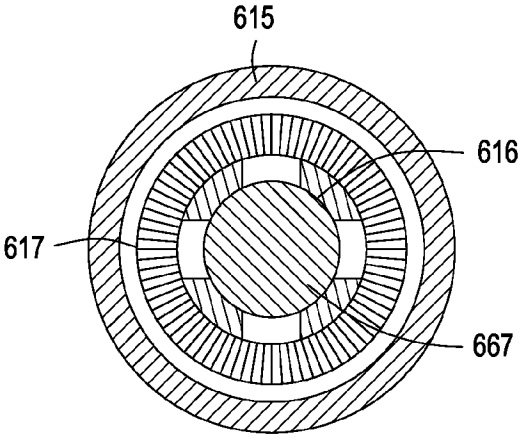
FIG. 8E is a cross-sectional view of the setting tool of FIG. 8C. Here, the view is taken across line E-E.

FIG. 8E is a cross-sectional view of the setting tool of FIG. 8C. Here, the view is taken across line E-E. One of the garter springs 617 is seen around the locking dog segments 616.

Centralizer Section

The setting tool 600 also includes a centralizer section. The centralizer section is also generally seen in FIG. 6C. The centralizer section serves to centralize the setting tool 600 during operation. Specifically, the centralizer section uses pinned arms 623, 626 to centralize the setting tool 600 when setting down on the tool assembly 300.

The upper end of the centralizer section represents the three slots 670 on the lower end of the locking rod 667. A collet mandrel 622 is connected to the lower end of the locking rod 667 with threads (not shown). The collet mandrel 622 has an external upset 671 at the lower end with external threads (also not shown).

A centralizer sleeve 629 is positioned on the lower end of the collet mandrel 622. The centralizer sleeve 629 has three slots 670. The slots 670 are disposed 120 degrees apart and are located on the upper end of the centralizer sleeve 629. The slots 670 receive and hold the ends of lower centralizer arms 626. A spring 630 is positioned between the centralizer sleeve 629 and the external upset 671 at the lower end of the collet mandrel 622.

Upper centralizer arms 623 are located in the three slots 670 at the lower end of the locking rod 667. The upper centralizer arms 623 are connected at upper ends with pins 621'. Each upper centralizer arm 623 is connected at a lower end to a lower centralizer arm 626. The connection is via pins 624. A retaining ring (not numbered) is inserted into grooves at each end of the pins 624 to hold them in place in the centralizer arms 626.

The lower centralizer arms 626 are connected to the centralizer sleeve 629 via pins 621". The lower centralizer arms 626 extend through the three longitudinal slots 670 in the lower barrel 620. A spring pin 627 located in a hole in the collet mandrel 622 limits upward travel of the centralizer sleeve 629 and outward expansion of the centralizer arms 626.

Collet Section

Figure 6D:
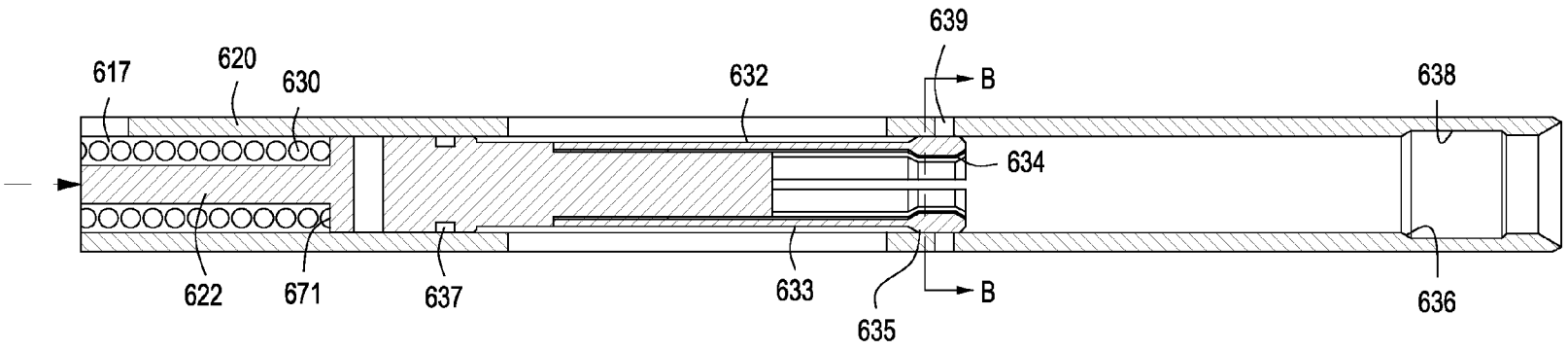

The setting tool 600 also includes a collet section. The collet section is shown in FIG. 6D. The collet section connects the setting tool 600 to the downhole tool assembly 300.

The collet section consists of a collet 632. The collet 632 has an internal thread (not shown) at an upper end which connects to the lower end of the collet mandrel 622. The collet 632 has a plurality of radially spaced-apart fingers 633. At the end of each finger 633 is an internal upset 634 and an external upset 635.

The collet section also consists of the lower end of the lower barrel 620. At the lower end of the lower barrel 620 is an internal undercut 636. Above the lower thread on the collet mandrel 622 are shallow holes 637 which will align with holes 639 through the lower end of the lower barrel 620. Shear pins (seen at 738 in FIG. 7D) are placed in these holes 637, 639 when running the tool assembly 300 into a wellbore for rotationally indexing or retrieving the tool assembly 300.

In order to run the downhole tool assembly 300 into a wellbore and to set the assembly 300 at the desired location, a series of steps is taken. First, the setting tool 600 is positioned in its run-in position. FIGS. 7A through 7D provide a cross-sectional expanded view of the setting tool 600, but with the setting tool 600 is in its running position. This is also an indexing position.

Figure 7A:
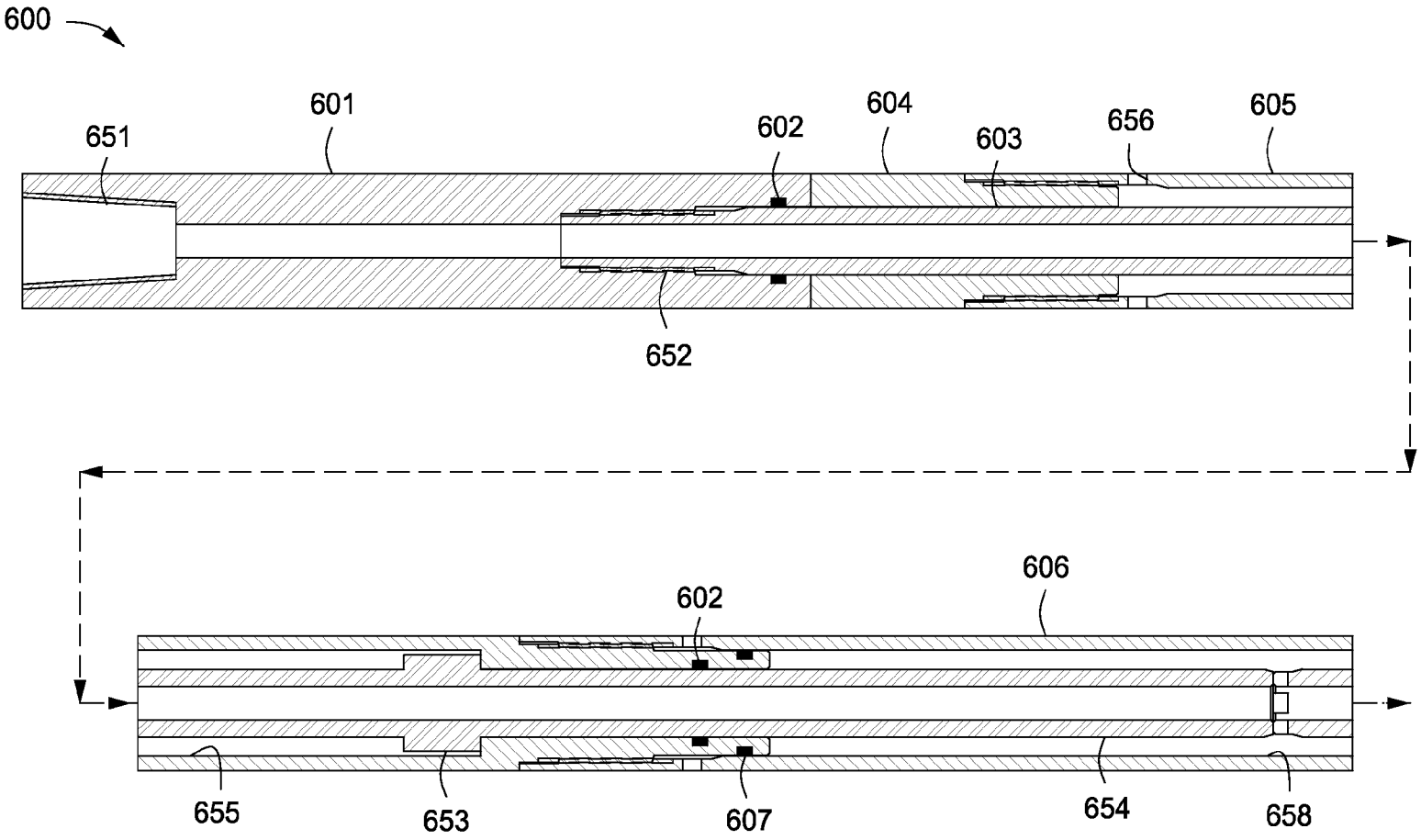
FIGS. 7A through 7D provide another cross-sectional expanded view of the setting tool of FIGS. 6A through 6D. Here, the setting tool is in its indexing position.
Figure 7B:
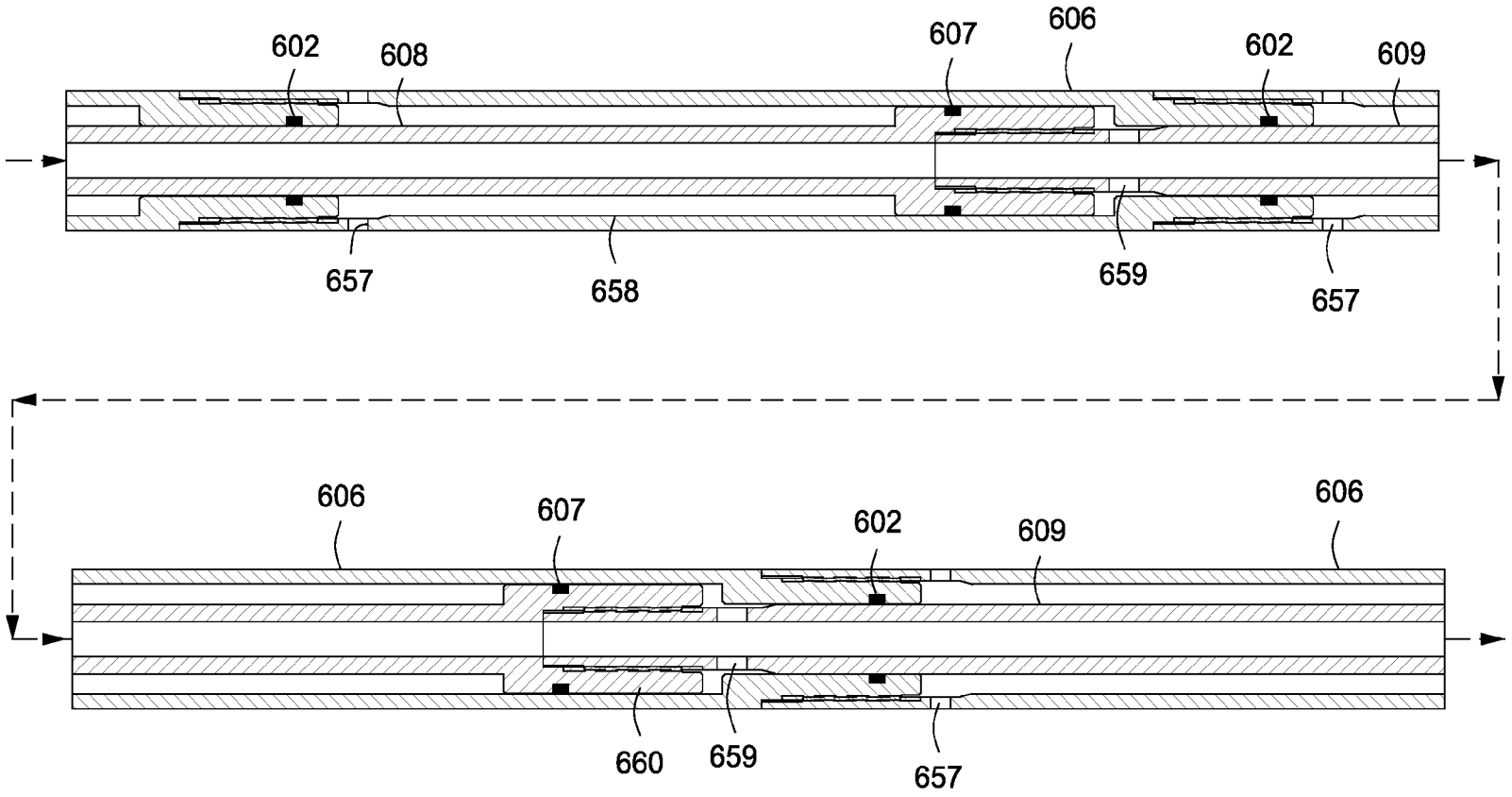
Figure 7C:
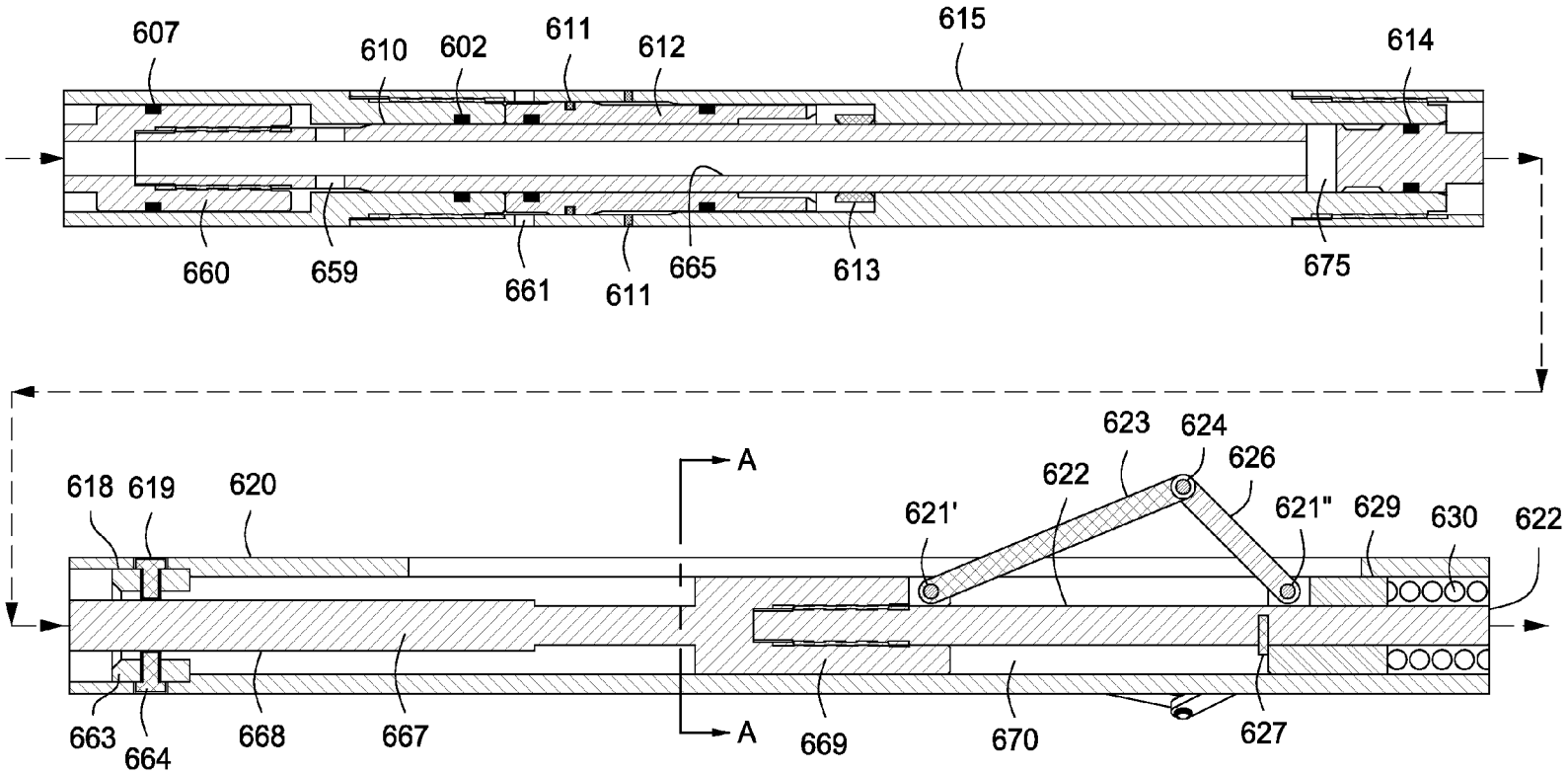
Figure 7D:
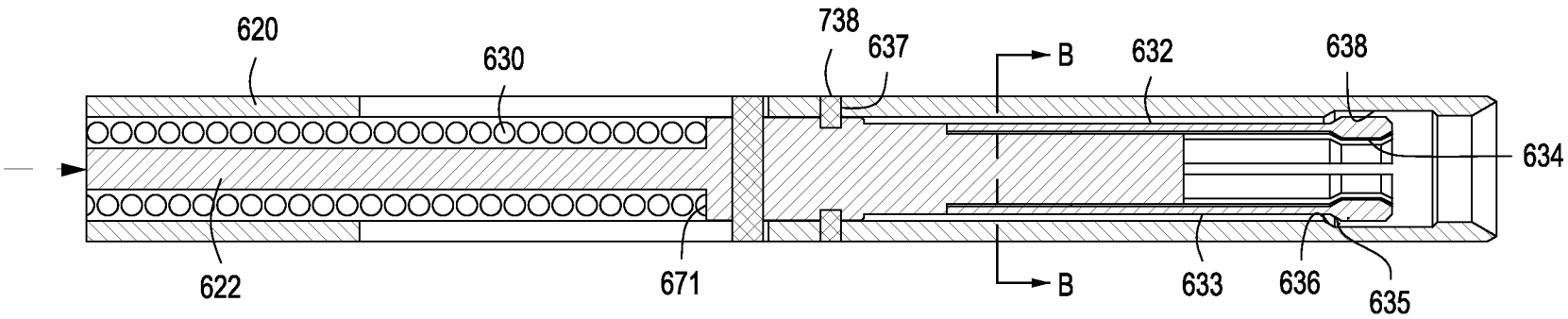

In its run-in position, the setting tool 600 is connected to the tool assembly 300 by the collet 632. More specifically, the collet fingers 633 latch over the bulbed upper end 30 of the retrieving mandrel 301. To do this, the collet mandrel 622 first moves down towards the internal undercut 636 in the lower barrel 620. This is seen in FIG. 7D.

As the collet fingers 633 are latched over the bulbed upper end 30 of the retrieving mandrel 301, they expand outward below the internal undercut 636. The collet fingers 633 then collapse back to the original position as the fingers 633 move over the bulbed end 30. The lower barrel 620 is then moved downward so that the inner diameter of the lower barrel 620 is over the external upset 635 of the collet 632. Because the inner diameter of the lower barrel 620 is smaller than the expanded outer diameter of the collet fingers 633, the collet 632 is locked around the bulbed upper end 30 of the retrieving mandrel 301.

Upon latching the retrieving mandrel 301, the lower barrel 620 moves downward over the collet 302 of the tool assembly 300. The lower barrel 620 contacts the collet lock sleeve 303, moving it downward against the biasing spring 308. The lower end of the lower barrel 620 has an I.D. that is large enough to go over the large O.D. of the collet 302, but small enough that the collet 302 cannot back over the bulbed end 30 of the retrieving mandrel 301.

The collet lock sleeve 303 will shoulder against the retrieving sleeve 309. When this happens, a groove 638 machined into the lower end of the lower barrel 620 is positioned over the large O.D. of the collet 302. The collet 302, the collet lock sleeve 303, the retrieving sleeve 309 and the upper whipstock rod 312 are together moved downward. This downward movement causes the internal upset 33 of the collet 302 to move down the retrieving mandrel 301. This position is shown in FIG. 3A.

As the lower barrel 620 moves further downward, the lower end of the upper whipstock rod 312 contacts the whipstock 322, causing the whipstock 322 to rotate inward to the collapsed position. This is demonstrated in FIG. 3B. After proceeding downward through the hole in the opening 55 and through the collapsed whipstock 322, the upper whipstock rod 312 pushes downward on the lower whipstock rod 324, the indexing rod 335 and, through a pin 339, the upper spring sleeve 338. The upper spring sleeve 338 is pushed downward against a compressed spring 341, compressing it further.

In FIG. 3B, the whipstock 322 has rotated to the collapsed position. This allows the upper whipstock rod 312 to travel through the opening 55 in the whipstock 322 and directly contact the lower whipstock rod 324. Continued downward movement of the upper whipstock rod 312 pushes the pin 339 in the upper spring sleeve 338 against the spring rod 340. This, in turn, transfers load and downward movement to the lower spring sleeve 338, the slip rod 343, and a pin 350 inserted through the lower end of the slip rod 343. The pin 350, in turn, transfers load and downward movement to the upper 349 and lower 351 slip sleeves. Load and downward movement are further transferred to the shear pins 353 connecting the lower slip sleeve 351 and upper spring shoe 355. The upper spring shoe 355 then compresses the disc springs 356 at the bottom of the tool assembly 300 and collapses the slips 345 inward into slots 73 in the slip mandrel 342.

As the slips 345 are collapsed, a shoulder 45 at the upper end of upper whipstock rod 312 contacts the dog 320. The dog 320 is connected to the guide sleeve 314 above the whipstock 322 and pushes the guide sleeve 314 downward. This unlocks the extended hose guides 316, 317, 318, 319 and allows the guides 316, 317, 318, 319 to collapse inward into the pockets in the guide sleeve 314 and whipstock mandrel 313. This position also moves slots in the retrieving mandrel 301 to be positioned beneath the retrieving dogs 307, allowing the retrieving dogs 307 to collapse inwardly.

The setting tool 600 is assembled with the lock ring 613 in a groove on the locking rod 667. This serves to keep the lower barrel 620 in the fully extended position. This also keeps the retrieving dogs 307, the guides 316, 317, 318, 319, the whipstock 322, and slips 345 in a collapsed position. The lock sleeve 612 is positioned over the lock ring 613 to lock the lock ring 613 in place when running into a wellbore. Shear pins 611 prevent the lock sleeve 612 from moving until pressure is applied to shear the pins 611.

As noted, below the lock ring 613 represents three sets of centralizer arms 623. When actuated, the centralizer arms 623 centralize the setting tool 600. During run-in, each of the centralizer arms 623 is constrained in a collapsed position. In this way the setting tool 600 can clear a slimhole region (such as production tubing 130 having a small I.D.). Spring 630 is collapsed. In FIG. 7C, spring 630 is expanded and the centralizer arms 623, 626 are also expanded.

After the centralizer arms 623 have passed through the slimhole region and have entered the larger I.D. production casing 220, the spring 617 expands the centralizer arms 623 outward and holds them in an expanded position under the weight of the setting tool 600. This is shown in FIG. 6C. This allows the lower end of the setting tool 600 to engage the centralized upper end of the tool assembly 300.

Later, when the setting tool 600 is retrieved, the upper centralizer arms 623 contact the small I.D. of the production tubing 130 (or other slimhole region) and are collapsed. In this respect, upward force on the setting tool 600 overcomes the force from the spring 617 on the centralizer arms 623.

Above the lock ring 613 and lock sleeve 612 are multiple rods (e.g., rods 608 and 609 seen in FIG. 6B) and barrels (e.g. barrels 605 and 606 seen in FIGS. 6A and 6B). The rods and barrels supply a differential area on which hydraulic pressure acts to apply downward force and movement to operate the downhole tool assembly 300. The number of rods and barrels can be changed to increase the differential area and decrease the operating pressure or decrease the differential area and increase the operating pressure.

At the top of the setting tool 600 is the slip joint section. The slip joint section allows tubing weight to be applied to the rods 608, 609 in the setting tool 600 and the tool assembly 300 when applying hydraulic pressure to operate the tool assembly 300. The slip joint section also applies upward force to the barrels 605, 606 when retrieving the setting tool 600 after setting and rotationally indexing the tool assembly 300.

After the setting tool 600 and connected tool assembly 300 are run into a wellbore and through the slimhole region, hydraulic pressure is applied through the coiled tubing. The hydraulic pressure acts on the rods (608, 609), barrels (605, 606), and lock sleeve 612. Pressure is increased until the force on the lock sleeve 612 shears the shear pins 619. The lock sleeve 612 then moves upward, releasing the lock ring 613.

The hydraulic pressure should be high enough that when the shear pins 619 are sheared, the downward force acting on the barrels (605, 606) is close to that of the force from the disc springs 356. As a result, there is little or no movement to expand the slips 345, the whipstock 322, the hose guides 316, 317, 318, 319, or the retrieving dogs 307. Hydraulic pressure is then relieved. This allows the disc springs 356 to push upward on the upper spring shoe 355, the lower 351 and upper 349 slip sleeves, and slip arms 347. This, in turn, rotates the slips 345 outward against the production casing 220.

The force from the disc springs 356 also applies a load to the expanded slips 345. This causes the teeth 82 of the slips 345 to at least partially penetrate into the wall of the casing 220. Any additional downward load on the slip mandrel 342 causes the teeth 82 to penetrate deeper into the casing 220. The slips 345 will hold an upward load until the force of the disc springs 356 is exceeded.

The disc springs 356 exert an upward force on other components of the tool assembly 300. These include the slip rod 343, the spring sleeves 338, the spring rod 340, the indexing rod 335, the lower whipstock rod 324, the upper whipstock rod 312, the retrieving sleeve 309, the collet lock sleeve 303, and the collet 302. The disc springs 356 also exert an upward force on the barrels 605, 606 of the setting tool 600 until the slips 345 are set. The retrieving dogs 307 are also moved out of the slots 36 in the collet lock sleeve 303 and expand outward, increasing their O.D. This is shown in FIG. 9C.

Once the slips 345 are set, the slip rod 343, the lower spring sleeve 338, and the spring rod 340 remain stationary. However, the spring 341 between the two spring sleeves 338 continues to apply an upward load to the other components and move them upward until the lower whipstock rod 324 contacts the whipstock 322. At this point, an upward load is applied to the setting tool 600 to continue moving these components upward. The upward load is applied by pulling the coiled tubing 1070. When the lower barrel 620 is moved upward, the lower shoulder 636 of the groove 638 contacts the external shoulder 635 of the expanded collet 632 and pulls the collet fingers 633 back inward. This is shown in FIG. 9C.

Also occurring upon setting of the slips 345, the upper whipstock rod 312 withdraws from the opening 55 in the whipstock 322. This allows the disc springs 356 to act on the lower whipstock rod 324. This, in turn, causes the whipstock 322 to rotate into its open or set position. This is seen in FIG. 4B. An upset 56 on the lower end of the whipstock 322 contacts the lower whipstock rod 324 to limit the rotation of the whipstock 322.

Continued upward movement of the lower whipstock rod 324 moves the longitudinal flat surface 44, or "flat." on the upper whipstock rod 312. The flat 44 is moved into contact with the dog 320. The dog 320 is connected to the guide sleeve 314 above the whipstock 322. The dog 320 pushes the guide sleeve 314 upward. This, in turn, moves the respective upper ends of the hose guides 316, 317, 318, 319 into contact with the ends of the slots 41, 42 going through the whipstock mandrel 313, and rotates them outwardly 90 degrees. This is shown in the cross-sectional views of FIGS. 5E, 5F, 5G and 5H.

The upper ends of the hose guides 316, 317, 318, 319 move into the slots that don't extend through the wall thickness. The guides 316, 317, 318, 319 are then locked into their respective extended positions. As the hose guides 316, 317, 318, 319 are locked in their extended positions, the collet 302 retracts back into the undercut 30 on the retrieving mandrel 301, and the lower barrel 620 moves off the collet 632. The lower barrel 620 contacts the collet lock sleeve 303, moving it downward against the biasing spring 308. The biasing spring 308 pushes the collet lock sleeve 303 over the external upset 34 of the collet 302, locking the collet 302 in place. This is seen in FIG. 4A.

After the downhole tool assembly 300 has been set in a wellbore, the operator releases the setting tool 600 from the tool assembly 300. This is done by continuing the upward movement of the setting tool 600 by pulling tension on the coiled tubing 1070. Do so enables the lower barrel 620 of the setting tool 600 to move upward until the internal undercut 638 on its lower end moves over the external upset 635 on the collet 632. This unlocks the collet 632 from the bulbed end 30 on the retrieving mandrel 301 and allows the setting tool 600 to be disengaged from the tool assembly 300.

After the tool assembly 300 has been set in a wellbore and the setting tool 600 has been released, the setting tool 600 is removed from the wellbore. The setting tool 600 is also detached from the coiled tubing 1070. Thereafter, a flexible hydraulic jetting hose 1080 is attached to the end of the coiled tubing 1070 and run into the wellbore to the depth of the tool assembly 300. The process for forming lateral boreholes may then commence.

After one or more lateral boreholes is completed, the setting tool 600 must be run back into the wellbore. The setting tool 600 is placed in its retrieving position. FIG. 8A through 8D provide yet another cross-sectional expanded view of the setting tool 600. Here, the setting tool 600 is in its retrieving position. FIG. 9E, mentioned below, also shows the setting tool 600 in its hydraulic retrieving position.

FIGS. 9A through 9F demonstrate a progression of steps for using the setting tool 600 of FIGS. 6A through 6D to manipulate the downhole tool assembly 300 of FIGS. 3A through 3D.

Figure 9A:
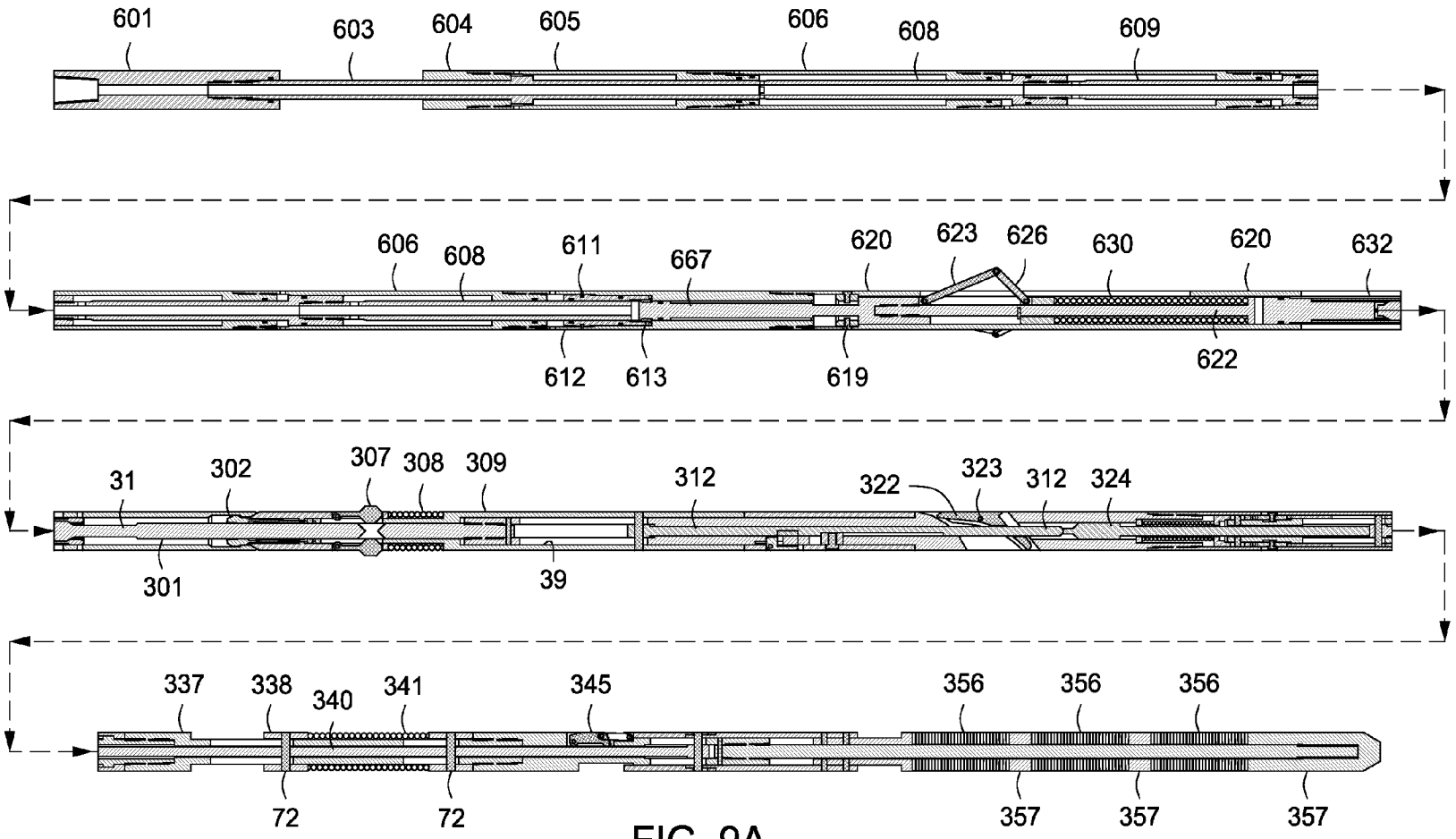
FIGS. 9A through 9F demonstrate a progression of steps for using the setting tool of FIGS. 6A through 6D to manipulate the downhole jetting assembly of FIGS. 3A through 3D.

FIG. 9A shows the setting tool 600 having been connected to the tool assembly 600. The setting tool 600 and the connected tool assembly 300 are in their run-in positions.

Figure 9B:
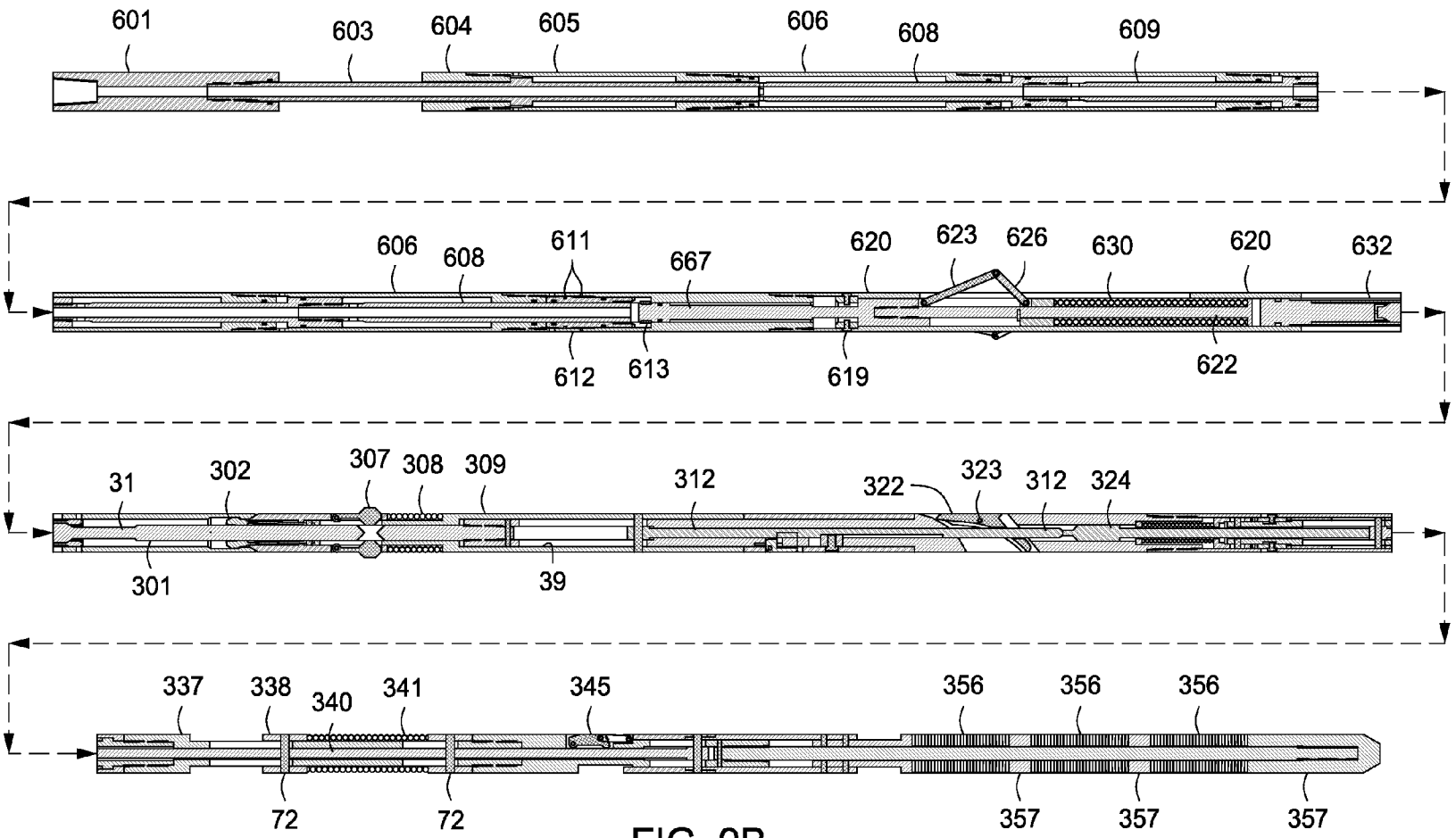
Figure 9C:
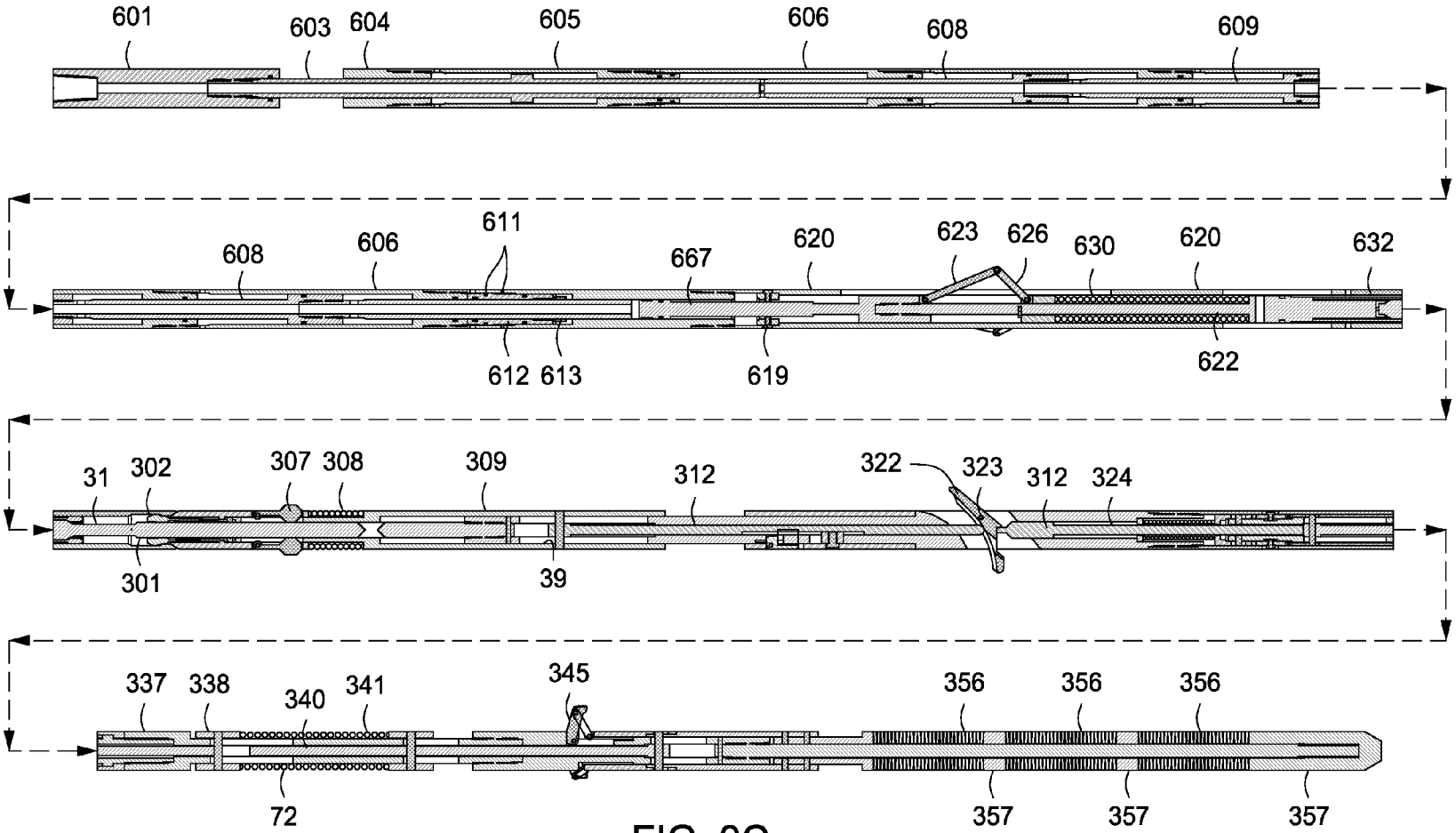

FIG. 9B shows the lock sleeve 612 being shifted in the setting tool 600. This serves to shear the shear pins 611, 619, and to release the lock ring 613.

FIG. 9C shows the set slips 345 having been rotated into their extended positions. Also, the whipstock 322 has been rotated into its set position and is ready to receive a jetting nozzle and connected jetting hose (not shown).

Figure 9D:
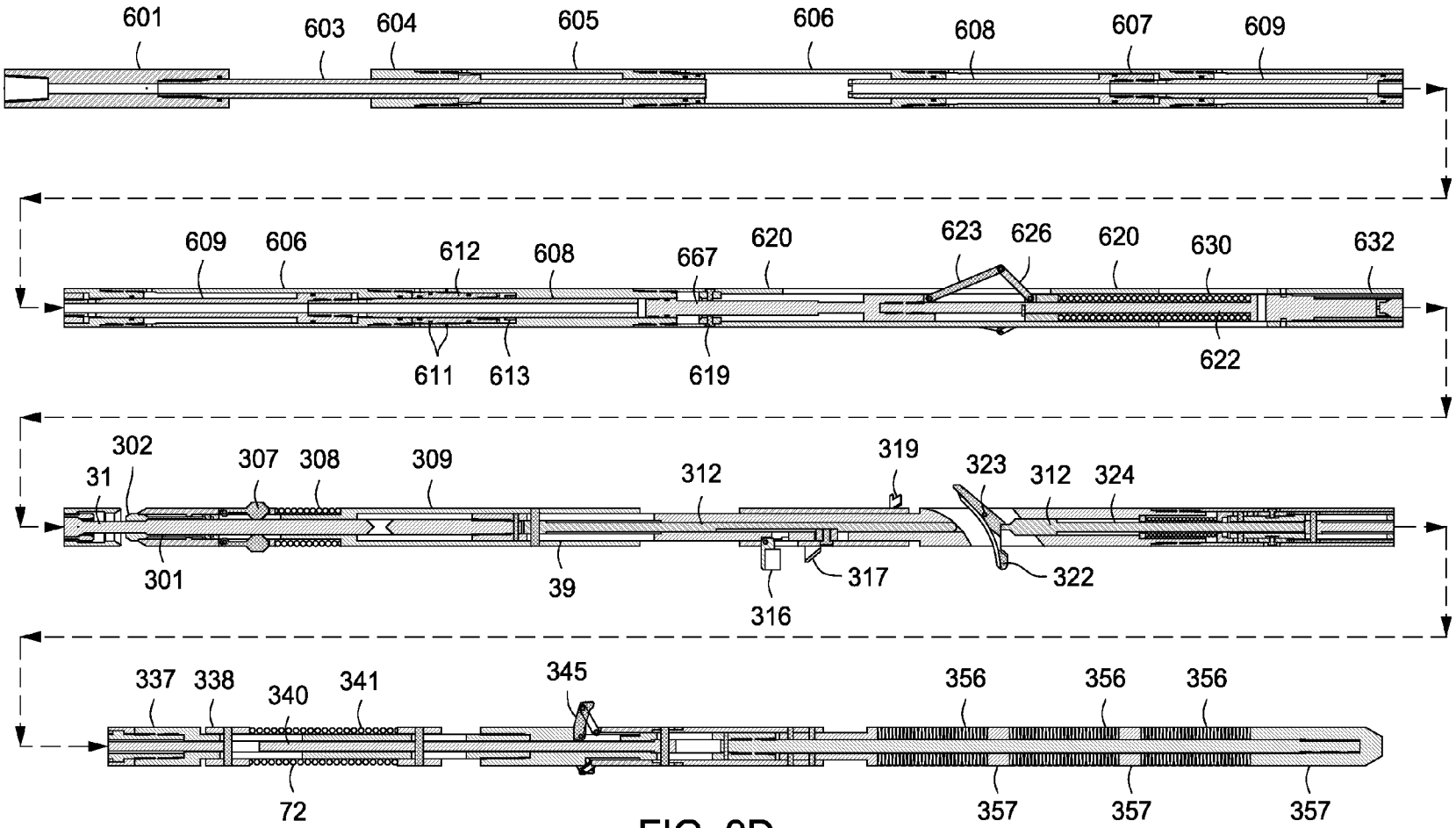
Figure 9E:
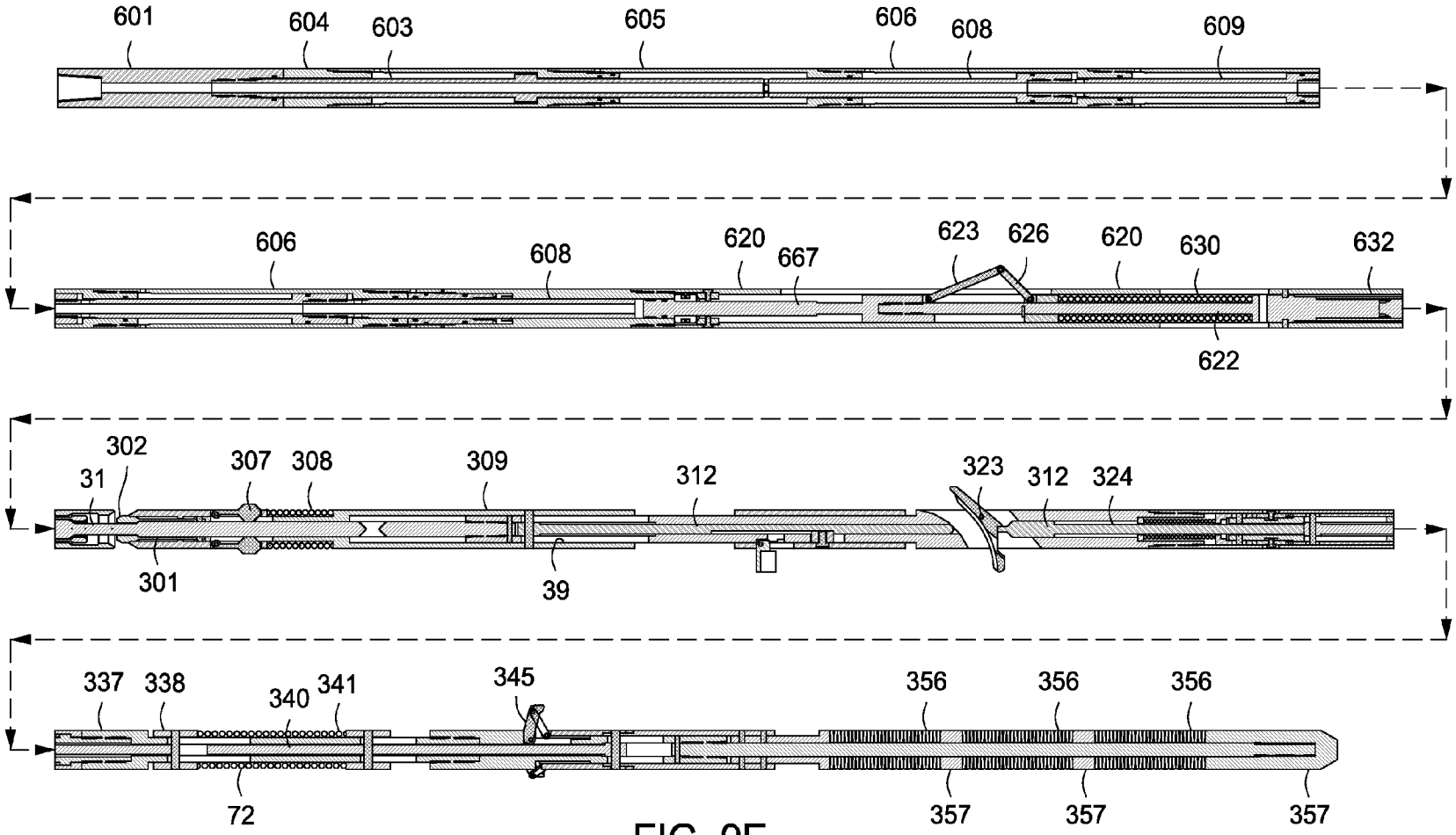

FIG. 9D shows hose guides 316, 317, 318, 319 having been activated along the tool assembly 300. These serve as part of a hose-guiding section for the tool assembly 300.

FIG. 9E shows the setting tool 600 in its hydraulic retrieving position. When collapsed and in its running position (e.g., for running into and retrieving out of the wellbore 200), the entire assembly 300/600 (when designed for application in a 4.5-inch O.D. production casing), has a maximum outer diameter of about 1.75-inch. Consequently, the assembly 300 600 can be conveyed and withdrawn through 2⅜ inch conventional production tubing (I.D.=1.995-inch). Of course, the assembly 300/600 could be constructed for setting and operation in other production casing 1020 (or, production liner) sizes, and for conveyance through other tubing 1030 (and other slimhole restriction) sizes.

Figure 9F:
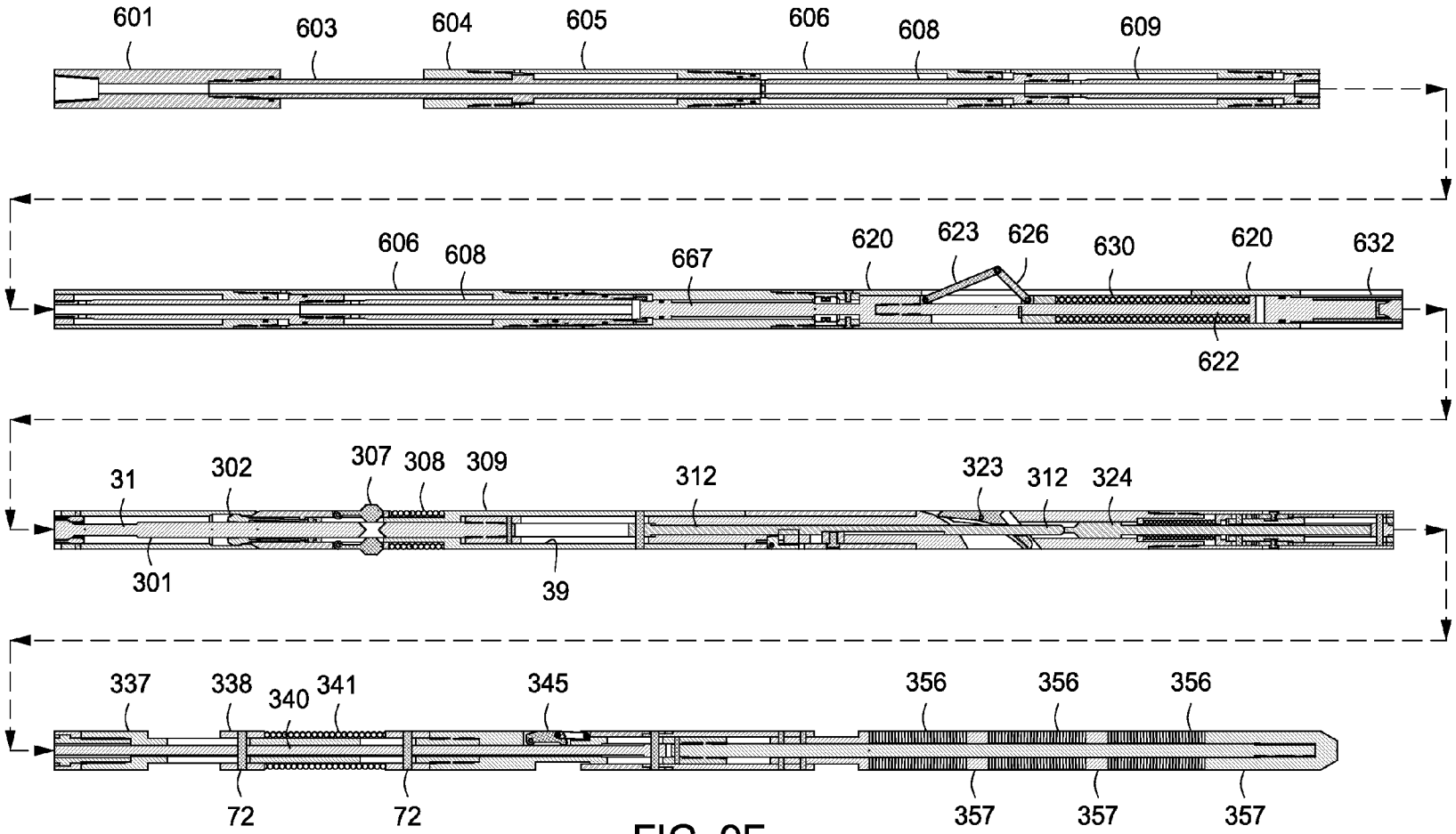

FIG. 9F shows the setting tool 600 and the connected tool assembly 300 being moved back into their run-in position. The retrieving dogs 307 are locked and the whipstock 322 is rotated back into a collapsed position.

FIGS. 10A through 10D demonstrate the use of the tool assembly 300 of FIGS. 3A through 3D and FIGS. 4A through 4D in forming lateral boreholes into a formation.

Figure 10A:
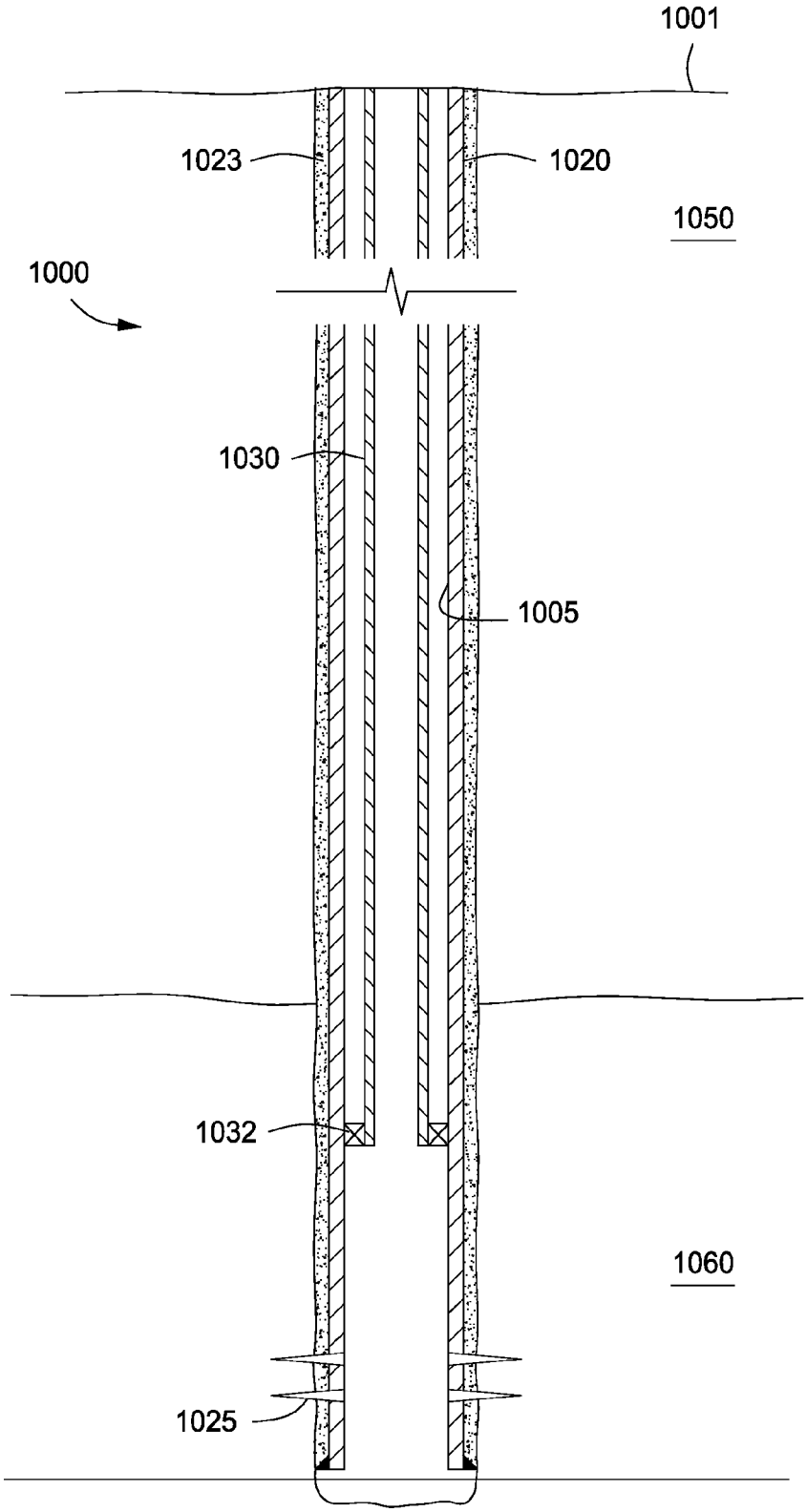
FIGS. 10A through 10D demonstrate the use of the jetting assembly of FIGS. 3A through 3D and FIGS. 4A through 4D in forming a lateral borehole into a producing formation.

First, FIG. 10A demonstrates a wellbore 1000. The wellbore 1000 has been formed through a subsurface 1050. The wellbore 1000 extends from a surface 1001, through the subsurface 1050, and into a producing formation or "pay zone" 1060.

The wellbore 1000 is completed with a string of production casing 1020. In the arrangement of FIG. 10A, the production casing 1020 extends from the surface 1001 through the producing formation 1060. However, it is understood that the production casing 1020 may be a liner that is hung from an intermediate string of casing (not shown). The production casing 1020 forms a bore 1005 into which production equipment may be placed.

The wellbore 1000 may, and almost certainly is, completed with additional strings of casing. These typically include casing strings such as conductor pipe 222 and surface pipe 224 of FIG. 2. Note also in FIG. 2 that the annular areas between theses casing strings 222, 224 and the formation borehole walls are held via cement sheaths 221, 223 completely back to the surface 101, which is desired for wellbore integrity in well control situations, and almost always a requirement of regulatory authorities. An intermediate string of casing (shown as 126 in FIG. 2, but not shown in FIG. 10A) may or may not be included, and may or may not be cemented (127 in FIG. 2, but not shown in FIG. 10A) back to surface. It is also understood that the wellbore 1000 of FIG. 10A will have surface equipment, including a well head, valves, and pipes. These also are not shown in the view of FIG. 10A.

The production casing 1020 has been perforated. Perforations are shown at 1025. Production has already taken place through the perforations 1025. A string of production tubing 1030 is provided for receiving production fluids. In one aspect, the production tubing 1030 is a string of 2.375-inch OD (1.995-inch I.D.) tubing.

A packer 1032 seals an annular region between the production tubing 1030 and the surrounding production casing 1020. The packer 1032 directs production fluids entering the wellbore 1000 through the perforations 1025 into the production tubing 1030. The packer 1032 also isolates the perforations 1025 from any wellbore fluids that may be invading the wellbore 1005 behind the tubing 1030.

In accordance with the present inventions, the operator desires to stimulate the producing formation 1060 by forming one or more lateral boreholes from the wellbore 1000. The boreholes will be formed by running a hydraulic jetting hose and connected nozzle down the wellbore 1000, through a window in the production casing 1020, and out into the formation 1060. However, it can be seen that the production tubing 1030 and packer 1032 create a restriction, or slimhole region," in the wellbore 1000. Therefore, a tool assembly such as downhole tool assembly 300 is desired that may be deployed through the slimhole region (tubing 1030 and packer 1032), and then expanded, set, operated, reoriented, and re-operated in the production casing 1020 at any desired depth below the slimhole region (tubing 1030). Preferably, the downhole tool assembly 300 is then released and moved to other target depths below the slimhole region, and the aforementioned process repeated as many times as desired.

Figure 10B:
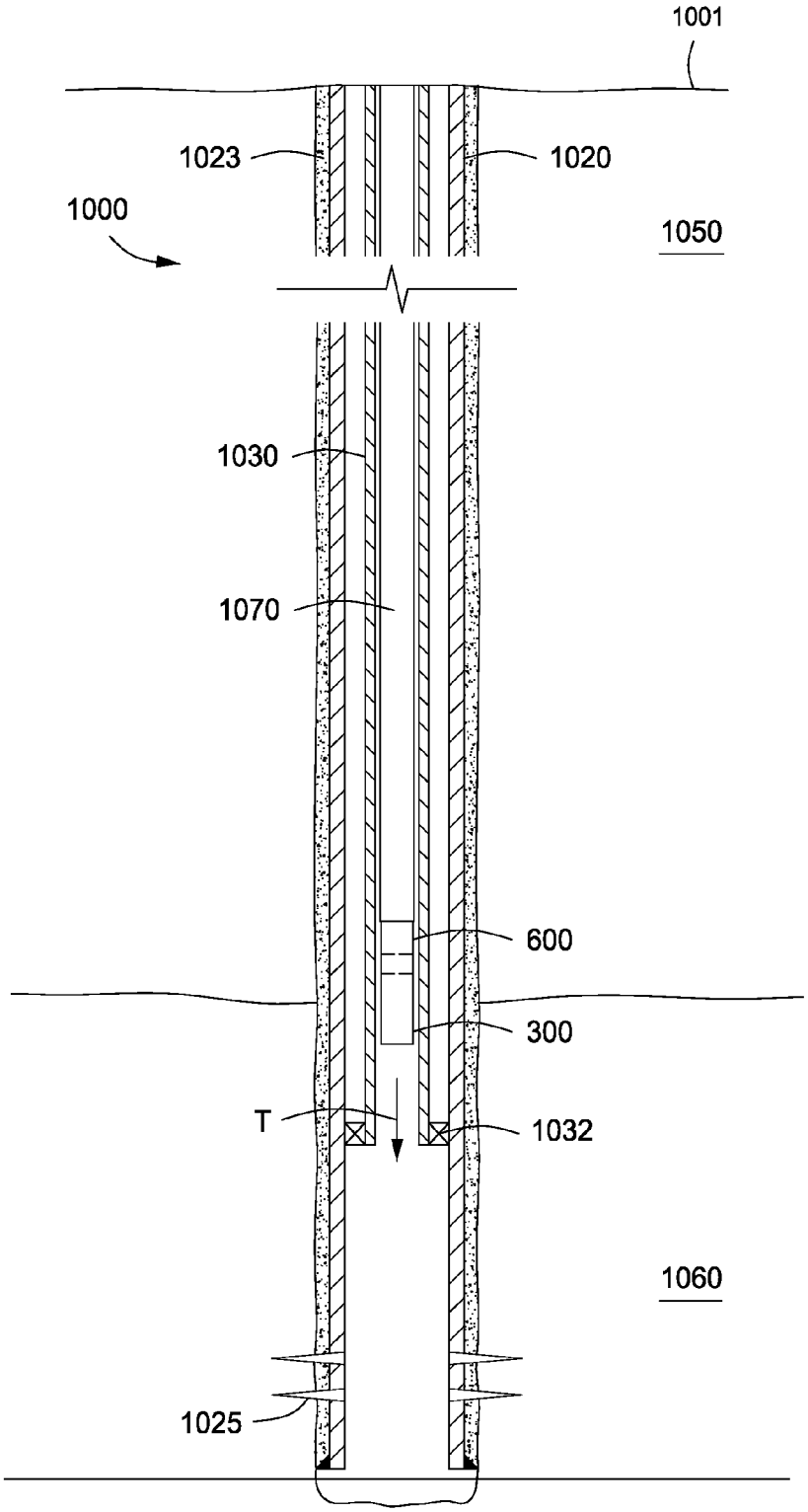

FIG. 10B provides another side view of the wellbore 1000 of FIG. 10A. Here, a string of coiled tubing 1070 is being run into the wellbore 1000. The setting tool 600 of FIGS. 3A through 3D is shown attached to the coiled tubing 1070. In addition, the tool assembly 300 is shown connected to the setting tool 600. The setting tool 600 and the tool assembly 300 are presented schematically. However, they may look like the view of FIG. 9A. Arrow "T" shows the direction of movement of the downhole tool assembly 300 into the wellbore 1000.

Figure 10C:
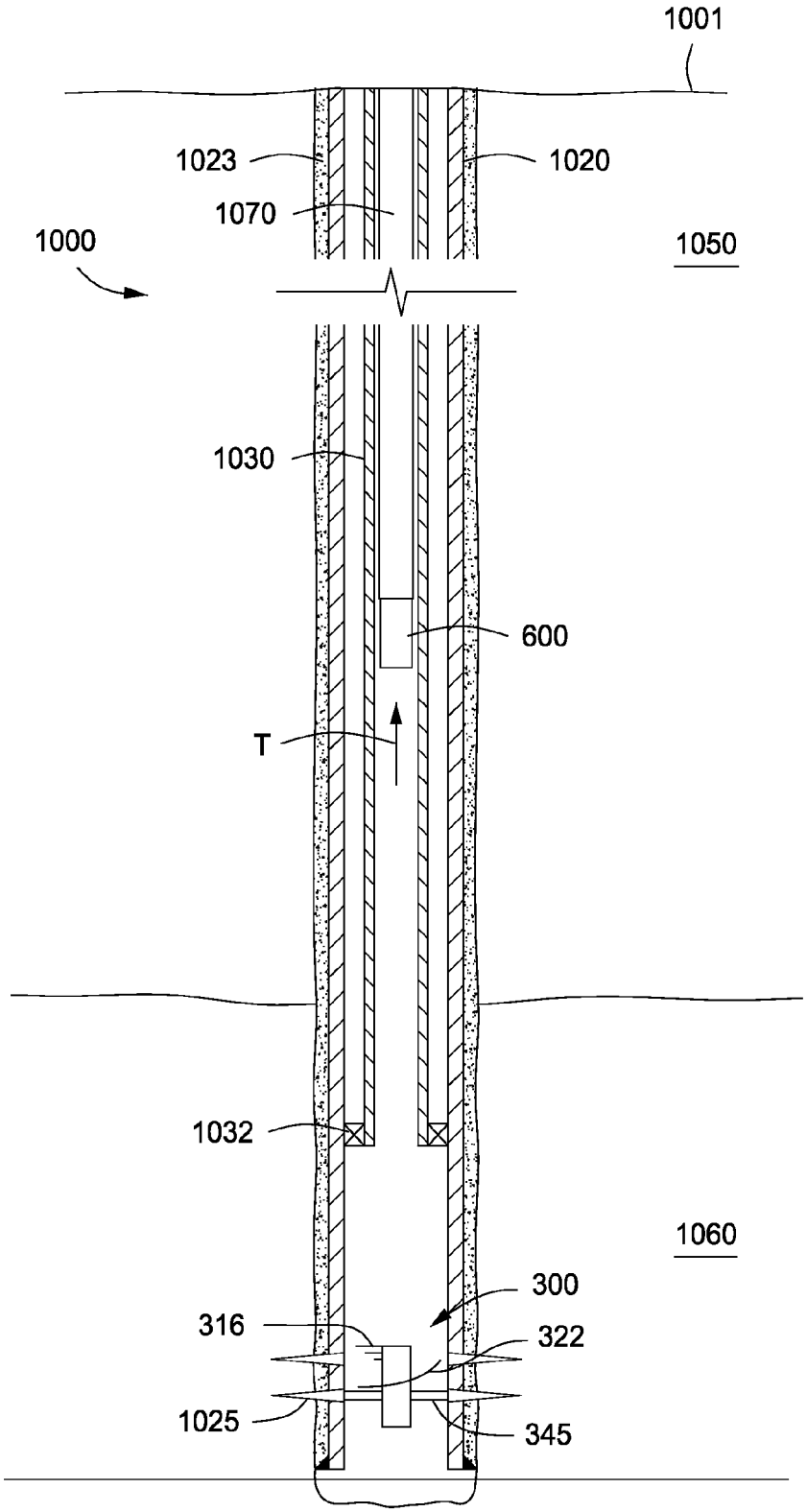

FIG. 10C provides another side view of the wellbore 1000 of FIG. 10A. Here, the downhole tool assembly 300 has been set in the wellbore 1000. It can be seen that the slips 345 of the tool assembly 300 have been expanded into position against the surrounding production casing 1020. In addition, the hose guides (only guide 316 is numbered) are seen. The hose guides define a series of descending deflection faces around an outer diameter of the tool assembly 300. The deflection faces are raised and lowered on pivot arms placed circumferentially around the tool assembly 300. When in their raised position within the production casing 1020, the deflection faces leave but one path for an advancing jetting hose to follow, such that the jetting nozzle (or milling assembly and mill) and jetting hose are guided into the curved face of the whipstock member. When in their collapsed position, the outer perimeters of the deflection faces conform to the outer diameter of the tool assembly 300, allowing the tool assembly 300 to pass through a slimhole region.

Also seen in FIG. 10C, the whipstock 322 has been rotated into an operating position. The whipstock 322 is ready to receive a jetting hose. The whipstock 322 provides a bend radius for the jetting hose that utilizes the full I.D. of the production casing 1030. This will provide for a maximum I.D. in the selection of a jetting hose 1080, and maximum hydraulic horsepower at the jetting nozzle 1085.

In the view of FIG. 10C, the coiled tubing 1070 is still visible. The coiled tubing 1070 is removing the attached setting tool 600 from the wellbore 1000. Movement is again indicated by arrow "T."

Figure 10D:
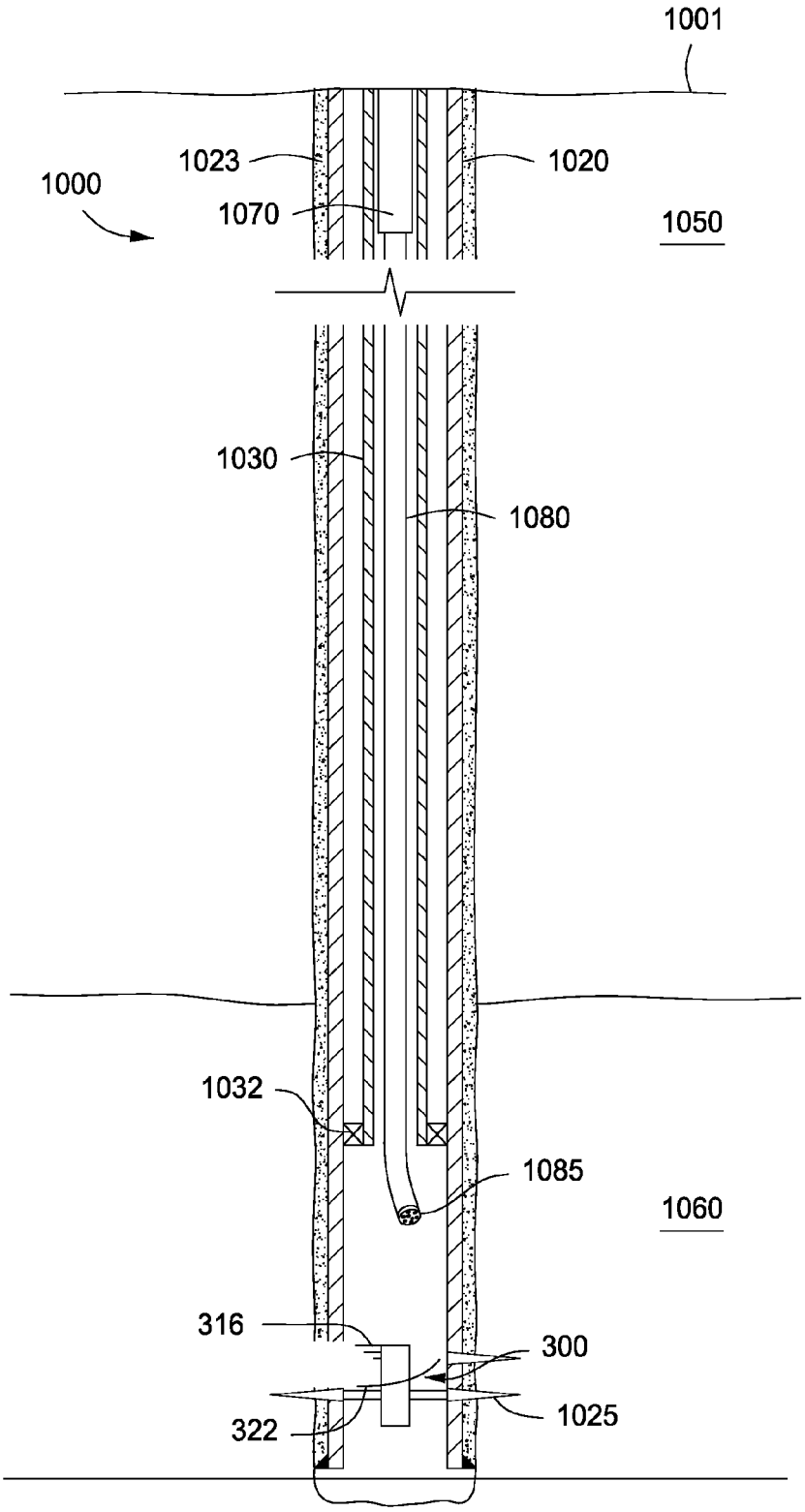

FIG. 10D provides still another side view of the wellbore 1000 of FIG. 10A. Here, a jetting hose 1080 is attached to the coiled tubing 1070 and is being advanced into the wellbore 1000. More specifically, the jetting hose 1080 is being run through the production tubing 1030 and towards the whipstock 322 of the downhole tool assembly 300.

The jetting hose 1080 is connected to the string of coiled tubing 1070. As the coiled tubing 1070 is run into the wellbore 1000, the flexible jetting hose 1080 is also introduced. The jetting hose 1080 will ultimately be used to form a lateral borehole (seen at 1090 in FIG. 10E) from the wellbore 1000.

It is understood that the coiled tubing 1070 will most likely be several thousand feet long and will be carried on a conventional coiled tubing unit's spool (not shown) at the surface 1001. Indeed, the jetting hose 1080 may be 20 to 100 feet long and the coiled tubing string 1070 may be 250 feet to 15,000 feet long.

A jetting nozzle 1085 is disposed on the end of the flexible hose 1080. The nozzle 1085 contacts the hose guides 316, 317, 318, 319 spaced around the tool assembly 300 circumference during run-in. The hose guides 316, 317, 318, 319 have faces "f" that direct the flexible hose to the whipstock 322.

The jetting nozzle 1085 may be a conventional fluid nozzle. Preferably, however, the jetting nozzle 1085 defines a hydraulic nozzle equipped with inner baffles and/or bearings that interface with ports or slots in the nozzle 1085. As fluid is pumped through the hose 1080, the baffles or bearings rotate along a longitudinal axis of the jetting hose 1080. In one aspect, the ports reside at the leading edge of the nozzle 1085 so that maximum fluid is directed against the formation 1060 being cut. The ports may be disposed radially around the leading edge of the nozzle 1085 to facilitate cutting a radial borehole.

In another embodiment, a hydraulic collar or seat is placed in the jetting hose 1080 proximate the nozzle 1085. In addition, rearward-directed ports may be placed proximate the collar or along the jetting hose 1080 just a few inches to a few feet up-string of the jetting nozzle 1085. In operation, the operator may pump a small ball down the jetting hose 1080. The ball will land on the collar, which in turn will open the reward-directed ports. This provides for expulsion of some fraction of the jetting fluid in a rearward direction, thereby providing thrust to advance the jetting nozzle 1085 forward into the newly generated lateral borehole 1090 while helping to enlarge the borehole and to keep it clear of cuttings.

Figure 10E:
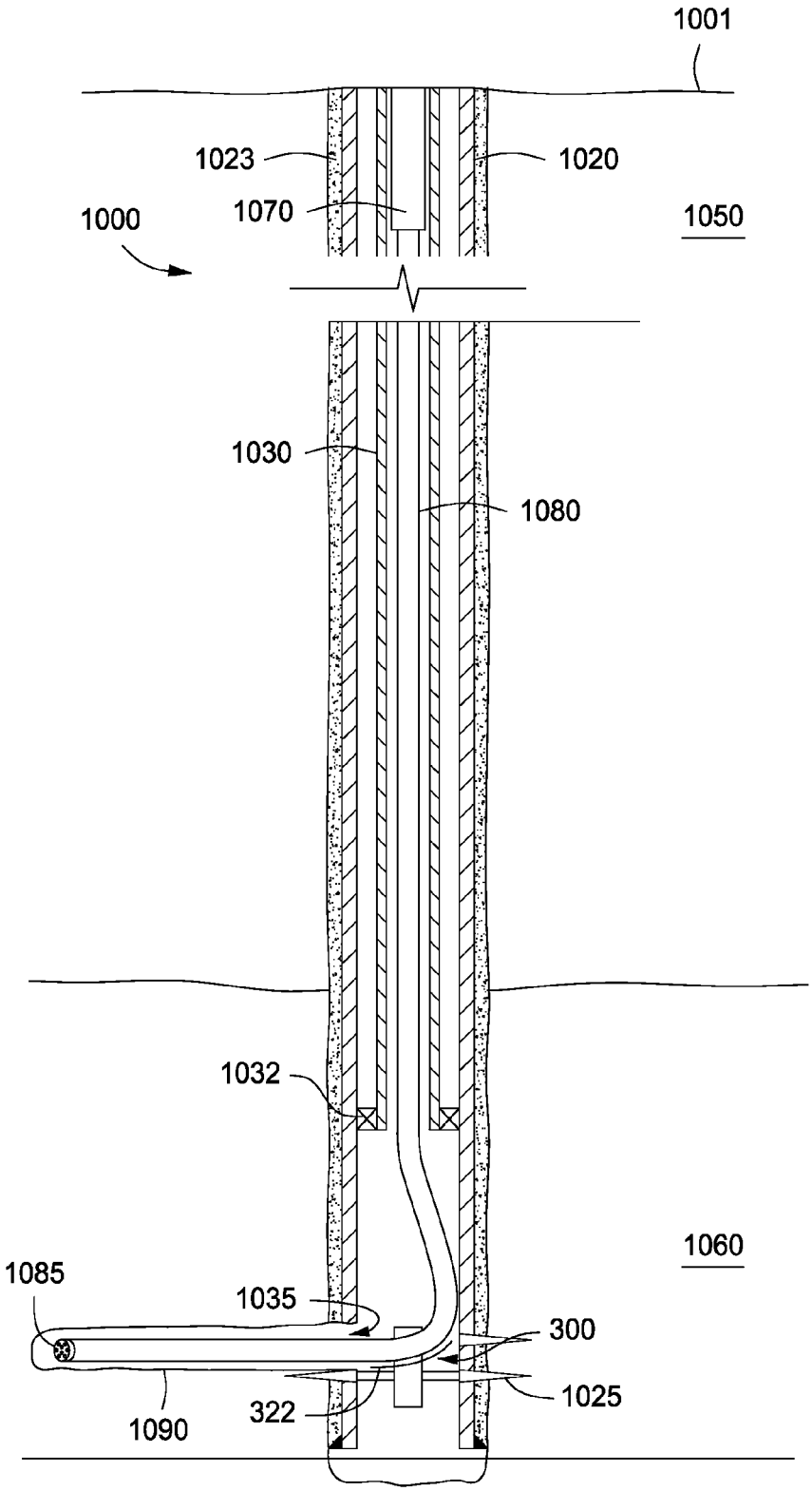
In FIG. 10E, a lateral borehole is being formed using the jetting hose and connected jetting nozzle. The jetting hose is being run through the window in the production casing.

It can also be seen in FIG. 10E that a window 1035 has been formed in the production casing 1020. The window 1035 has been formed using a separate bit and mill assembly (not shown). The bit and mill assembly may be run into the wellbore 1000 at the end of the coiled tubing string 1070, and then actuated using mechanical or hydraulic forces as is known in the art. After the window 1035 is formed, the bit and mill assembly is tripped out of the wellbore, and the flexible hose 1080 and connected jetting nozzle 1085 are run into the production tubing 1030.

As an alternative, the window 1035 may be formed using jetting forces directed from the nozzle 1085 itself. In this instance, the hydraulic fluid will preferably include a suspended abrasive material such as sand to form an abrasive slurry. The abrasive slurry cuts a hole through the casing wall, through a cement sheath 1023 around the casing 1020, and into the producing formation 1060. After the window 1025 is formed through the production casing 1020 and cement sheath 1023, the flexible hose 1080 with jetting nozzle 1085 is advanced. During this time, high pressure jetting fluid continues to be injected through the jetting nozzle 1085. In this way, the lateral borehole 1090 is erosionally "drilled" substantially perpendicular to the longitudinal axis of the wellbore 1050 within the target pay zone 1060.

Other techniques for forming the window 1035 may be used. These may include extensive perforating using multiple explosive charges. Also, the use of pyro-chemicals is known for melting a window out of the casing. Regardless of the method for forming the window 1035, the whipstock 322 guides the flexible jetting hose 1080 from one side of the casing 1020 I.D. to the other. The whipstock 322 face spans substantially the entire inner diameter of the production casing 1020, causing the jetting nozzle 1085 to enter the window 1035 substantially perpendicular to the casing 1020. Fluid is then pumped through the flexible hose 1080 under high pressure where it exits through ports in the jetting nozzle 1085.

FIG. 10E provides a final side view of the wellbore 1000 of FIG. 10A. Here, the jetting hose 1080 and attached jetting nozzle 1085 are being run through the window 1035. An extended lateral borehole 1090 is being formed through the producing formation 1060.

In forming the lateral borehole, it is preferred that the jetting nozzle 1085 be specially designed to employ backwards thrust forces. Such forces are largely distributed to the wall of the production casing 220 as the jetting nozzle 1085 first enters the window 1035. The thrust forces urge the jetting nozzle 1085 forward as a lateral borehole is formed. In one aspect, a ported collar (not shown) is incorporated into the jetting hose 1080 just upstream of the jetting nozzle 1085 to provide reverse hydraulic forces. Such forces are sufficient to create a borehole up to at least 500 feet from the wellbore 1000 without need of compression on the coiled tubing 1070.

It is again noted that once a window 1035 is created and a first lateral borehole 1090 is formed, the jetting hose 1070 is withdrawn from the lateral borehole 1090 and the downhole tool assembly 300 may be indexed. This means that the tool assembly 300 is radially moved a desired number of degrees within the wellbore. This is done by rotating the upper indexing ratchet 328 relative to the indexing mandrel 336.

In operation, when the downhole tool assembly 300 is set in casing, the slips 345 are moved outward to contact the casing ID and to hold the tool assembly 300 in place. To rotationally index the tool assembly 300, the setting tool 600 is set back down on the tool assembly 300. The collets 632 on the lower end of the setting tool 600 then engage an external upset on the upper end of the retrieving mandrel 301. Pressure is then applied to the setting tool 600, moving the lower barrel 620 of the setting tool 600 downward and over the collets 632, locking them to the external upset on the upper end of the retrieving mandrel 301.

The lower barrel 620 continues to move downward and to apply force to and through a series of parts for the tool assembly 300. These include the collet lock sleeve 303, the retrieving sleeve 309, the pin 311, the whipstock rod 312, the whipstock 322, the lower whipstock rod 324, the indexing rod 335, and to the indexing pin 333. The indexing pin 333 moves in slots machined on a lead in the lower indexing ratchet 334. Movement of the indexing pin 333 applies a rotational force to the lower indexing ratchet 334, which in turn rotates the inner indexing sleeve 331.

The inner indexing sleeve 331 is connected to the outer indexing sleeve 327 by means of a screw 330. The screw 330 transfers rotation from the inner indexing sleeve 331 to the outer indexing sleeve 327. The outer indexing sleeve 327 is free to rotate relative to the components of the tool assembly 300 below the indexing section, but is connected to the components of the tool assembly 300 above the indexing section. When the outer indexing sleeve 327 is rotated, the upper section of the tool assembly 300 also rotates. The slips 345 remain set during this operation and provide the resistance to rotation for the lower section of the tool assembly 300.

When the indexing rod 335 moves downward, the rod 335 pushes against pins 339 and spring sleeve 338. This mechanical action compressing a spring 341. When pressure is released on the setting tool 600, the spring 338 pushes upward on the spring sleeve 338, the pins 339, the indexing rod 335, and the indexing pin 333. The indexing pin 333 moves in the slots in the lower indexing ratchet 334, turning the ratchet 334 in the opposite direction and moving the ratchet 334 against the inner indexing sleeve 331. The inner indexing sleeve 331 is prevented from rotating with the lower indexing ratchet 334 by the upper indexing ratchet 328.

Selectively applying and releasing pressure on the setting tool 600 creates downstrokes and upstrokes. During a downstroke and upstroke cycle, the indexing section rotates the upper sections of the tool assembly 300, including the locking/retrieving section and guide/ramp section, through a set number of degrees relative to the lower sections of the tool assembly 300. The number of degrees is determined by the number of teeth and the design of the slots on the lower indexing ratchet. Rotating the guide/ramp section changes the radial orientation of the whipstock 322. This, in turn, allows multiple radial holes to be jetted through the casing into the formation without unsetting the slips 345.

As can be seen, improved methods for forming lateral boreholes from a parent wellbore are provided. Improved systems for forming lateral boreholes are also provided. The systems and methods allow for delivery and setting of a hydraulic tool assembly through a slimhole region in a wellbore using coiled tubing. It is no longer required to kill the well or to use well control equipment. Further, it is no longer required to pull the production tubing, nor are there concerns of retrieving a stuck packer or tubing anchor. Further, a conventional coiled tubing unit may be used.

The method provides for running a jetting hose through a first window by turning the jetting hose across a bend radius equivalent to the full inner diameter of the production casing. The production casing may be, for example, standard 4.5- to 7-inch O.D. production casing (including a production liner) having inner diameters of about 3.83 to 6.54 inches (9.7 to 16.6 cm). Tool configurations for larger casing sizes are possible, depending on the I.D. of the slimhole region through which the casing must be accessed. In one embodiment, the production casing has a 4.5-inch O.D. and an I.D. ranging from 3.83 to 4.1 inches (9.7 to 10.4 cm), able (in run-in position) to pass through a slimhole region comprised of 2⅜$^{ths}$ inch O.D. (1.85 to 1.99-inch I.D.) standard oilfield tubing coupled with either a 1.78 to 1.87-inch I.D. seating nipple, packer, or both.

The method further provides jetting a lateral borehole into the subsurface formation. This is done by using hydraulic fluid. In one embodiment, the borehole is jetted at a depth of greater than 400 feet, and to a length of at least 50 feet (15.2 meters) from the wellbore. The tool assembly 300 can also be rotated around the casing I.D. allowing multiple radial boreholes to be created while still anchored in the casing.

Use of the downhole tool assembly 300 and the steps shown in FIGS. 10A through 10E beneficially allows the operator to continue production of a flowing well during the process of jetting a lateral borehole 1090. If no significant increase in oil and/or gas production rate is observed in connection with fluid returns, the operator may choose to cease jetting that specific mini-lateral. The operator can then index the assembly 300 using the indexing section to another radial direction, and form a new lateral borehole. Alternatively, the operator may release the slips 345 in the anchor section, and move the tool assembly 300 to a different depth within the target pay zone, or to a newly-targeted pay zone altogether, before beginning a new jetting procedure. Conversely, if favorable production increase is observed, the operator may attempt to maximize the length and/or diameter of that specific lateral borehole. Hence, "real time" production and pressure responses are realized in jetting boreholes using the assembly 300 herein.

Given the subject method and invention, no cement squeezes are required to remediate wells in these situations. A slimhole recompletion, where the casing leaks are isolated by running a packer on the end of the production tubing and/or cementing the production tubing in place inside the well's production casing, can immediately isolate the producing formation from the casing leak. Any drilling mud left in the wellbore opposite the producing formation can then be jetted out with the same coiled tubing unit that will subsequently perform the lateral jetting operations. The hydraulically jetted horizontal lateral boreholes will then be able to access "fresh rock" either: (1) well beyond the damaged area within the pay zone invaded by mud and/or mud filtrate; or, (2) along a different azimuth altogether from that of a mud-damaged interface of an original hydraulic fracture plane.

In addition to these benefits, the systems and methods allow the operator to maximize power output, as a larger jetting hose may be deployed as compared to the hose size that the operator could use with previously known systems and methods. The system utilizes substantially the entire inner diameter of the casing as the bend radius for a hydraulic jetting hose, thus providing for the maximum hydraulic horsepower at the jetting nozzle.

While it will be apparent that the inventions herein described are well calculated to achieve the benefits and advantages set forth above, it will be appreciated that the inventions are susceptible to modification, variation and change without departing from the spirit thereof. While it is realized that certain embodiments of the invention have been disclosed herein, it is perceived that further modifications will occur to those skilled in the art, and such obvious modifications are intended to be within the scope and spirit of the present invention.

What is claimed is:

1. A downhole tool assembly for forming a lateral borehole within a subsurface formation from an existing wellbore using hydraulic forces that are directed through a jetting hose, the wellbore having been completed with a string of production casing defining an inner diameter, and the tool assembly comprising:

a whipstock member having a curved face, with the curved face creating a bend radius for the jetting hose;

a pin, wherein:

the whipstock member is configured to rotate about the pin from a first run-in position such that the whipstock member may pass through a slim hole region along the wellbore, the slim hole region defining, an inner diameter that is less than the inner diameter of the production casing, to a second set position below the slim hole region in response to a force applied to the tool assembly within the wellbore, and in the set position, the whipstock member is configured to receive the jetting hose from the surface and to direct the jetting hose across the entire inner diameter of the production casing to a window location in the production casing; and slips configured to pivot from a first run-in position to a second set position, wherein the slips pivot outwardly to engage an inner wall of the production casing and to anchor the tool assembly in the set position in response to the force applied to the tool assembly.

2. The tool assembly of claim 1, wherein the slim hole region defines (i) one or more packers, (ii) one or more seating nipples, (iii) a production tubing, (iv) a repair casing, or (v) combinations thereof placed along the inner diameter of the production casing.

3. The tool assembly of claim 2, wherein:

the slim hole region is a production tubing; and the tool assembly has an outer diameter of about 1.6 inches to 2.3 inches in its run-in position.

4. The tool assembly of claim 3, wherein:

the whipstock member is configured to rotate substantially across, and the slips are configured to set in, production casing having an inner diameter of about 3.8 to 6.5 inches (9.7 to 16.6 cm).

5. The tool assembly of claim 1, wherein:

the whipstock member comprises a curved face configured to receive the jetting hose and redirect the hose about 90 degrees when the whipstock member is rotated into its set and operating position; and the force applied to the tool assembly comprises a hydraulic force.

6. The tool assembly of claim 5, further comprising:

an upper barrel and at least one lower barrel;

an opening along the upper barrel for permitting the whipstock member to rotate from its run-in position within the upper barrel to its set position transverse to the upper barrel; and an upper rod and at least one lower rod which move longitudinally relative to the upper barrel and the at least one lower barrel.

7. The tool assembly of claim 6, wherein:

the pin extends through both the whipstock member and the upper barrel; and the upper barrel comprises a slot in which the pin moves in response to longitudinal movement of the upper barrel and the at least one lower barrel.

8. The tool assembly of claim 6, further comprising:

a plurality of disc springs along a lower end of the jetting assembly, the disc springs providing an upward force against the slips.

9. The tool assembly of claim 6, further comprising:

an indexing section configured to rotate the whipstock member relative to the casing.

10. The tool assembly of claim 9, wherein the indexing section comprises:

an indexing mandrel configured to remain stationary relative to the production casing once the slips are in their set position;

an inner indexing sleeve having ratcheting teeth at both upper and lower ends, and configured to reciprocate longitudinally and to rotate within the wellbore;

an outer indexing sleeve configured to rotate within the wellbore;

an indexing rod configured to reciprocate longitudinally an upper indexing ratchet having a set of teeth at a lower end that mate with the teeth on the upper end of the inner indexing sleeve, the upper indexing ratchet being operatively engaged with the inner indexing sleeve so as to reciprocate longitudinally in response to movement of the inner indexing sleeve; and a lower indexing ratchet having a body, and having a set of teeth at an upper end of the body that mate with the teeth on the lower end of the inner indexing sleeve, the on the lower indexing ratchet being configured to reciprocate radially in response to the movement of an indexing pin residing in a slot along the body, thereby incrementally advancing the radial position of the whipstock member relative to the production casing.

11. The tool assembly of claim 6, further comprising:

a hose-guiding section for directing the jetting hose to the top of the whipstock member.

12. The tool assembly of claim 11, wherein the hose-guiding section comprises a series of descending deflection faces that translate from a first run-in position that permits the tool assembly to pass through the slim hole region, to a second set position in response to the hydraulic forces, wherein the deflection faces extend from the tool assembly towards the production casing in the set position to direct the jetting hose towards an upper end of the whipstock member.

13. A method for forming lateral boreholes within a subsurface formation from an existing wellbore, the wellbore having been completed with a string of production casing defining an inner diameter, and the method comprising:

providing a downhole tool assembly comprising:

a whipstock member having a curved face;

a pin, wherein:

the whipstock member is configured to rotate about the pin from a first run-in position wherein the diameter of the downhole tool has an inner diameter that is less than the inner diameter of the production casing, to a second set position in the wellbore, and the curved face defines a bend radius that, in the set position, extends across the inner diameter of the production casing for directing the jetting hose to a window location in the production casing; and slips configured to pivot from a first run-in position to a second set position, wherein the slips pivot outwardly to engage an inner wall of the production casing and to anchor the tool assembly in the set position in response to the force applied to the tool assembly;

running the tool assembly into the wellbore adjacent a subsurface formation at a window location;

applying a force to the tool assembly within the wellbore to cause the whipstock member to rotate from its first run-in position to its second set position, and to cause the slips to pivot from their run-in position to their set position;

running a jetting hose into the wellbore and along the curved face of the whipstock member within the production casing;

further running the jetting hose through a first window in the production casing; and still further running the jetting hose into the wellbore while injecting hydraulic fluid through the hose under pressure to create a first lateral borehole in the subsurface formation.

14. The method of claim 13, wherein:

the wellbore comprises a slim hole region defining an inner diameter that is less than the inner diameter of the production casing;

running the tool assembly into the wellbore adjacent the subsurface formation comprises running the tool assembly through the slim hole region to the window location adjacent the subsurface formation; and the force is applied to the tool assembly after the tool assembly has cleared the slim hole region and the whipstock member is located adjacent the window location.

15. The method of claim 14, wherein the first borehole extends from about 10 feet to 500 feet from the wellbore.

16. The method of claim 14, wherein the first borehole is formed at a wellbore depth greater than 400 feet.

17. The method of claim 14, wherein the first borehole is formed at a wellbore depth greater than 5,500 feet.

18. The method of claim 14, wherein the curved face of the whipstock member is configured to receive the jetting hose and redirect the hose about 90 degrees.

19. The method of claim 18, wherein:

the slim hole region is a production tubing; and the tool assembly has an outer diameter of about 1.6 inches to 2.3 inches (4.0 to 5.8 cm) in its run-in position.

20. The method of claim 19, wherein:

the whipstock member is configured to rotate substantially across, and the slips are configured to set in, production casing having an inner diameter of about 3.8 to 6.5 inches (9.7 to 16.6 cm).

21. The method of claim 14, wherein:

the wellbore is substantially horizontal at a depth of the subsurface formation; and the first lateral borehole extends substantially normal to the wellbore.

22. The method of claim 14, wherein:

the wellbore is substantially vertical at a depth of the subsurface formation; and the first lateral borehole extends substantially normal to the wellbore and along the plane of the subsurface formation.

23. The method of claim 14, further comprising:

using a milling assembly with a mill at an end, milling the first window in the production casing.

24. The method of claim 14, wherein:

running the tool assembly into the wellbore is done using coiled tubing; and the method further comprises:

using a hydraulic nozzle, jetting the first window with hydraulic fluid injected through the jetting hose and the nozzle.

25. The method of claim 24, wherein the hydraulic fluid comprises water and a suspended abrasive material.

26. The method of claim 25, further comprising:

producing formation fluids from the subsurface formation while injecting hydraulic fluid through the jetting hose and into the first lateral borehole.

27. The method of claim 24, wherein the downhole tool assembly further comprises:

an opening in the center of the whipstock; and an elongated whipstock rod residing in the opening of the whipstock, the whipstock rod having a variable diameter such that a large diameter portion of the whipstock rod resides in the opening while the whipstock is in its run-in position, but a smaller diameter portion is moved into the opening in response to setting the slips, thereby allowing the whipstock to rotate into its set position.

28. The method of claim 14, wherein the tool assembly further comprises an indexing section.

29. The method of claim 28, further comprising:

using the indexing section, changing the radial orientation of the whipstock member within the wellbore below the slim hole region.

30. The method of claim 29, wherein:

the indexing section comprises:

an indexing mandrel configured to remain stationary relative to the production casing once the slips are in their set position;

an inner indexing sleeve having ratcheting teeth at both upper and lower ends, and configured to reciprocate longitudinally and to incrementally advance rotationally within the wellbore;

an outer indexing sleeve configured to rotate within the wellbore;

an indexing rod configured to reciprocate longitudinally;

an upper indexing ratchet having teeth at a lower end that mate with the teeth on the upper end of the inner indexing sleeve, the upper indexing ratchet being operatively engaged with the inner indexing sleeve so as to reciprocate longitudinally in response to movement of the inner indexing sleeve; and a lower indexing ratchet having a body, and having teeth at an upper end of the body that mate with the teeth on the lower end of the inner indexing sleeve, the lower indexing ratchet being configured to reciprocate radially in response to movement of an indexing pin residing in a slot along the body, thereby incrementally advancing the radial position of the whipstock member relative to the production casing;

wherein the method further comprises;

applying and releasing actuation forces to the inner indexing sleeve by means of hydraulic pressure applied through a setting tool, wherein resulting movements of the indexing pin incrementally and radially advance the inner indexing sleeve relative to the production casing in order to change the radial orientation of the whipstock member.

31. The method of claim 28, further comprising:

discontinuing injecting hydraulic fluid through the jetting hose;

pulling the hose out of the first lateral borehole and the first window;

using the indexing section, rotating the whipstock member a selected number of degrees;

forming a second window in the production casing; and running the jetting hose into the wellbore and the second window while injecting hydraulic fluid through the hose under pressure to create a second lateral borehole in the subsurface formation.

32. The method of claim 31, further comprising:

using a hydraulic nozzle, jetting the second window with hydraulic fluid injected through the jetting hose, wherein the hydraulic fluid comprises water and a suspended abrasive material.

33. The method of claim 14, wherein the downhole assembly further comprises a hose-guiding section for directing the jetting hose to the top of the whipstock.

34. The method of claim 33, wherein the hose-guiding section comprises a series of descending deflection faces that translate from a first run-in position that permits the tool assembly to pass through the slim hole region, to a second set position in response to the hydraulic forces, wherein the deflection faces extend from the tool assembly towards the production casing in the set position to direct the jetting hose towards an upper end of the whipstock member.

* * * * *